US006869235B2

(12) United States Patent
Kawaguchi et al.

(10) Patent No.: US 6,869,235 B2
(45) Date of Patent: Mar. 22, 2005

(54) RECORDING APPARATUS

(75) Inventors: Koichiro Kawaguchi, Kanagawa (JP); Shinji Murata, Tokyo (JP); Masanori Kaneko, Kanagawa (JP); Noriyuki Sugiyama, Kanagawa (JP); Hiroyuki Saito, Kanagawa (JP); Koya Iwakura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/462,696

(22) Filed: Jun. 17, 2003

(65) Prior Publication Data

US 2004/0017459 A1 Jan. 29, 2004

(30) Foreign Application Priority Data

Jul. 10, 2002 (JP) ..... 2002-201831

(51) Int. Cl.[7] ..... B41J 3/407

(52) U.S. Cl. ..... 400/59; 400/55; 347/8; 347/104

(58) Field of Search ..... 400/23, 27, 28, 400/55, 56, 59, 521, 541, 542, 636.3, 639; 347/8, 104

(56) References Cited

U.S. PATENT DOCUMENTS 5,801,728 A 9/1998 Yanagi et al. ..... 347/50
2002/0067940 A1 * 6/2002 Sasai et al. ..... 400/61
2002/0085078 A1 * 7/2002 Tanno ..... 347/104
2002/0167557 A1 * 11/2002 Tanno ..... 347/8
2003/0234852 A1 * 12/2003 Oshima et al. ..... 347/104

FOREIGN PATENT DOCUMENTS

JP 11179888 A * 7/1999 ..... B41J/2/01
JP 2001199598 A * 7/2001 ..... B65H/11/00

OTHER PUBLICATIONS

Machine translation of JP 2001199598 to Motoki from Japanese Patent Office website.*

* cited by examiner

*Primary Examiner*—Daniel J. Colilla
(74) *Attorney, Agent, or Firm*—Fitzpatrick, Cella, Harper & Scinto

(57) ABSTRACT

A recording apparatus can mount a special recording material, such as a compact disc (CD) or the like, in a state of being accommodated in a tray and perform recording on the special recording material. In this recording apparatus, by an operation of mounting a tray guide into the main body of the recording apparatus, an arm of the tray guide is inserted between a spur base for holding a spur, and a platen for holding sheet discharge rollers. The spur base thereby raises to separate the spur from the sheet discharge roller, and a space to allow passage of the tray is formed.

27 Claims, 67 Drawing Sheets

(BEFORE MOUNTING CD CONVEYING UNIT)

(AFTER MOUNTING CD CONVEYING UNIT)

(STATE BEFORE MOUNTING CD CONVEYING UNIT)

(STATE IN WHICH SLIDE COVER IS MOVED AFTER MOUNTING CD CONVEYING UNIT)

(BEFORE MOVING SLIDE COVER)

(AFTER MOVING SLIDE COVER)

(WHEN LOWERING CARRIAGE)

(WHEN RAISING CARRIAGE)

RECORDING APPARATUS

BACKGROUND OF THE INVENTION

1. Field of the Invention

The present invention relates to a recording apparatus, such as a printer or the like, and more particularly, to a recording apparatus in which recording can be performed on a recording material other than standard paper, and the recording material is mounted in the main body of the recording apparatus in a state of being accommodated in a tray-shaped unit.

2. Description of the Related Art

Conventionally, a recording apparatus, such as a printer or the like, is expected to perform recording on each type of recording material as well as standard paper. For example, recording is performed on cardboard, a card, a CD(compact disc)-R (recordable), or a DVD (digital versatile disc). Such a recording material is sometimes smaller or thicker than standard recording paper, and it is impossible to convey the recording material by conveying means for conveying standard paper. Even if it can be conveyed, problems may arise such as inferior conveyance accuracy, damage on the recording material, and the like. Accordingly, a special recording material is mounted in the main body of a recording apparatus in a state of being accommodated within a dedicated protection tray, and is conveyed via a path different from a conveying path for standard paper.

More specifically, for example, a guide unit is provided in advance in the main body of the recording apparatus, or a guide member is mounted in the main body of the recording apparatus, and a tray is mounted while being guided by the guide unit or the guide member. When a recording material is mounted in the tray, a path for the tray is secured within the main body of the recording apparatus, for example, by operating a lever provided in the main body of the recording apparatus. That is, a sufficient space is secured by retracting a conveying member, such as a spur or the like, for performing pressure contact with the recording material from a position for standard paper. Then, for example, by further pushing the tray and again operating the lever, the tray is nipped by the conveying member, and the combined body including the tray is conveyed toward a recording unit and further toward a downstream portion.

As described above, conventionally, before performing recording on a recording material, the user must perform a series of operations of mounting the guide unit in the main body of the recording apparatus, mounting the tray, mounting the recording material in the tray, operating the lever, pushing the tray, and again operating the lever while confirming a tray pushing position.

When the user pushes the tray in a state in which the conveying member is not retracted by forgetting a lever operation, or the position of the lever is shifted from a predetermined position because of an incorrect lever operation, the tray or the recording material may contact a carriage mounting a recording head, or the conveying member may strongly contact the recording material (for example, a CD-R) on the tray, resulting in damage of the recording material or the conveying member, or great degradation in the quality of recording.

Furthermore, if the insertion angle of the tray is shifted due to a slight shift of the mounting position or the pushing position of the tray, when discharging the tray after completing recording, the tray may be damaged by riding on the guide member, or the quality of recording may be greatly degraded. In consideration of differences among users in the user's pushing operation, it is necessary to provide tray-position detection means for confirming the pushed position of the tray, and perform an operation of adjusting the position of the tray.

In the above-described configurations, a complicated mechanism is required, for example, because of the provision of a lever in the main body of the recording apparatus, resulting in a very high cost for dealing with a thick recording material, and an increase in the size of the main body.

SUMMARY OF THE INVENTION

It is an object of the present invention to provide a very reliable recording apparatus in which printing can be performed by accommodating a special recording material such as cardboard, a CD or the like, or a small-size recording material in a tray such that excellent operability is obtained, and degradation in the quality of recording caused by damage of the recording apparatus due to an erroneous operation, variations in the operation, and the like are prevented.

According to one aspect of the present invention, a recording apparatus for recording an image on a recording material using a recording head includes a tray for mounting a recording material, and a tray guide for guiding the tray. Linked with an operation of mounting the tray guide into a main body of the recording apparatus, a space to allow passage of the tray is formed.

According to the present invention, it is possible to perform recording by accommodating a special recording material, such as a CD, a small sheet or the like, within a tray. Accordingly, it is possible to protect a recording material without damaging it, straightly convey a circular recording material or the like irrespective of its shape, and deal with a small recording material so small that it cannot reach a conveying roller from an ordinary sheet feeding unit or manual insertion port.

According to the present invention, when dealing with a special recording material, such as cardboard, a CD or the like, a path for a tray for the recording material is linked securely by mounting a tray guide. Accordingly, the recording material can be assuredly conveyed without performing an erroneous operation, and the recording material or the main body of a recording apparatus is not damaged.

Conventionally, the user must secure a conveying path, for example, by lowering a pinch roller by operating a member, such as an intersheet-distance adjusting lever or the like. In the present invention, however, such manual operation is unnecessary. Accordingly, it is possible to prevent damage of the main body of a recording apparatus or a recording material, or degradation of the main body of a recording due to a user's erroneous operation or omission of an operation. Furthermore, since the lever and the like can be omitted, the production cost, and the size of the recording apparatus is reduced. Since the recording material or the tray is not in pressure contact with a recording material conveying member, a trace of the recording material conveying member on the recording material can be prevented. When performing consecutive recording on various recording materials, since a conveying path can be immediately secured, usability by the user is improved and the operation efficiency is improved.

The foregoing and other objects, advantages and features of the present invention will be more apparent from the following detailed description of the preferred embodiments taken in conjunction with the accompanying drawings.

DETAILED DESCRIPTION OF THE PREFERRED EMBODIMENTS

Preferred embodiments of the present invention will now be described with reference to the drawings.

(First Embodiment)

Figure 1:
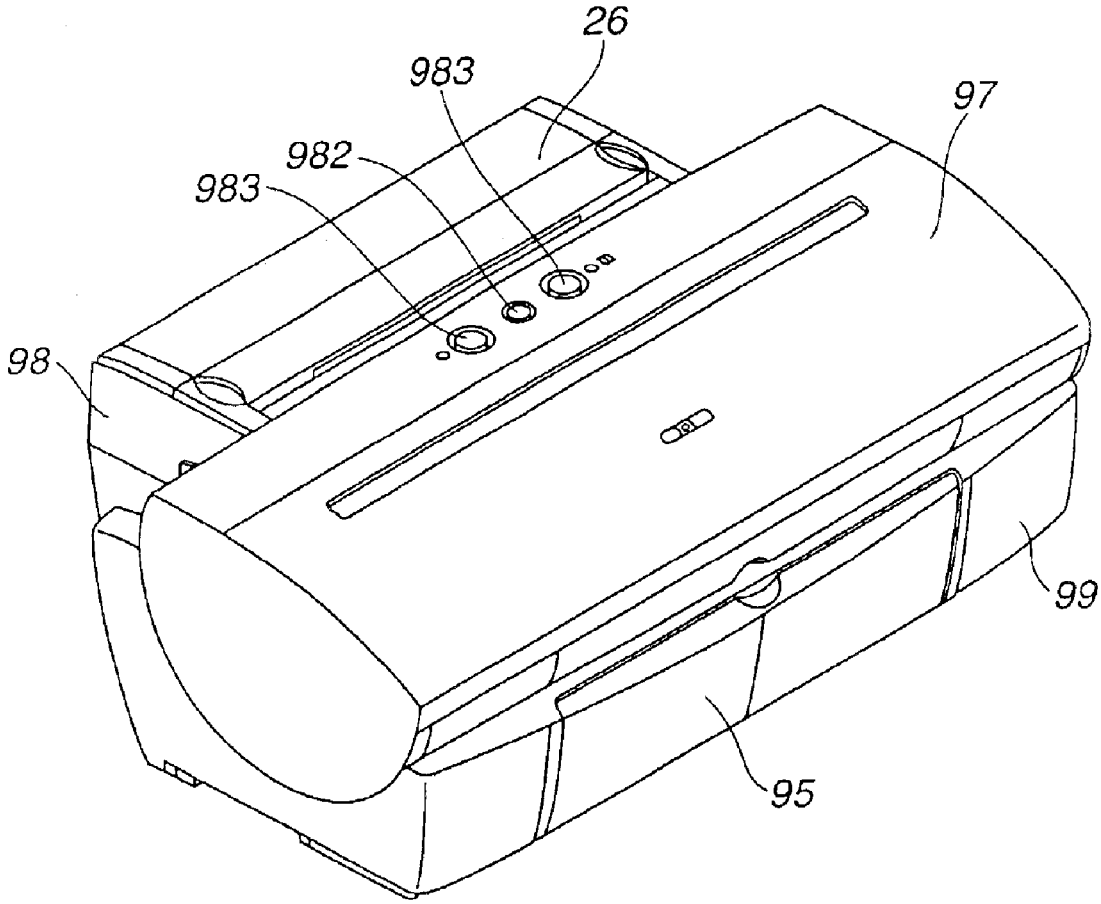
FIGS. 1 and 2 are perspective views, each illustrating a recording apparatus according to a first embodiment of the present invention.
Figure 2:
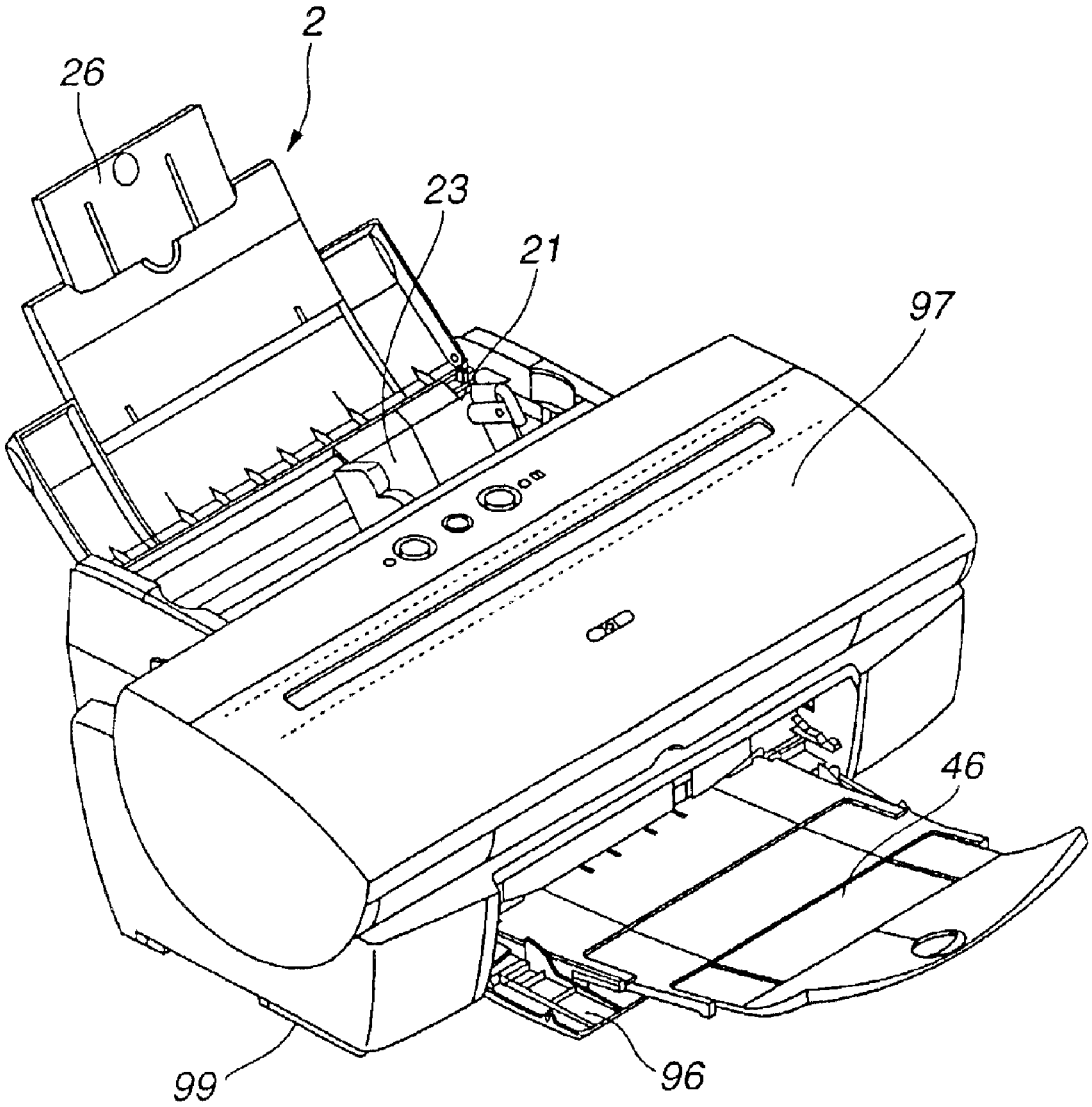
Figure 3:
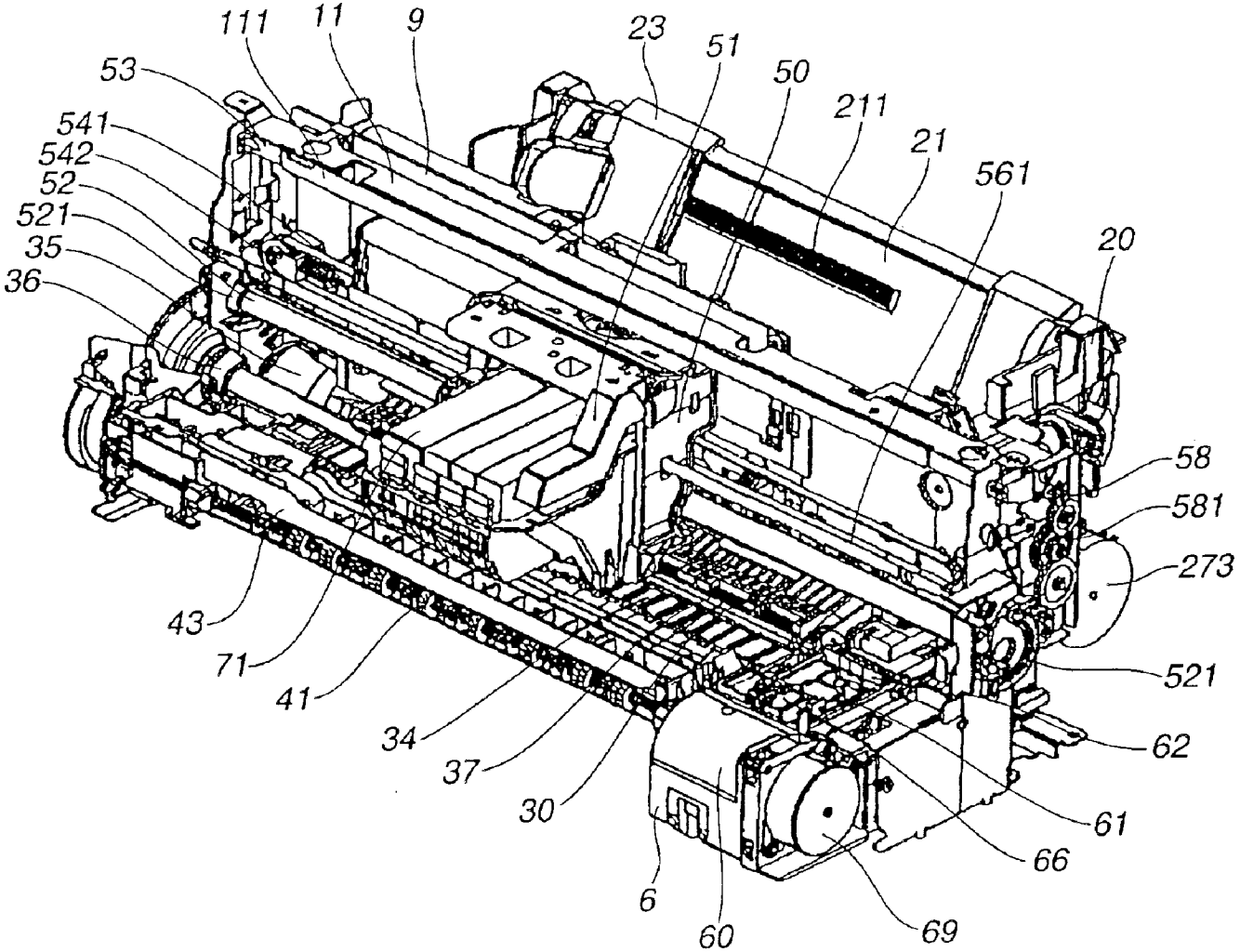
FIGS. 3 and 4 are perspective views, each illustrating an internal mechanism of the recording apparatus of the first embodiment.
Figure 4:
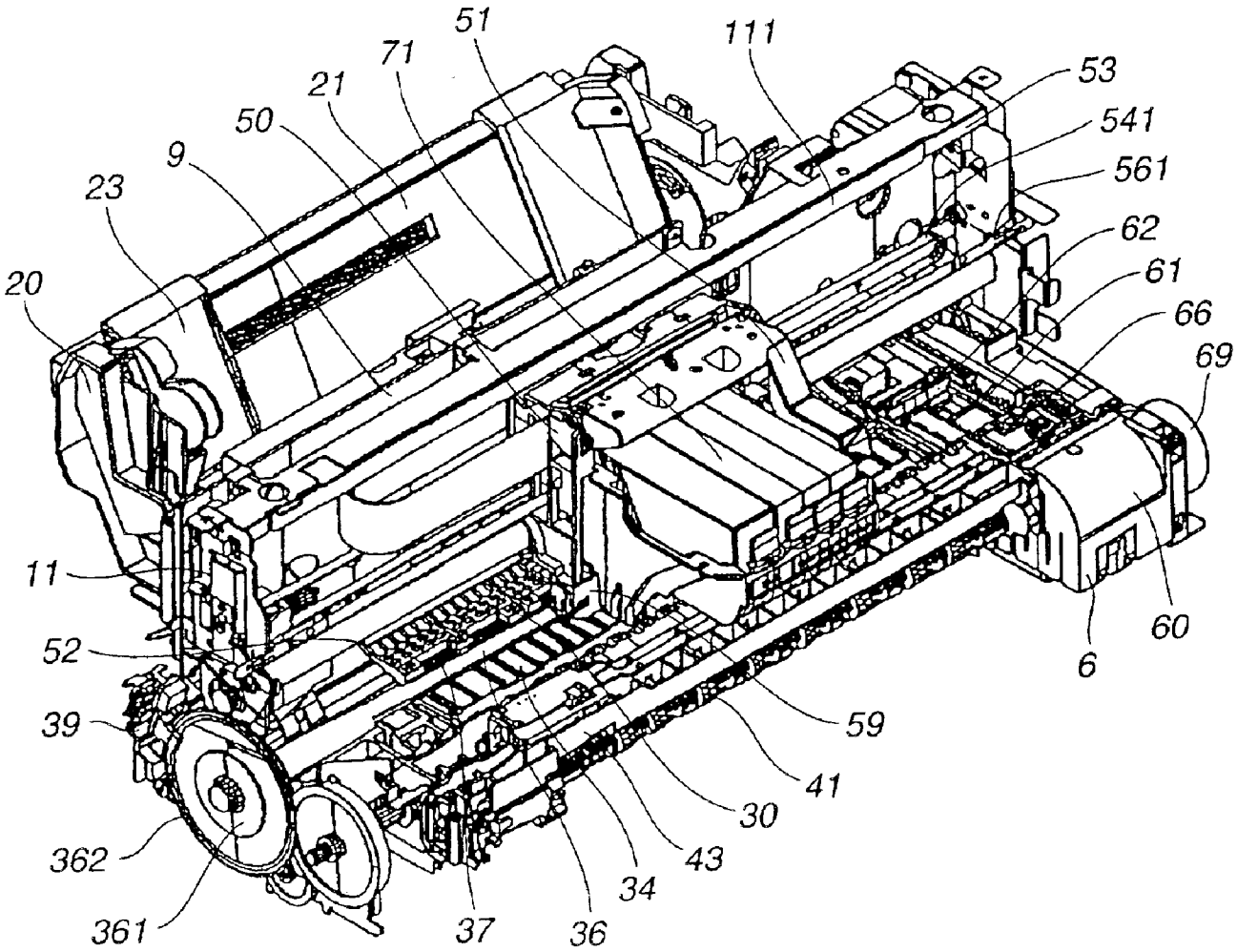
Figure 5:
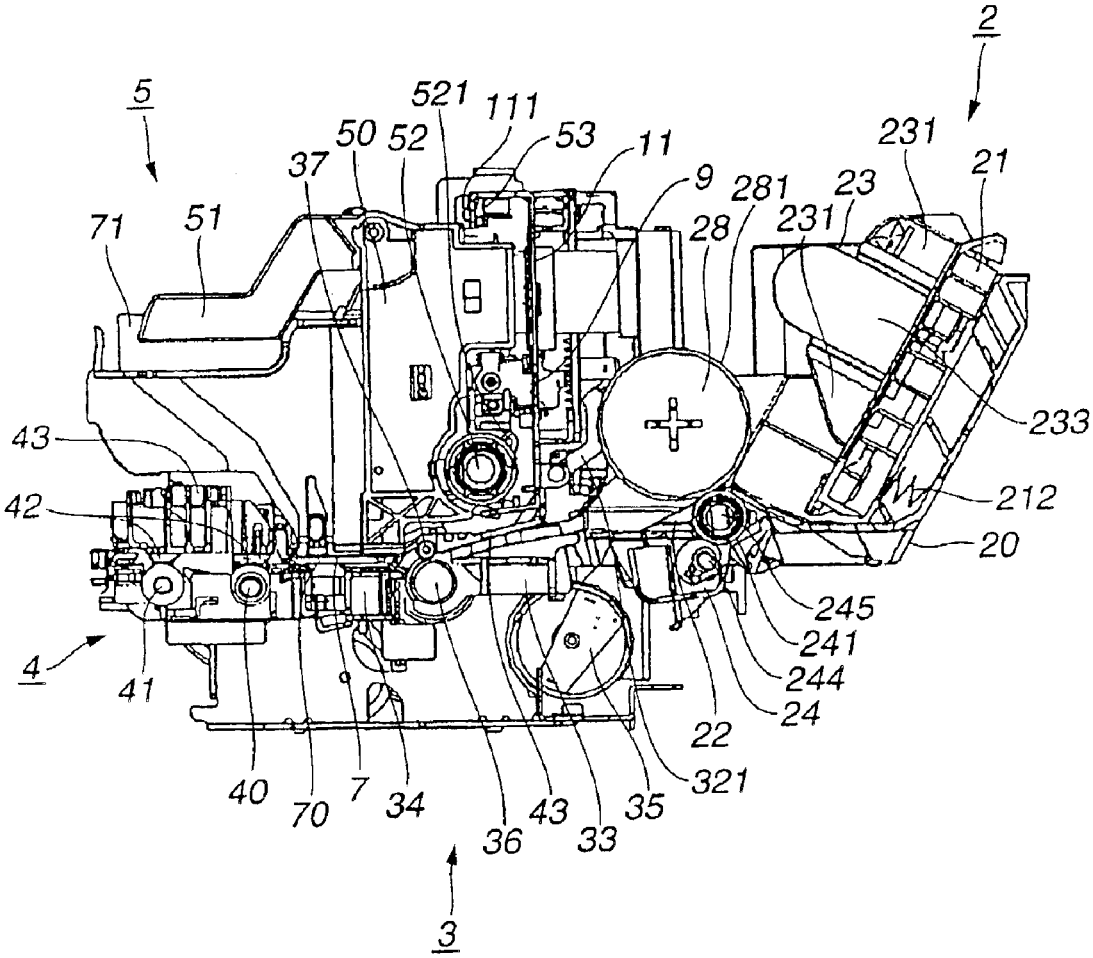
FIG. 5 is a cross-sectional view of the recording apparatus of the first embodiment.

The basic configuration of a recording apparatus according to a first embodiment of the present invention will now be described with reference to FIGS. 1–5. FIGS. 1 and 2 are perspective views illustrating the recording apparatus of the first embodiment. FIGS. 3 and 4 are perspective views illustrating an internal mechanism of the recording apparatus of the first embodiment. FIG. 5 is a cross-sectional view of the recording apparatus of the first embodiment. The recording apparatus includes a sheet feeding unit 2, a sheet conveying unit 3, a sheet discharge unit 4, a carriage unit 5, a cleaning unit 6, a recording head 7, a unit 8 for conveying a special recording material (for example, a CD), and an electric unit. An outline of each of these units will now be sequentially described.

(A) Sheet Feeding Unit

As shown in FIG. 5, in the sheet feeding unit 2, a pressing plate 21 for mounting a standard sheet material, serving as an ordinary recording material, a sheet feeding roller 28 for feeding the sheet material, a separation roller 241 for separating sheets of the sheet material, a return lever 22 for returning the sheet material to a mounting position, and the like are mounted on a base 20. A sheet feeding tray 26 (see FIGS. 1 and 2) for holding mounted sheets of the sheet material is mounted on the base 20 or an armored unit (to be described later). The sheet feeding tray 26 has a multi-step structure, and is used by being drawn.

The sheet feeding roller 28 has the shape of a cylinder, and has sheet-feeding-roller rubber 281 provided at a sheet conveying reference position in order to feed the sheet material. The sheet feeding roller 28 is driven by a dedicated sheet feeding motor 273 (see FIG. 3) provided at the sheet feeding unit 2 via a driving transmission gear and a planetary gear.

A movable side guide 23 is movably provided on the pressing plate 21, in order to regulate a mounting position for the sheet material. The pressing plate 21 can be rotated around a rotating shaft provided on the base 20, and is urged toward the sheet feeding roller 28 by a pressing-plate spring 212. At a portion of the pressing plate 21 facing the sheet feeding roller 28, there is provided a separation sheet made of a material having a large coefficient of friction, such as artificial leather or the like, for preventing multiple feeding of upper sheets of the sheet material. The pressing plate 21 is configured so as to contact or separate from the sheet feeding roller 28 by means of a pressing-plate cam.

A separation-roller holder 24 mounted on the separation roller 241 for individually separating sheets of the sheet material is provided so as to be rotatable around a rotating shaft provided on the base 20, and is urged toward the sheet feeding roller 28 by a separation-roller spring. A clutch spring is mounted on the separation roller 241, so that the separation roller 241 rotates when a load exceeding a predetermined amount is applied. The separation roller 241 is configured so as to contact or separate from the sheet feeding roller 28 by means of a separation-roller release shaft and a control cam. The positions of the pressing plate 21, the return lever 22 and the separation roller 241 are detected by an ASF sensor.

The return lever 22 for returning the sheet material to the mounting position is rotatably mounted on the base 20, and is urged in a release direction by a return-lever cam. When returning the sheet material, the return lever 22 is rotated by a control cam.

An operation of feeding the sheet material in the sheet feeding unit having the above-described configuration will now be described.

In an ordinary waiting state, the pressing plate 21 is controlled by the pressing-plate cam, and the separation roller 241 is controlled by the control cam. The return lever 22 is at an initial position of returning the sheet material and blocking an entrance so as to prevent mounted sheets of the sheet material from entering a rear portion. When a sheet feeding operation is started from this state, the separation roller 241 first contacts the sheet feeding roller 28 by being driven by a motor. Then, the return lever 22 is released and the pressing plate 21 contacts the sheet feeding roller 28. In this state, feeding of the sheet material is started. The sheet material is restricted at a front-stage separation unit provided on the base 20, and only a predetermined number of sheets of the sheet material are fed to a nip portion constituted by the sheet feeding roller 28 and the separation roller 241. The fed sheets are separated at the nip portion, and only the uppermost sheet is conveyed.

When the conveyed sheet material reaches a nip portion between a conveying roller 36 and a pinch roller 37 (to be described later), the pressing plate 21 and the separation roller 28 are controlled by the pressing-plate cam and the control cam, respectively, and the return lever 22 is returned to the mounting position by the control cam. At that time, the sheet material that has reached the nip portion constituted by the sheet feeding roller 28 and the separation roller 241 is returned to the mounting position.

(B) Sheet Conveying Unit

The sheet conveying unit 3 is mounted on a chassis 11 formed by bending a sheet metal, and includes the conveying roller 36 for conveying the sheet material and a PE sensor. The conveying roller 36 is made by coating fine ceramic particles on the surface of a metal shaft, and is mounted on the chassis 11 in a state in which metal portions at both ends of the shaft are supported by bearings. In order to cause the conveying roller 36 to perform stable conveyance by being provided with a load during rotation, conveying-roller tension springs are provided between the bearings and the conveying roller 36. The conveying-roller tension springs provide a predetermined load by urging the conveying roller 36.

A plurality of driven pinch rollers 37 are provided so as to contact the conveying roller 36. The pinch rollers 37 are held by a pinch-roller holder 30, are brought in pressure contact with the conveying roller 36 by being urged by a pinch-roller spring 31, to generate a sheet-material conveying force. The rotating shaft of the pinch-roller holder 30 is mounted in a bearing of the chassis 11, and the pinch rollers 37 rotate around the rotating shaft.

At an entrance of the sheet conveying unit 3 where the sheet material is conveyed, a paper guide flapper 33 for guiding the sheet material and a platen 34 are disposed. A PE-sensor lever 321 for transmitting detection of the leading edge and the trailing edge of the sheet material to the PE sensor is provided at the pinch-roller holder 30. The platen 34 is mounted on the chassis 11 by being positioned. The paper-guide flapper 33 is rotatable around a bearing unit where the conveying roller 36 is fitted and slidably moves, and is positioned by contacting the chassis 11.

A sheet pressing unit covering an end portion of the sheet material is provided at the sheet-conveying reference position side. As a result, even in a sheet whose end portion is deformed or curled, interference of the sheet with a carriage 50 or the recording head 7 due to a raise of the end portion does not occur. The recording head 7 for forming an image based on image information is provided at a portion downstream from the conveying roller 36 in the sheet-material conveying direction.

In the sheet conveying unit 3 having the above-described configuration, the conveyed sheet material reaches the nip portion formed by the conveying roller 36 and the pinch roller 37 by being guided by the pinch-roller holder 30 and the paper-guide flapper 33. At that time, the PE-sensor lever 321 detects the leading edge of the conveyed sheet material, and a recording position for the sheet material is obtained based on the detection. The sheet material is conveyed on the platen 34 by rotation of a pair of rollers 36 and 37 by being driven by a conveyance motor 35. A rib for determining the sheet-conveying reference position is formed on the platen 34, in order to manage a gap with the recording head 7. The rib also suppresses undulation of the sheet material in cooperation with the sheet discharge unit 4 (to be described later).

The conveying roller 36 is driven by transmission of the revolving force of the conveyance motor 35, that is a DC motor, to a pulley 361 provided on the shaft of the conveying roller 36 via a timing belt. On the shaft of the conveying roller 36, there is provided a code wheel 362, in which marking is formed with a pitch of 150–300 lpi (lines per inch), for detecting the conveying amount of the conveying roller 36. An encoder sensor for reading the marking is mounted at a position adjacent to the code wheel 362 on the chassis 11.

The recording head 7 is an ink-jet recording head that mounts a plurality of independent exchangeable ink tanks 71 for respective colors. By providing ink with heat using a heater or the like, ink performs film boiling, and an image is formed on the sheet material by discharging ink from a nozzle due to a change in the pressure caused by the growth of a bubble as a result of the film boiling.

(C) Carriage Unit

The carriage unit 5 has the carriage 50 mounting the recording head 7. The carriage 50 is supported by a guide shaft 52 and a guide rail 111 for maintaining the interval between the recording head 7 and the sheet material while holding the rear end of the carriage 50, and can perform reciprocating scanning in a direction orthogonal to the sheet-material conveying direction. The guide shaft 52 is mounted on the chassis 11, and the guide rail 111 is integrated with the chassis 11. At the carriage 50 side of the guide rail 111, there is provided a thin-plate sliding sheet 53 made of stainless steel or the like, in order to reduce sliding sound.

The carriage 50 is driven by a carriage motor mounted on the chassis 11 via a timing belt 541. The timing belt 541 is supported in a state in which a tension is applied by an idle pulley 542. The timing belt 542 is connected to the carriage 50 via a dumper made of rubber or the like, and attenuates vibration of the carriage motor and the like to reduce, for example, unevenness in the obtained image. A code strip 561, in which marking is formed with a pitch of 150–200 lpi, for detecting the position of the carriage 50 is provided in parallel to the timing belt 541. In addition, an encoder for reading the marking is provided on a carriage substrate mounted on the carriage 50. Contacts for providing electric connection with the recording head 7 are also provided on the carriage substrate. A flexible substrate for transmitting a head signal from an electric substrate to the recording head 7 is mounted on the carriage 50.

In order to fix the recording head 7 on the carriage 50, a contact unit for performing positioning and pressing means for fixing the carriage 50 by pushing it are provided in the carriage 50. The pressing means is mounted on a head-set lever 51 so as to operate on the recording head 7 when setting the head-set lever 51 by rotating it.

Eccentric cams 521 are provided at both ends of the guide shaft 52. By transmission of the driving force of a carriage raising/lowering motor 58 to the eccentric cam 521 via a gear train 581, the guide shaft 52 is raised or lowered. As a result, the carriage 50 is raised or lowered, so that an optimum gap can be provided with each of recording materials having different thicknesses. The carriage raising/lowering motor 58 is started when a tray 83 (to be described later) is mounted in the main body of the recording apparatus.

Figure 6:
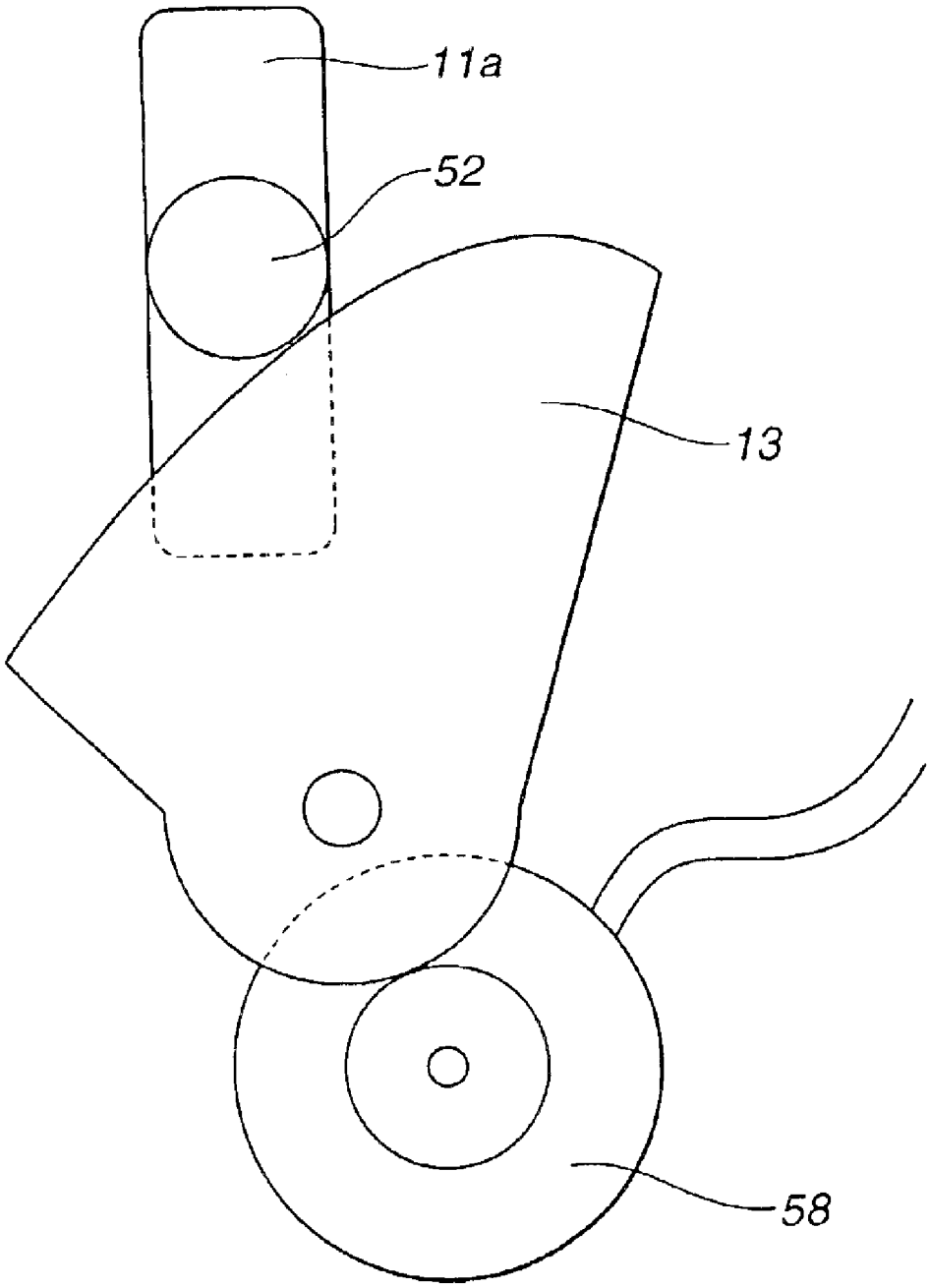
FIG. 6 is a schematic diagram illustrating a guide-shaft raising/lowering mechanism in which a carriage is mounted.

As schematically shown in FIG. 6, a configuration may be adopted in which the guide shaft 52 is pushed downward by a spring (not shown) so as to be movable only in vertical directions by being guided by a slit 11*a* opened in the chassis 11, a cam 13 raises the guide shaft 52 by rotating in a counterclockwise direction, and the carriage 50 moves upward together with the guide shaft 52. The moving amount of the guide shaft 52 and the carriage 50 is variable depending on the angle of revolution of the carriage raising/lowering motor 58. For example, the carriage 50 moves upward by about 2.5 mm and 1 mm when the thickness of the tray 83 is 2.5 mm and when the thickness of cardboard is 1 mm, respectively.

As will be described later, a space is provided so that a special recording material or the tray 83 for holding the recording material does not interfere with the carriage 50 and the recording head 7. The interval between the carriage 50 and the platen 34 may be increased by moving the guide shaft 52 by driving the carriage raising/lowering motor 58 after performing electric determination by switching on a tray-guide detection sensor 344 by a projection provided at a tray guide 82. Alternatively, a long arm may be provided at the tray guide 82, and the guide shaft 52 may be mechanically raised by the arm. In some cases, there is a sufficient space between a spur base 43, a recording material or the tray 83 and the carriage 50 depending on the positions and the shapes of respective components, and it is unnecessary to retract the carriage 50 upward. Generally, in the recording apparatus firmware, the position of the carriage 50 is recognized. When it is determined that there is a sufficient space between the position and the spur base 43, the recording material or the tray 83, the carriage 50 is not retracted upward. In this case, when an instruction for a recording operation arrives and it is determined that a space with the carriage 50 is not present, the carriage 50 may be moved upward by raising the guide shaft 52 by operating the cam 13 or 521 by the carriage raising/lowering motor 58.

A tray-position detection sensor 59, comprising a reflection-type light sensor, for detecting a mark 82 for position detection on the tray 83 for CD printing (to be described later) is mounted on the carriage 50. This sensor 59 can detect the position of the tray 83 by emitting light from a light-emitting device and sensing reflected light.

In the above-described configuration, when forming an image on a sheet material, the pair of rollers 36 and 37 convey the sheet material to a line position for image formation (a position in the sheet-material conveying direction), and the carriage motor moves the carriage 50 to a column position for image formation (a position in a direction perpendicular to the sheet-material conveying direction) to cause the recording head 7 to face an image forming position. Then, an image is formed by discharging ink from the recording head 7 toward the sheet material in accordance with a signal from the electric substrate.

(D) Sheet Discharge Unit

The sheet discharge unit 4 includes two sheet discharge rollers 40 and 41, spurs 42 capable of performing driven rotation by contacting the sheet discharge rollers 40 and 41 with a predetermined pressure, a gear train for transmitting the driving force to the sheet discharge rollers 40 and 41, and the like.

The sheet discharge rollers 40 and 41 are mounted on the platen 34. The upstream-side sheet discharge roller 40 is obtained by providing a plurality of rubber members on a metal shaft, and rotates by transmission of a driving force from the conveying roller 36 to the sheet discharge roller 40 via an idler gear. The sheet discharge roller 41 is obtained by mounting a plurality of elastic members made of elastomer on a resin shaft. The driving force to the sheet discharge roller 41 is transmitted from the sheet discharge roller 40 via an idler gear.

Each of the spurs 42 is obtained by integrally forming a stainless-steel thin plate, having a plurality of projections provided at the circumference thereof, around a resin central core, and is mounted on the spur base 43. Each of the spurs 42 is mounted on the spur base 43 by a spur spring that is a coil spring, and is brought in pressure contact with a corresponding one of the sheet discharge rollers 40 and 41, and the like. The spurs 42 are provided at positions corresponding to the rubber member and the elastic member of the sheet discharge rollers 40 and 41, respectively, in order to mainly produce a conveying force for the sheet material, and at positions where the rubber member and the elastic member of the sheet discharge rollers 40 and 41, respectively, are absent in order to mainly suppress a raise of the sheet material during a recording operation.

A sheet-end support for preventing the sheet discharge rollers 40 and 41 from rubbing a recording portion on the sheet material by holding both ends of the sheet material at a portion upstream from the sheet discharge rollers 40 and 41 is provided between the sheet discharge rollers 40 and 41. The sheet-end support is configured such that a resin member having a roller provided at a leading edge thereof is urged by a sheet-end-support spring, and the roller is pressed against the sheet material with a predetermined pressure, to provide stiffness by raising both ends of the sheet material.

According to the above-described configuration, the sheet material having an image formed at the carriage unit 50 thereon is conveyed by being grasped between the sheet discharge roller 41 and the spur 42, and is discharged onto a discharged-sheet tray 46. The discharged-sheet tray 46 is divided into a plurality of portions so as to be accommodated in a lower portion of a lower case 99 (to be described later), and is used in a state of being drawn. The discharged-sheet tray 46 is raised toward the distal end thereof, and both end portions of the discharged-sheet tray 46 are high, so as to allow improvement of the mountability of discharged sheets and prevention of abrasion of a recorded surface.

(E) Cleaning Unit

The cleaning unit 6 includes a pump 60 for cleaning the recording head 7, a cap 61 for preventing drying of the recording head 7, blades 62 for cleaning the nozzle surface of the recording head 7, and the like.

A cleaning motor 69 dedicated for cleaning causes the pump 60 to operate by revolution in one direction, and causes the blades 62 to operate and the cap 61 to perform a raising/lowering operation by revolution in another direction, by means of a one-way clutch.

The pump 60 generates a negative pressure by squeezing two tubes by pump rollers, and is connected from the cap 61 via a halfway valve or the like. When the pump 60 is caused to operate in a state in which the cap 61 is brought in tight contact with the recording head 7, unnecessary ink or the like is sucked from the recording head 7. A cap absorber is provided in the cap 61 in order to reduce the amount of ink remaining on the nozzle surface of the recording head 7 after suction. In order to prevent problems caused by solidification of ink remaining on the nozzle surface, ink remaining within the cap 61 is sucked by the pump 60 in a state in which the cap 61 is open. Waste ink sucked by the pump 60 is absorbed and held by a waste-ink absorbing member 991 provided in the lower case 99.

A series of operations, such as the operations of the blades 62, the raising/lowering operation of the cap 61, opening/closing of the valve, and the like, are controlled by a main cam having a plurality of cams provided on the shaft thereof. Cams and arms at respective portions perform predetermined operations by being operated by the main cam. The position of the main cam can be detected by a position detection sensor, such a photo-interrupter or the like. While the cap 61 descends, the blades 62 move in a direction perpendicular to the scanning direction of the carriage 50, to clean the nozzle surface of the recording head 7. Some of the blades 62 clean a portion near the nozzle of the recording head 7, and another blades 62 clean the entire nozzle surface. As a result of contact of the blades 62 with a blade cleaner 66 when they move to the most rear portion, ink and the like adhering to the blades 62 are removed.

(F) Armored Unit

The above-described respective units are assembled on the chassis 11 to form a mechanical portion of the printer. An armored unit is mounted so as to surround the units. The armored unit mainly includes the lower case 99, an upper case 98, an access cover 97, a connector cover 96, and a front cover 95.

A discharged-sheet-tray rail is provided at a lower portion of the lower case 99, so as to be able to accommodate the divided discharged-sheet tray 46. The front cover 95 blocks a discharge port when the apparatus is not used.

The access cover 97 is rotatably mounted on the upper case 98. An opening is formed at a portion of the upper surface of the upper case 98, so that an ink tank 71 and the recording head 7 can be exchanged at this position. In addition, a door-switch lever for detecting opening/closing of the access cover 97, an LED (light-emitting diode) guide 982 for performing display by transmitting light from an LED, a key switch 983 for operating on a switch on the substrate, and the like are provided at the upper case 98. Furthermore, a multi-step sheet feeding tray 26 is rotatably mounted on the upper case 98. When the sheet feeding unit is not used, the sheet feeding tray 26 is accommodated to become a cover of the sheet feeding unit.

The upper case 98 and the lower case 99 are connected by elastic engaging pawls, and a connector forming portion between the upper case 98 and the lower case 99 is covered with the connector cover 96.

(G) CD Conveying Unit

Next, the conveying unit (CD conveying unit) 8 for a special recording material and a method for performing printing on the special recording material (CD) that constitute a feature of the present invention will be described in detail with reference to FIGS. 7A–27.

Figure 7A:
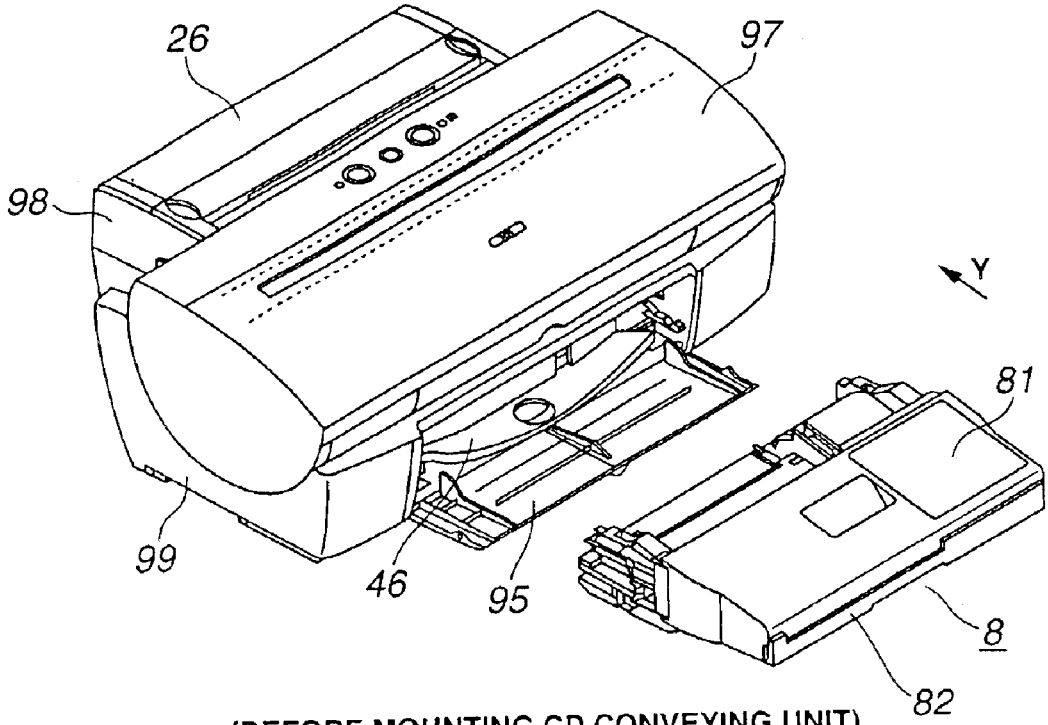
FIGS. 7A and 7B are perspective views illustrating states before and after mounting a CD conveying unit in the main body of the recording apparatus of the first embodiment, respectively.
Figure 7B:
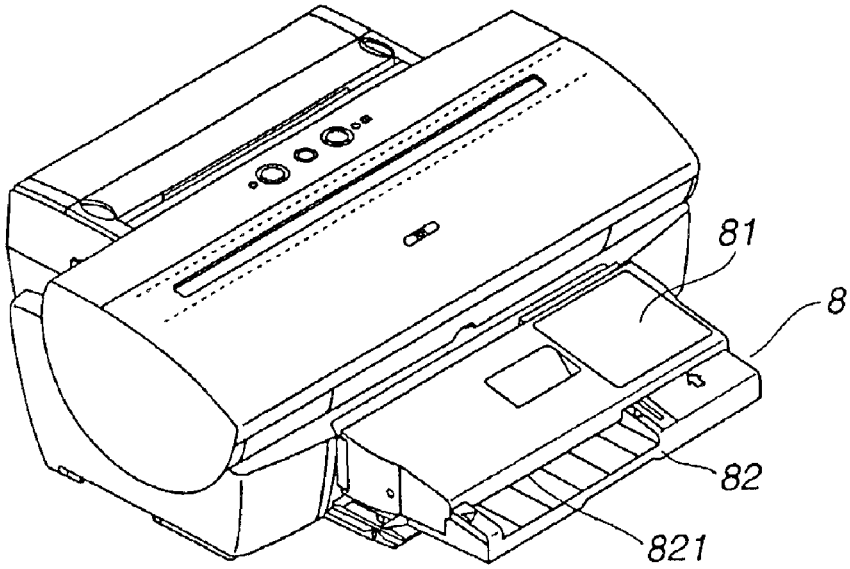
Figure 8:
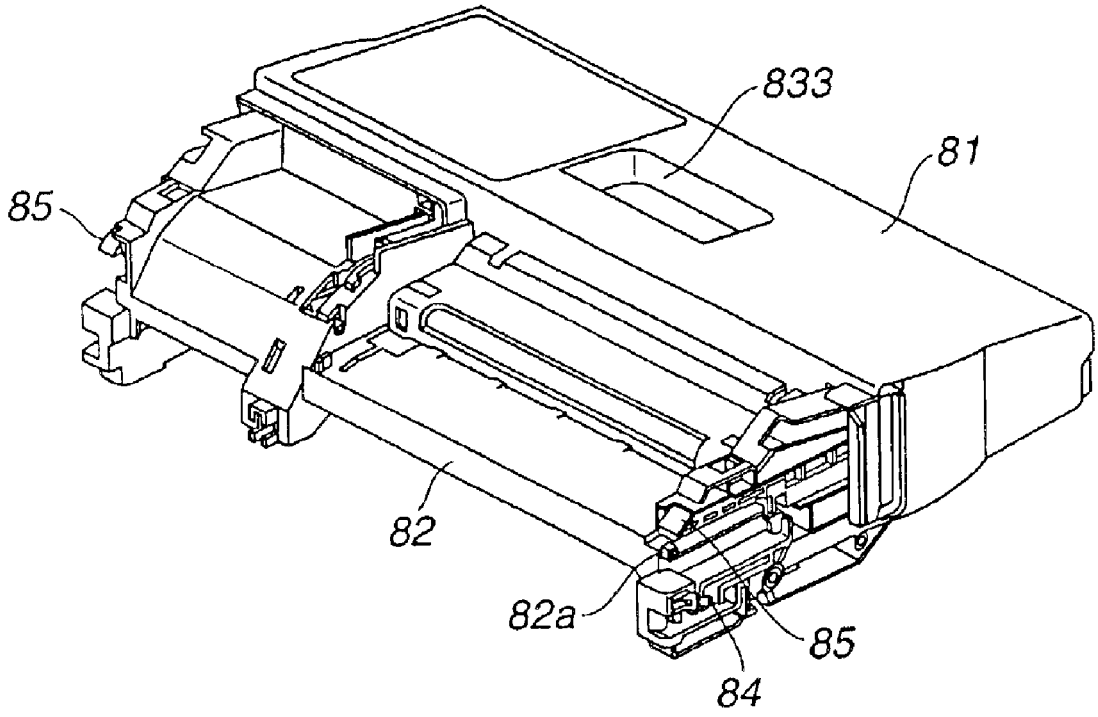
FIG. 8 is a perspective view illustrating the CD conveying unit of the first embodiment.
Figure 9:
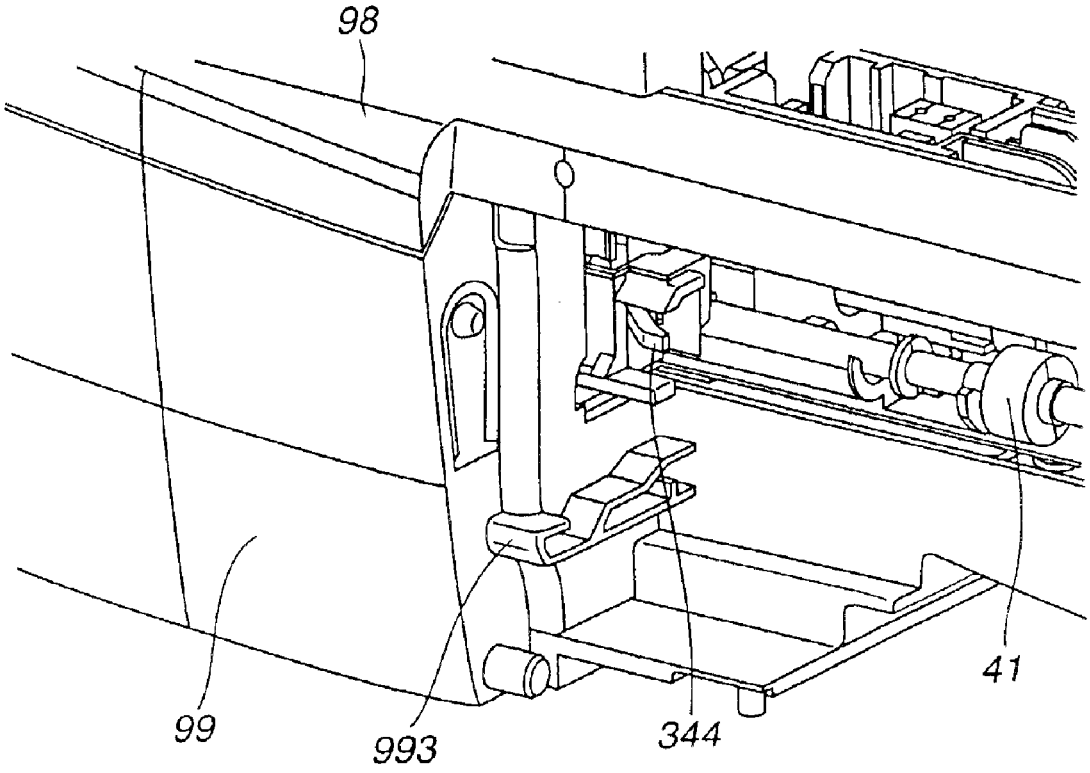
FIG. 9 is a diagram illustrating the configuration of a mounting unit and a mounting detection unit for the CD conveying unit in a lower case of the recording apparatus of the first embodiment.
Figure 10:
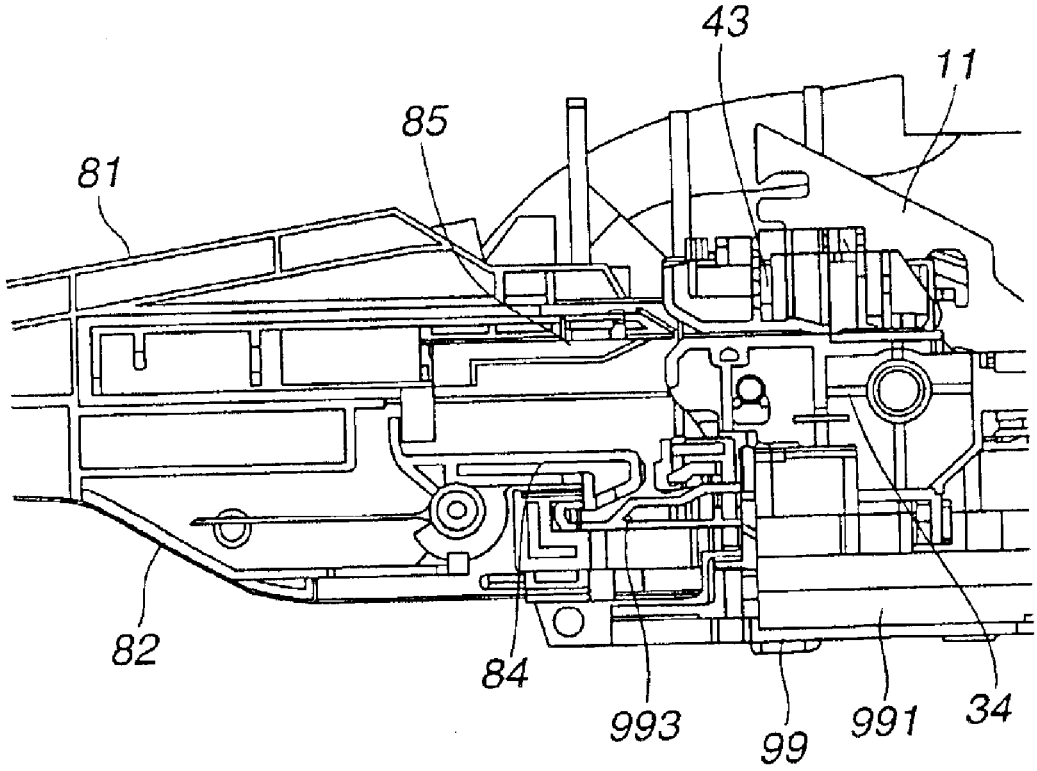
FIG. 10 is a diagram illustrating mounting of a hook of the CD conveying unit in the lower case.
Figure 11A:
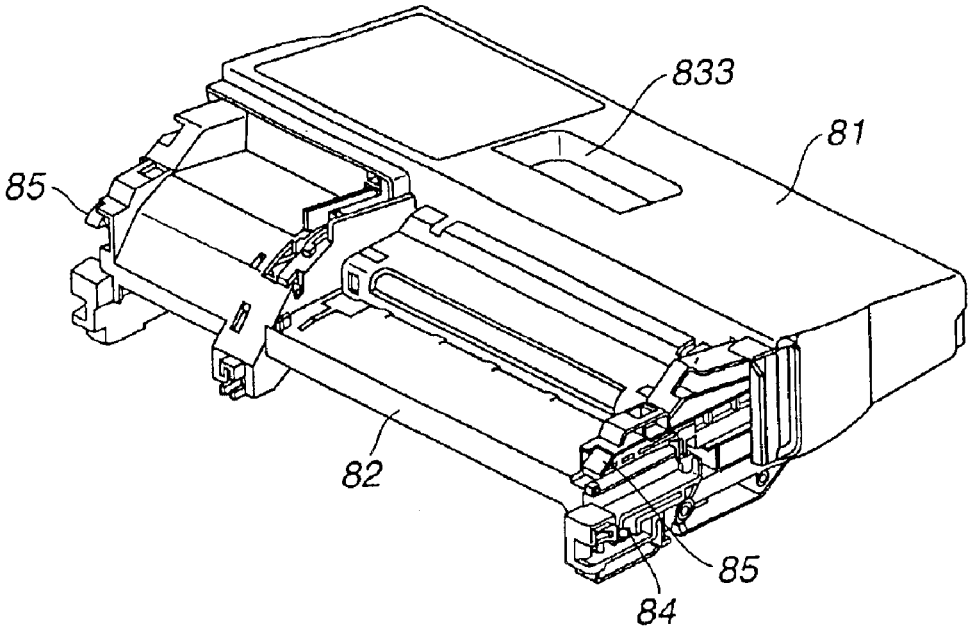
FIGS. 11A and 11B are perspective views illustrating a state before mounting the CD conveying unit and a state in which a slide cover is moved after mounting the CD conveying unit, respectively, in the first embodiment.
Figure 11B:
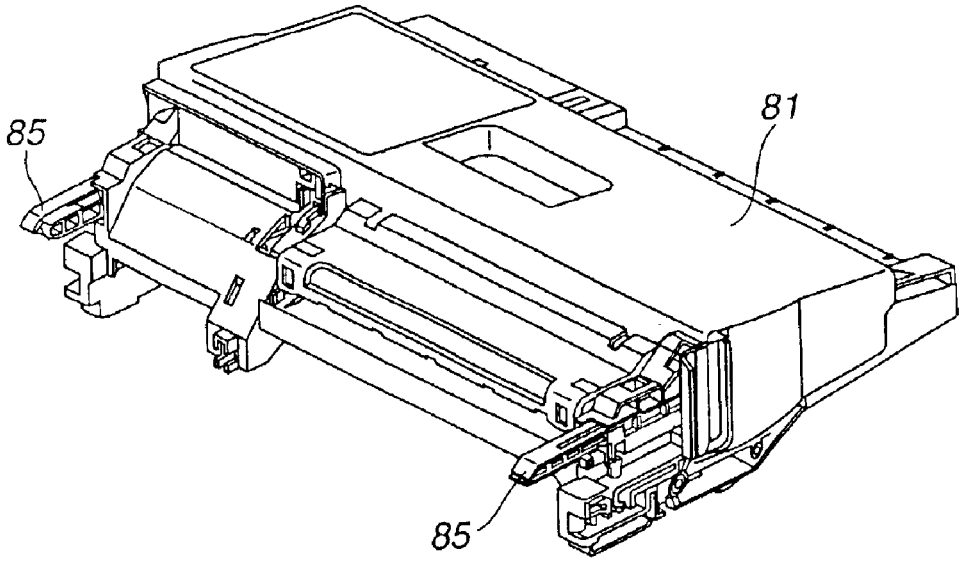
Figure 12:
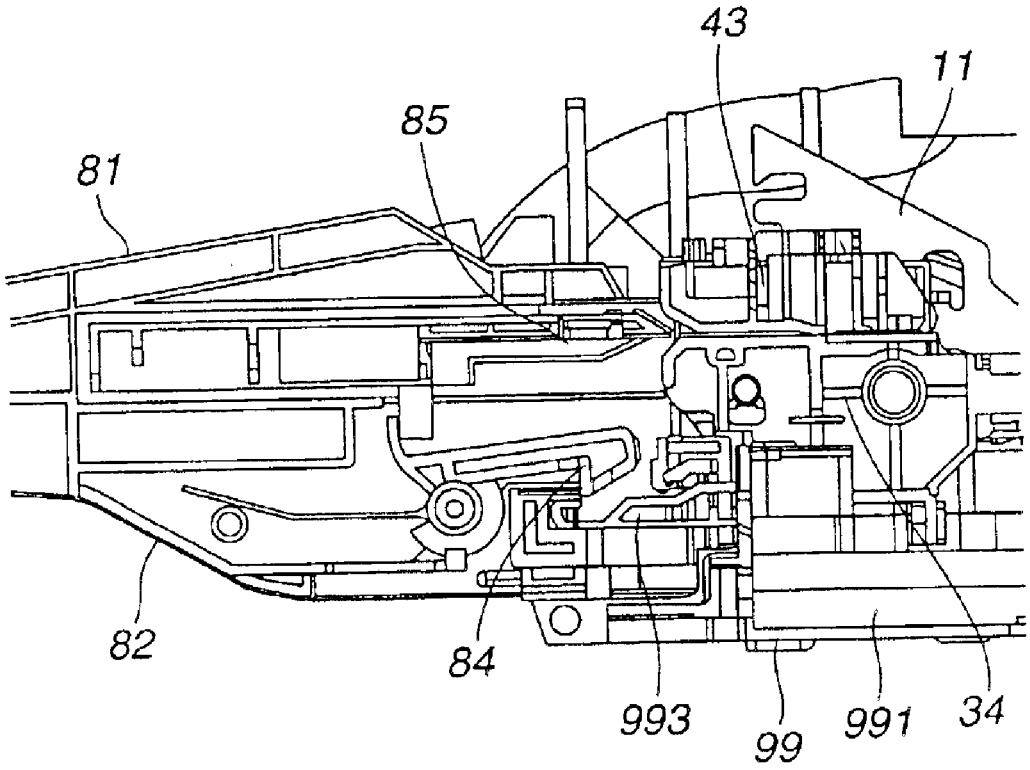
FIG. 12 is a diagram illustrating release of the hook of the CD conveying unit from the lower case, in the first embodiment.
Figure 13A:
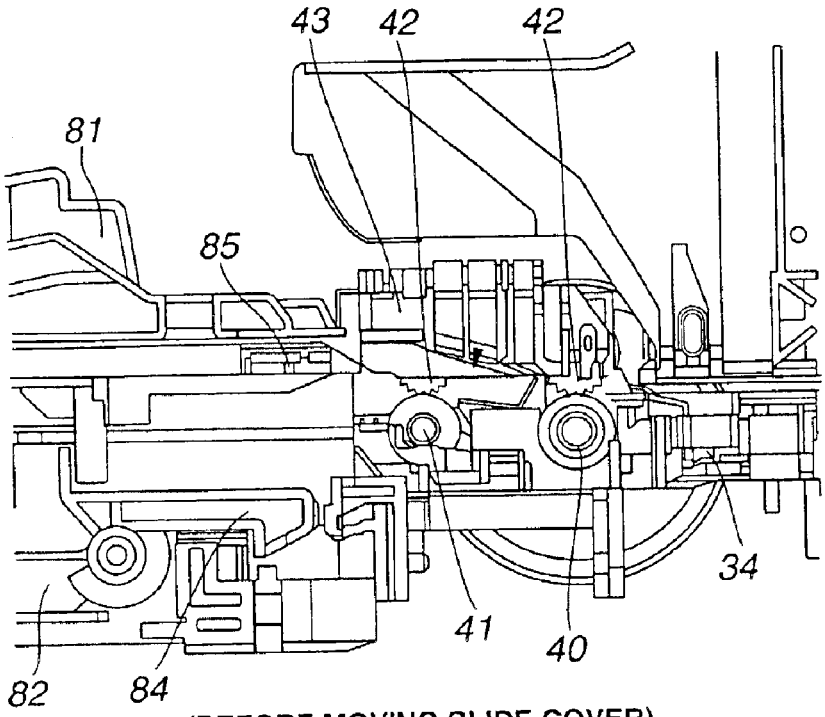
FIGS. 13A and 13B are diagrams illustrating states before and after moving a slide cover, respectively, in the first embodiment.
Figure 13B:
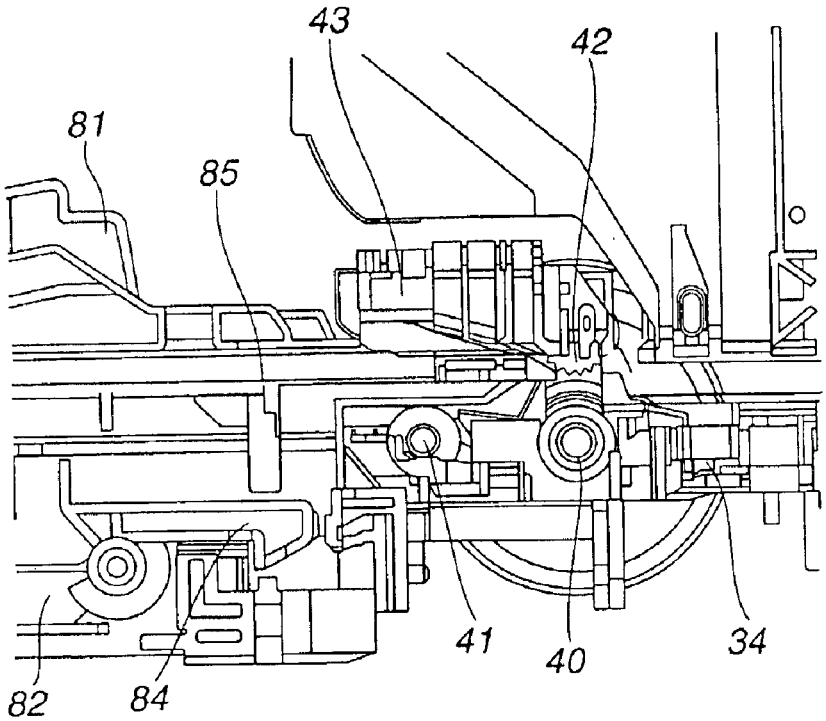
Figure 14:
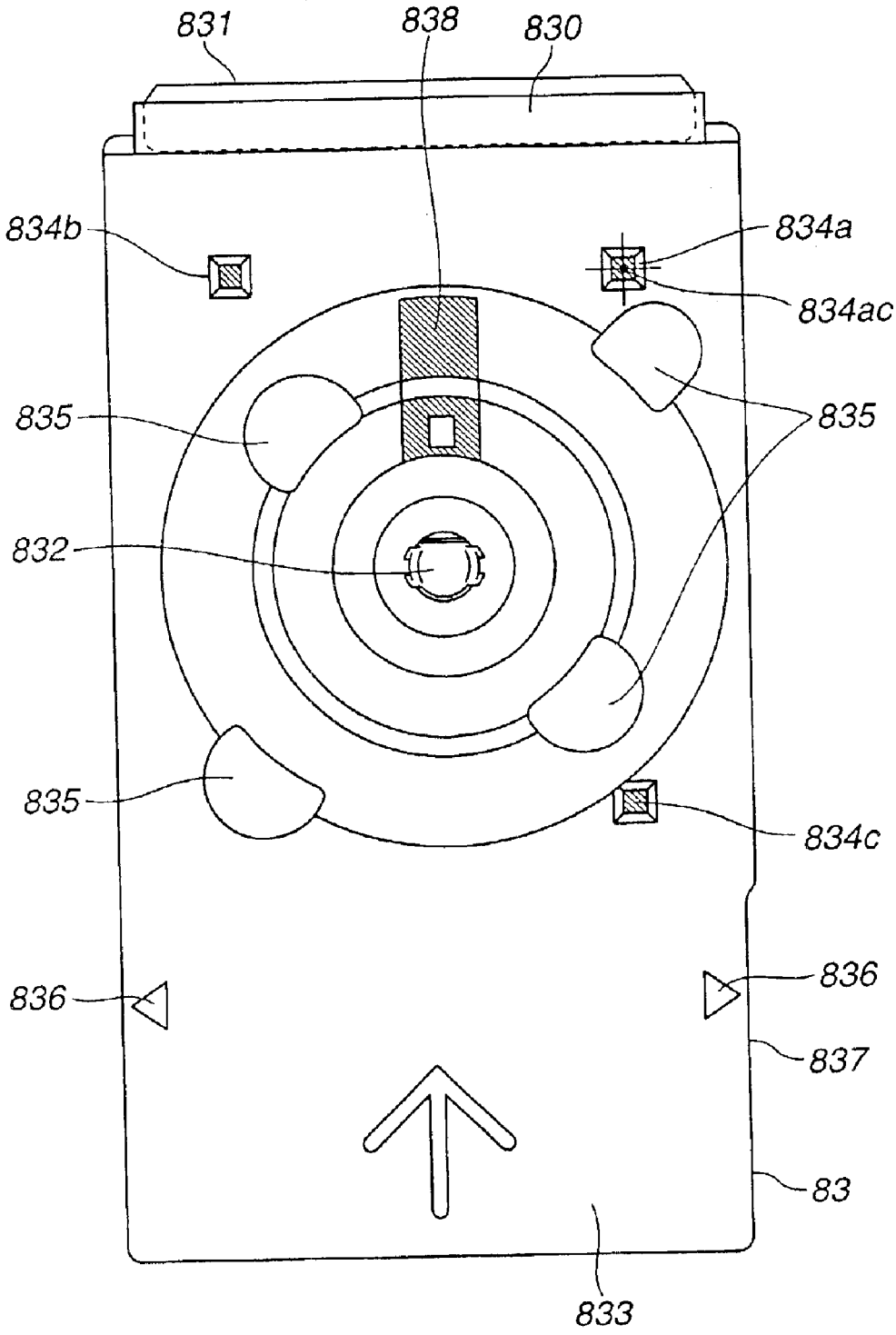
FIG. 14 is a plan view illustrating a tray in the first embodiment.
Figure 15:
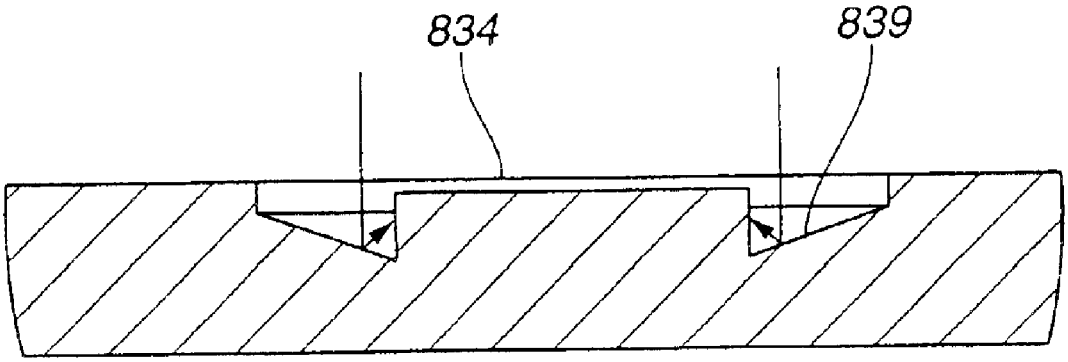
FIG. 15 is a diagram illustrating the concave shape of a tray-position detection portion of the tray in the first embodiment.
Figure 17:
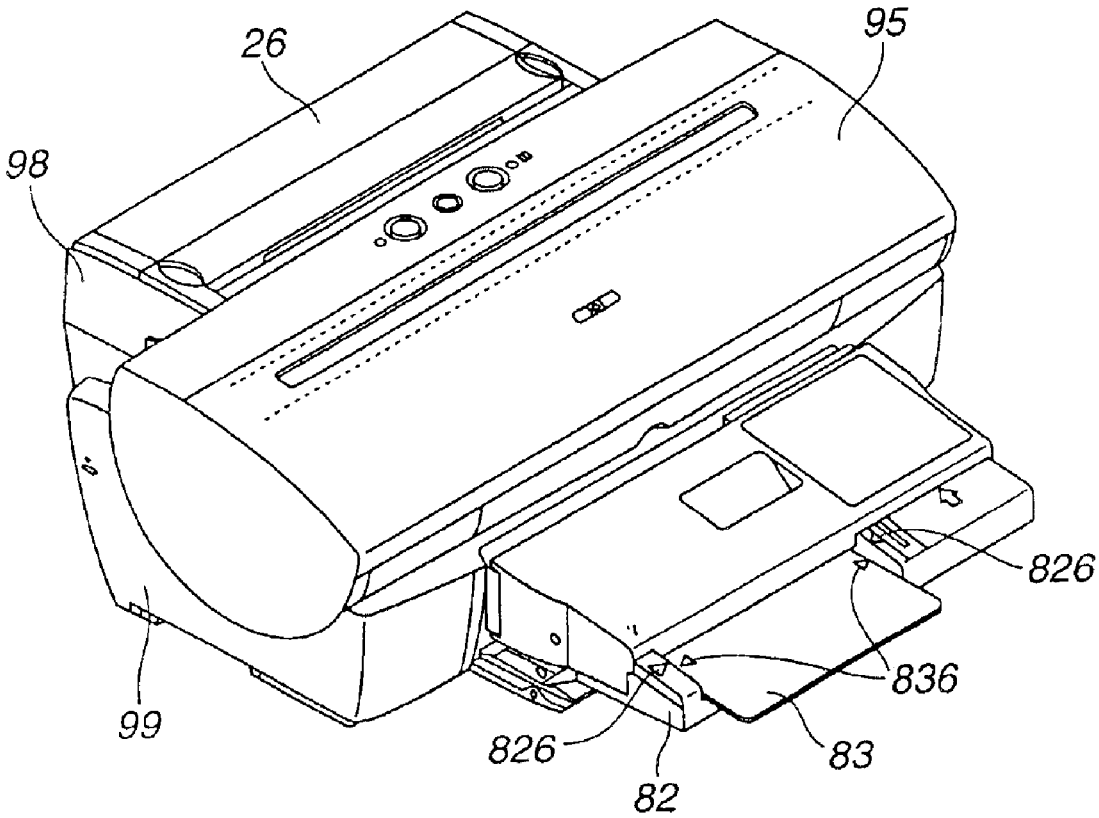
FIG. 17 is a perspective view illustrating a state in which the tray is set in the CD conveying unit in the first embodiment.
Figure 18:
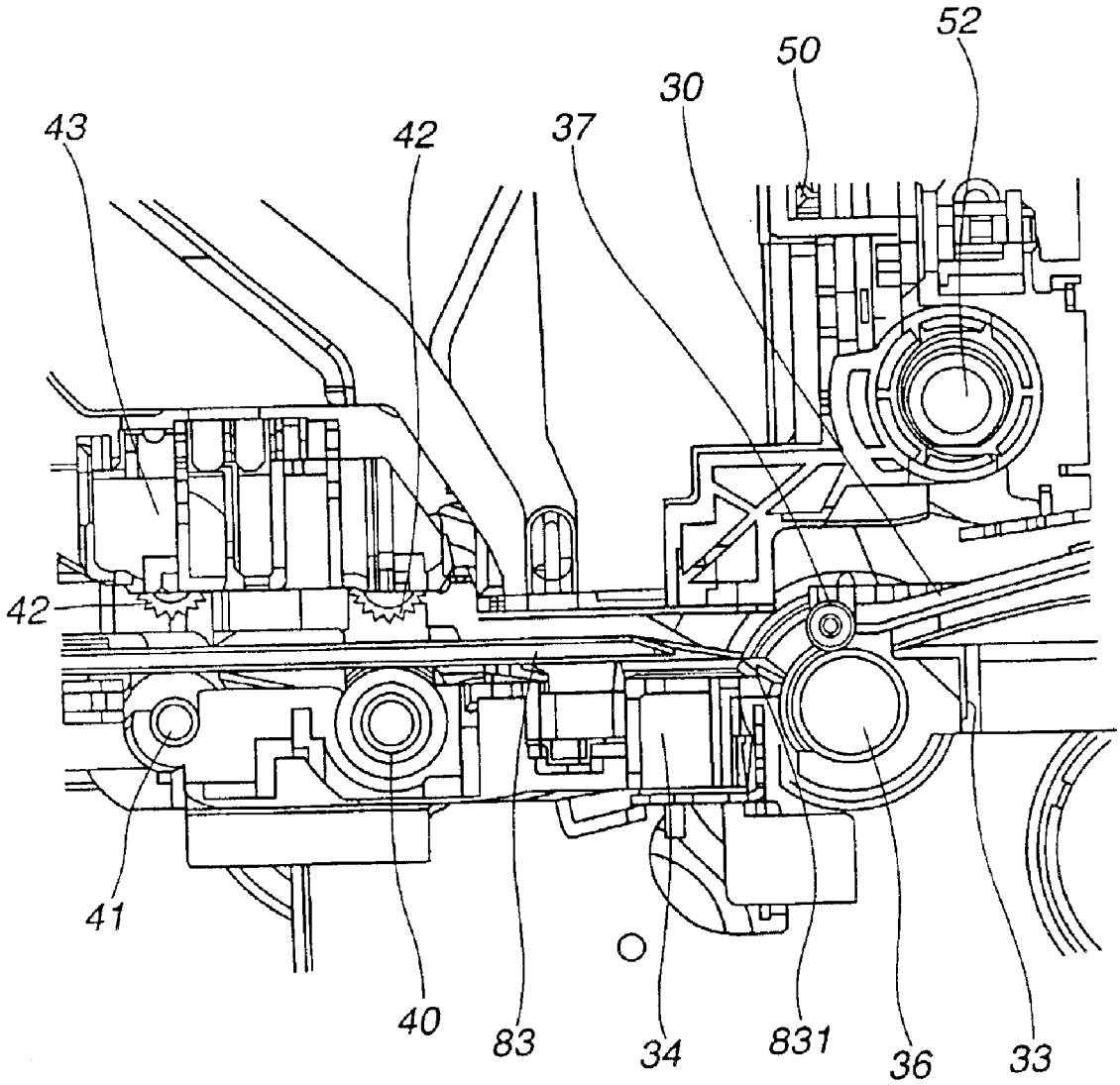
FIG. 18 is a diagram illustrating a state in which the tray is conveyed in the first embodiment.
Figure 19A:
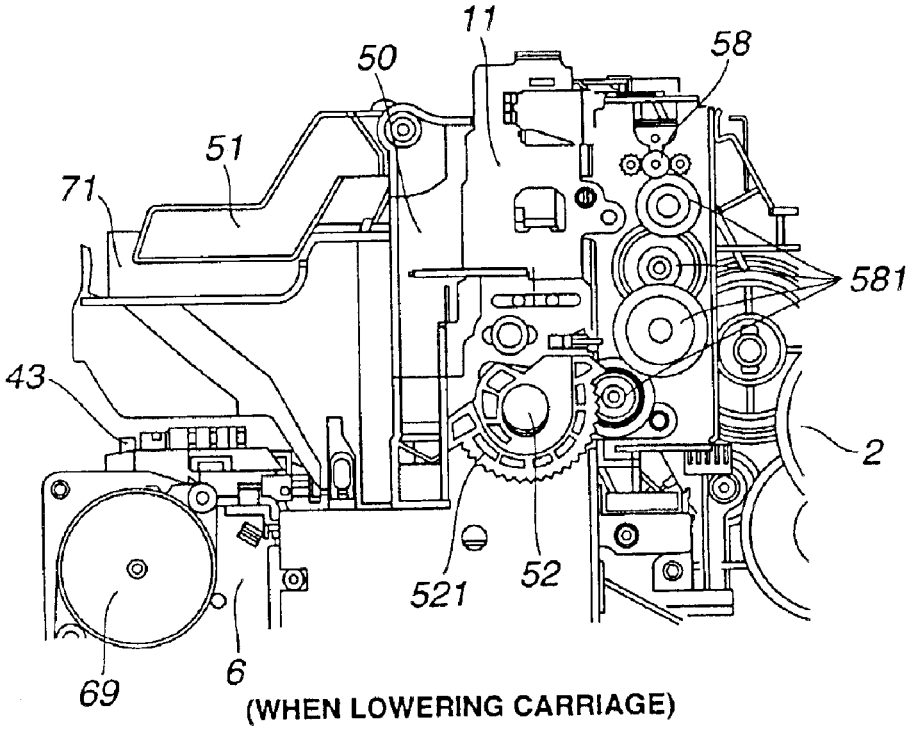
FIGS. 19A and 19B are diagrams illustrating the operation of a carriage-guide-shaft raising/lowering mechanism according to the first embodiment.
Figure 19B:
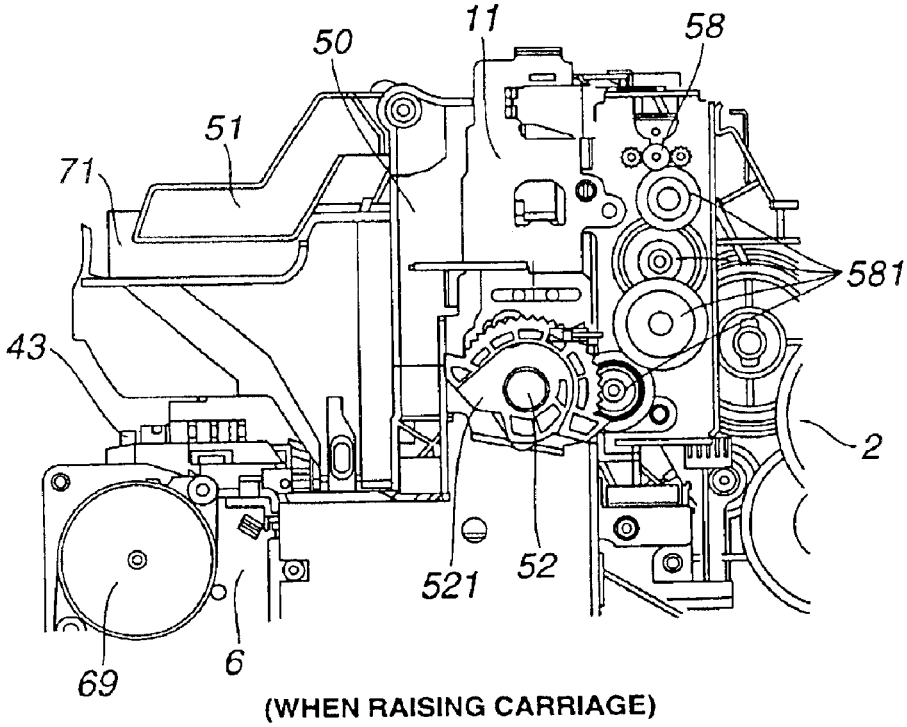
Figure 20:
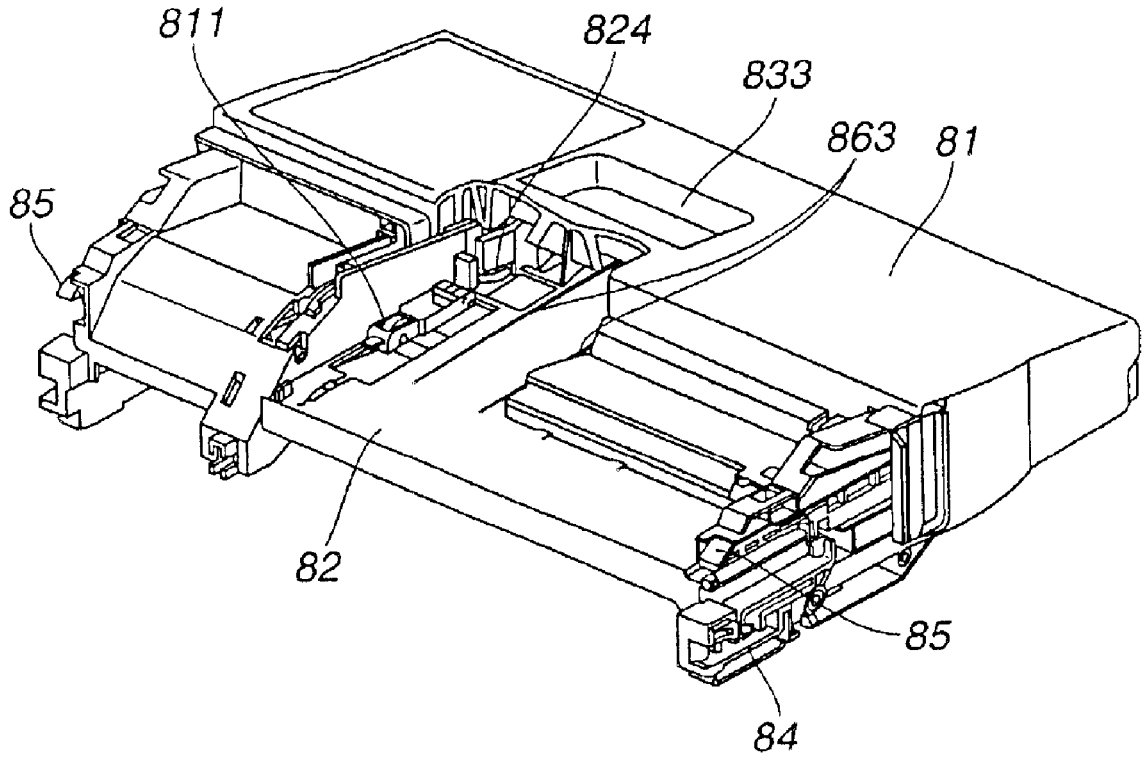
FIG. 20 is a diagram illustrating operations of a lateral-pressure roller and a pressing roller on the tray in the first embodiment.
Figure 21:
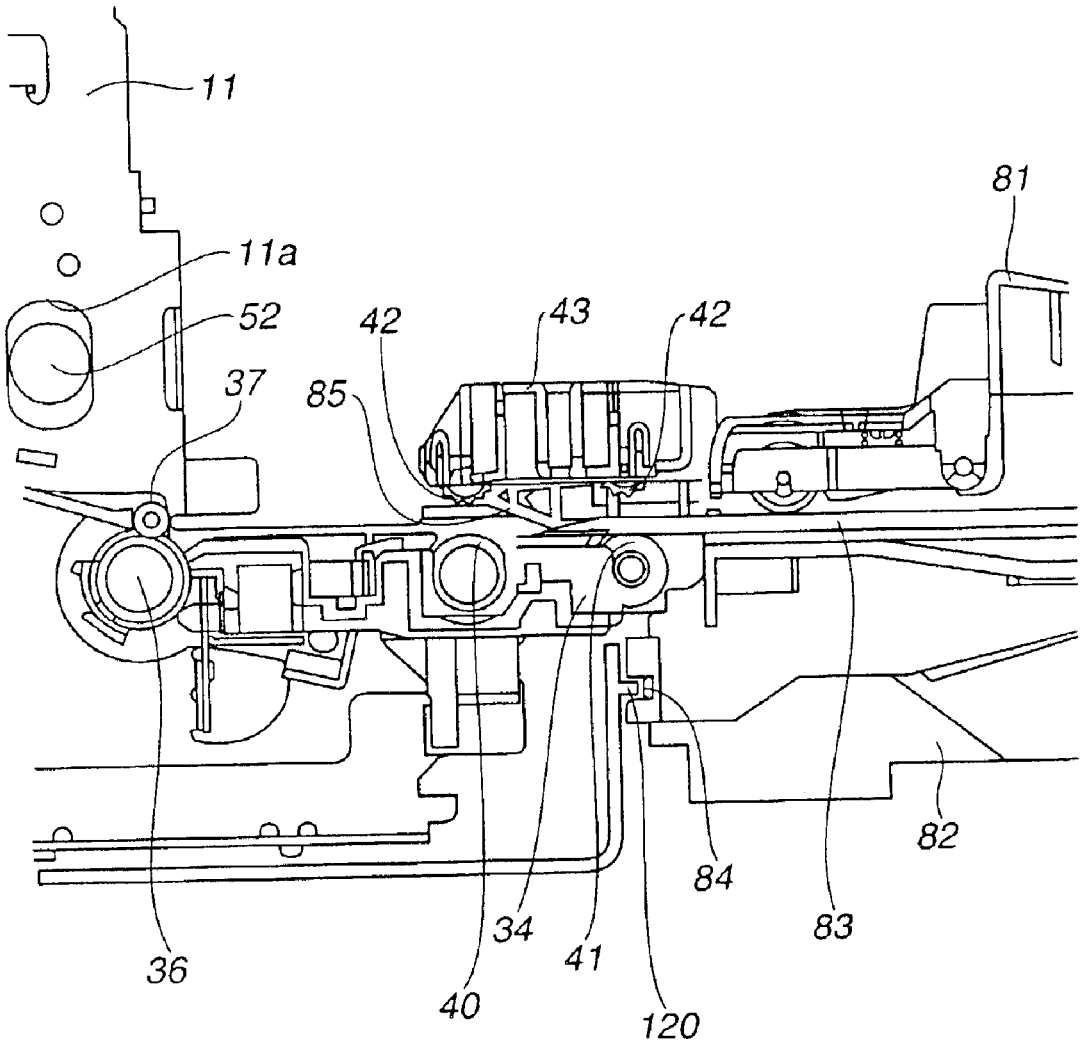
FIG. 21 is a cross-sectional view illustrating a tray-guide mounting state.
Figure 22:
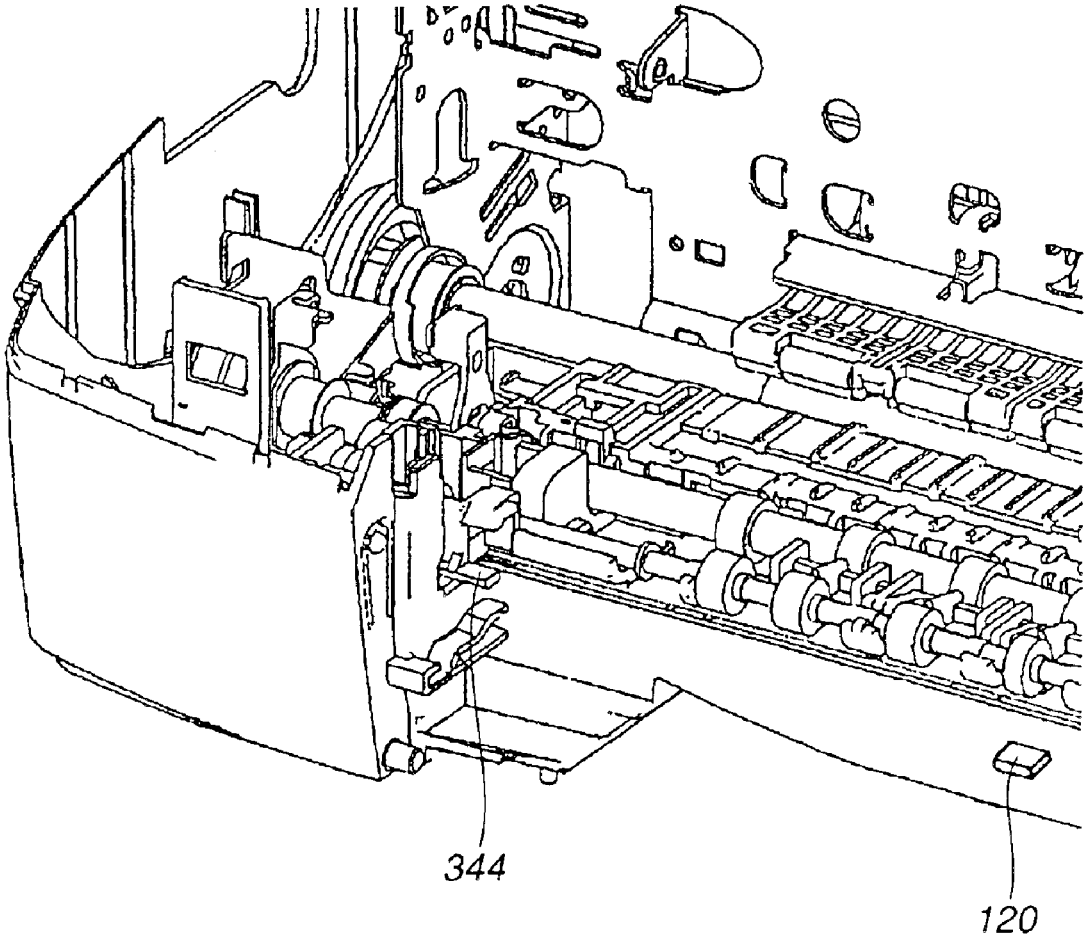
FIG. 22 is a perspective view illustrating an example of the internal mechanism of the main body of the recording apparatus.

FIGS. 7A and 7B are perspective views illustrating states before and after mounting the CD conveying unit 8, respectively, in the main body of the recording apparatus. FIG. 8 is a perspective view of the CD conveying unit 8. FIG. 9 is a diagram illustrating the configuration of a CD-conveying-unit mounting unit and a mounting detection unit of the lower case 99. FIG. 10 is a diagram illustrating mounting of a hook 84 of the CD conveying unit 8 in the lower case 99. FIGS. 11A and 11B are perspective views illustrating a state before mounting the CD conveying unit 8, and a state in which a slide cover 81 is moved after mounting the CD conveying unit, respectively. FIG. 12 is a diagram illustrating release of the hook 84 of the CD conveying unit 8 from the lower case 99. FIGS. 13A and 13B are diagrams illustrating an arm 85 in states before and after moving the slide cover 81, respectively. FIG. 14 is a plan view of the tray 83. FIG. 15 is a diagram illustrating the concave shape of a tray-position detection portion of the tray 83. FIGS. 16A–16F are diagrams, each illustrating a relative position of a position detection sensor with respect to the tray 83. FIG. 17 is a perspective view illustrating a state in which the tray 83 is set in the CD conveying unit. FIG. 18 is a diagram illustrating a state in which the tray 83 is conveyed. FIGS. 19A and 19B are diagrams illustrating the operation of a carriage-guide-shaft raising/lowering mechanism. FIG. 20 is a diagram illustrating operations of a lateral-pressure roller and a pressing roller on the tray 83. FIGS. 21–27 illustrate other examples of the above-described configurations, or partially modified examples of the above-described configurations in order to facilitate understanding.

In the following description, a term "CD" also indicates a CD-R or the like, and a recording material having a shape similar to a CD, such as a DVD or the like, can also be handled as the CD.

As shown in FIG. 7A, the CD conveying unit 8 is mounted in the lower case 99 by being rectilinearly slid in the direction of an arrow Y. At that time, engaging portions at both ends of the tray guide 82 are inserted along guide rails 993 provided at both sides of the lower case 99 shown in FIGS. 9 and 10, to perform positioning. The hooks 84 are rotatably provided at both sides of the tray guide 82, and are urged in one direction. When the CD conveying unit 8 is slid to a predetermined position, it contacts the hooks 84 and cannot be further slid. The hooks 84 operate on stoppers of the guide rails 993 to perform locking so as to prevent the CD conveying unit 8 from returning in the original direction. A mechanical tray-guide detection sensor 344 for detecting a state in which the tray guide 82 is mounted is provided at the platen 34. When the tray guide 82 is mounted in the main body of the recording apparatus, a portion 82*a* of the tray guide 82 pushes the tray-guide detection sensor 344 to detect mounting.

Figure 23:
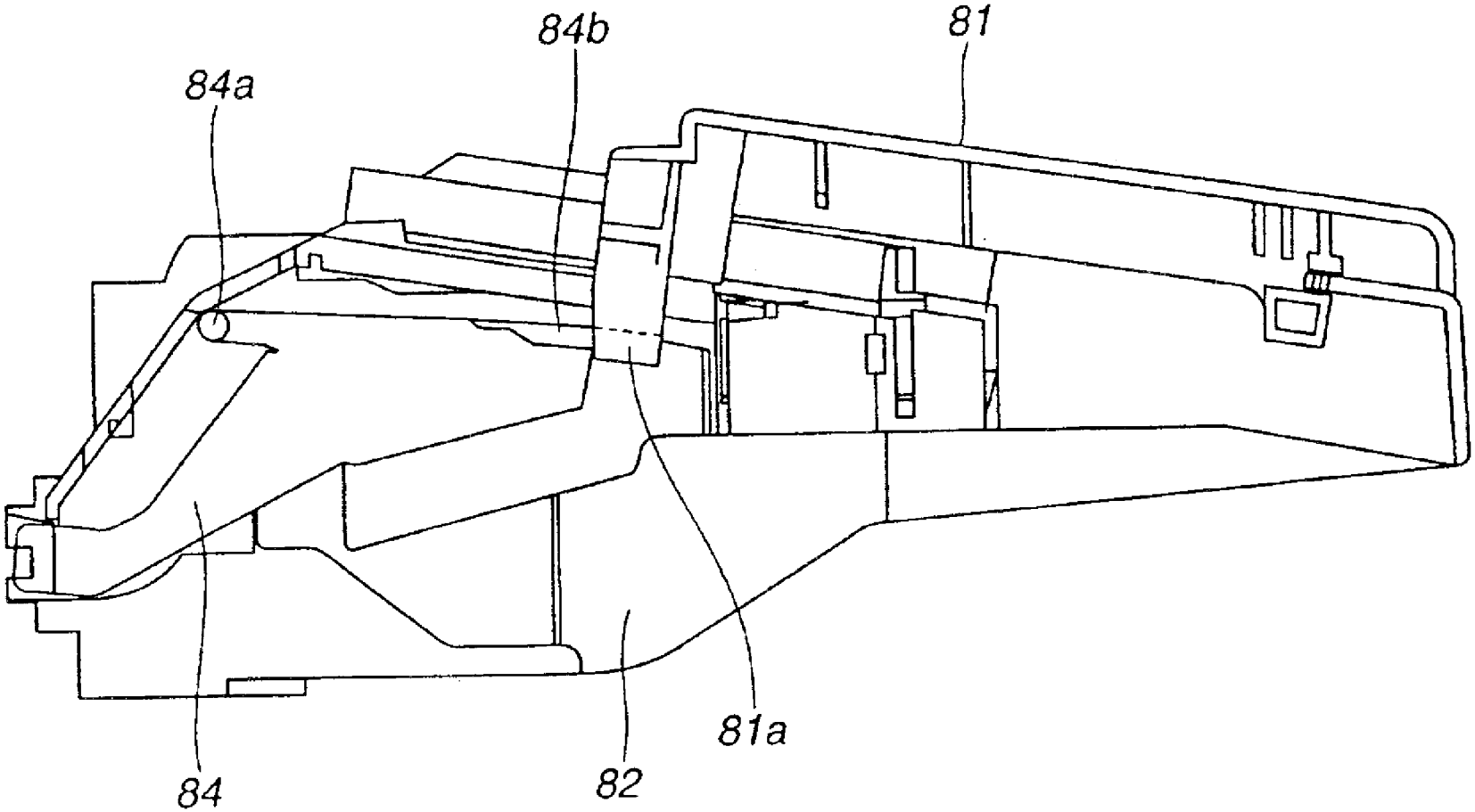
FIG. 23 is a schematic diagram illustrating the tray guide.
Figure 24:
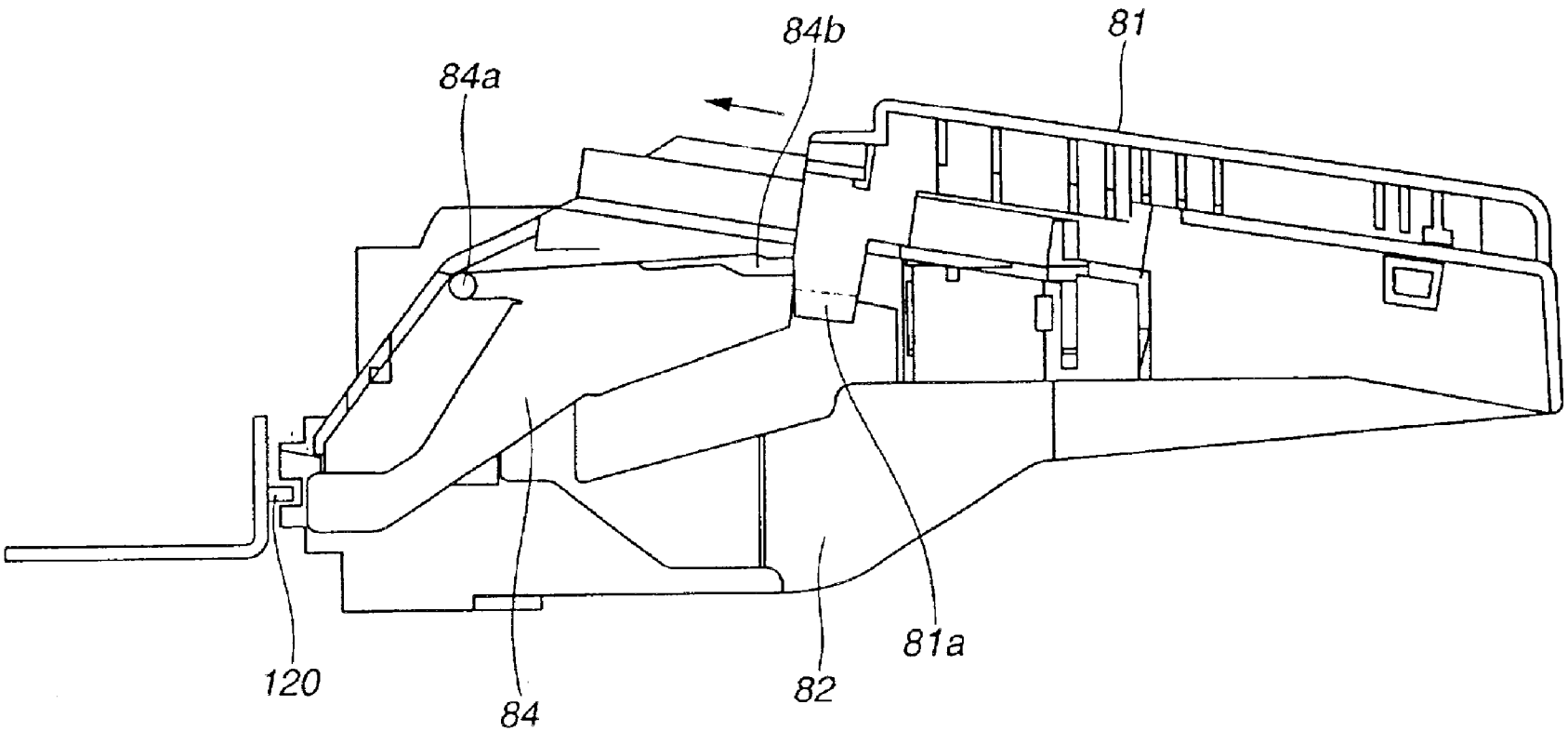
FIG. 24 is a schematic diagram illustrating a state in which the tray guide is mounted in the main body of the recording apparatus.
Figure 25:
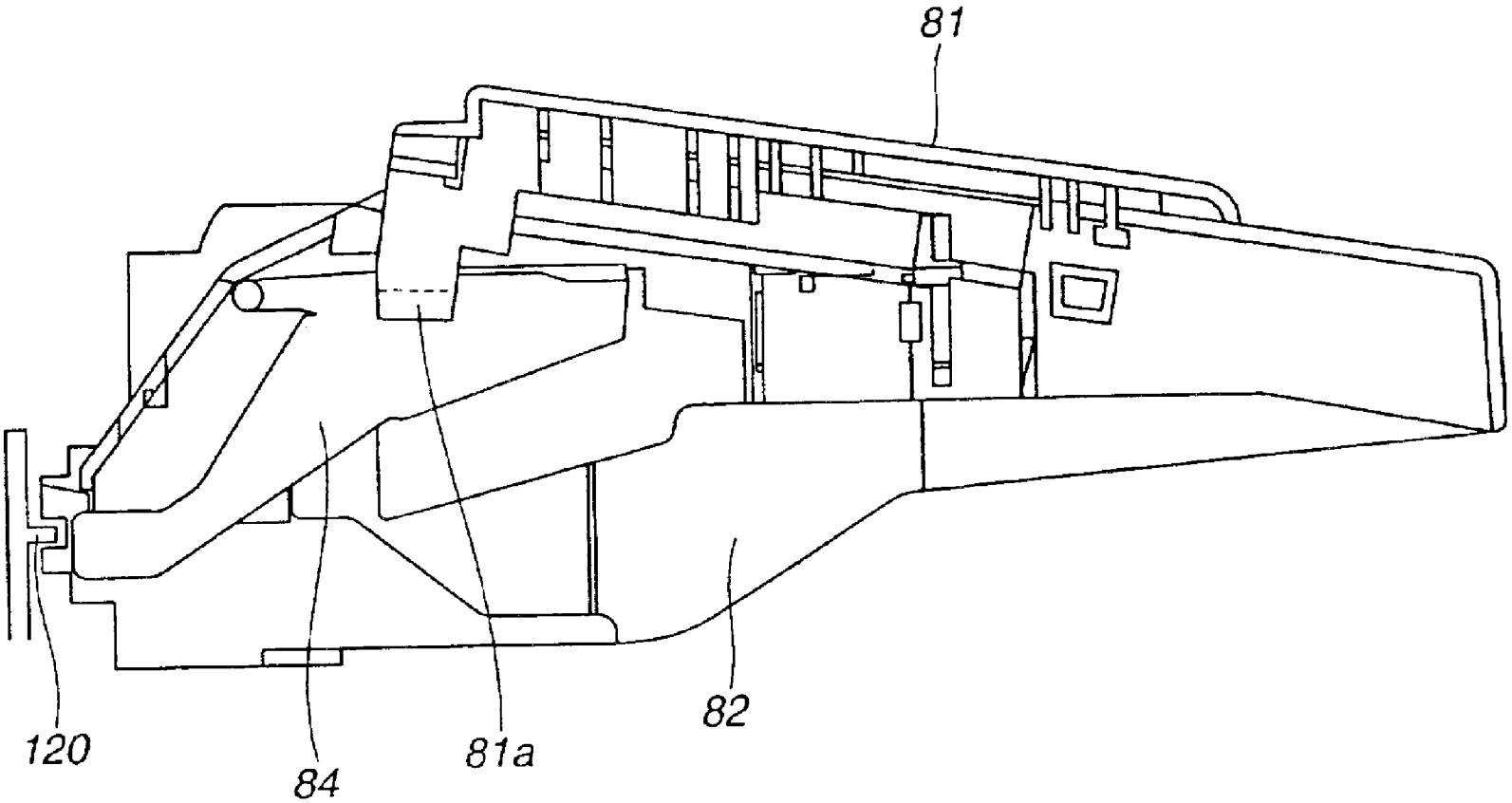
FIG. 25 is a schematic diagram illustrating the tray guide in a state in which a slide cover is set.

As schematically illustrated in FIGS. 21–25, a configuration may be adopted in which when the tray guide 82 is mounted in the main body of the recording apparatus, a projection 120 for releasing locking provided at the main body of the recording apparatus pushes the hooks 84 of a multi-tray unit. The hook 84 is rotatably supported around a rotation center 84*a* and is urged by a spring (not shown). The hook 84 rotates by being pushed by the projection 120 for releasing locking. As shown in FIG. 23, when the tray 83 is not mounted in the main body of the recording apparatus, a pawl 84*b* provided at the hook 84 contacts an arm 81*a* of the slide cover 81. Therefore, the hook 84 cannot move. As shown in FIG. 24, when the tray 83 is mounted in the main body of the recording apparatus, the pawl 84*b* retracts upward to release the hook 84, so that the slide cover 81 can move in an upperleft direction in FIG. 24. That is, as shown in FIG. 25, the user can push the slide cover 81 in an upperleft direction (toward the main body of the recording apparatus).

Then, as shown in FIGS. 11B and 13B, when the slide cover 81 is moved toward the main body of the recording apparatus, an arm 85 protrudes toward the main body of the recording apparatus.

Figure 26:
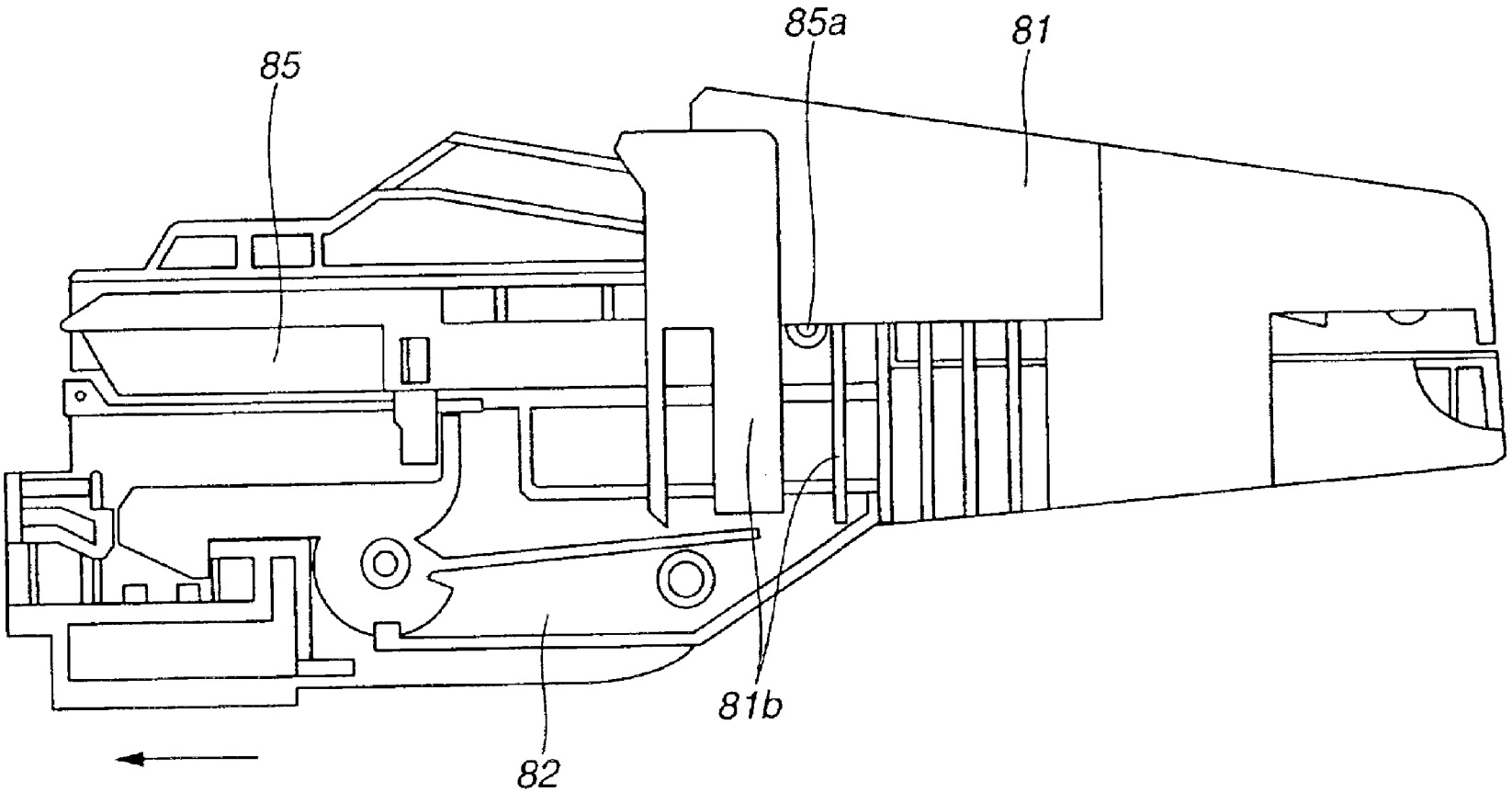
FIG. 26 is a side view illustrating a state in which an arm of the tray guide is waiting.
Figure 27:
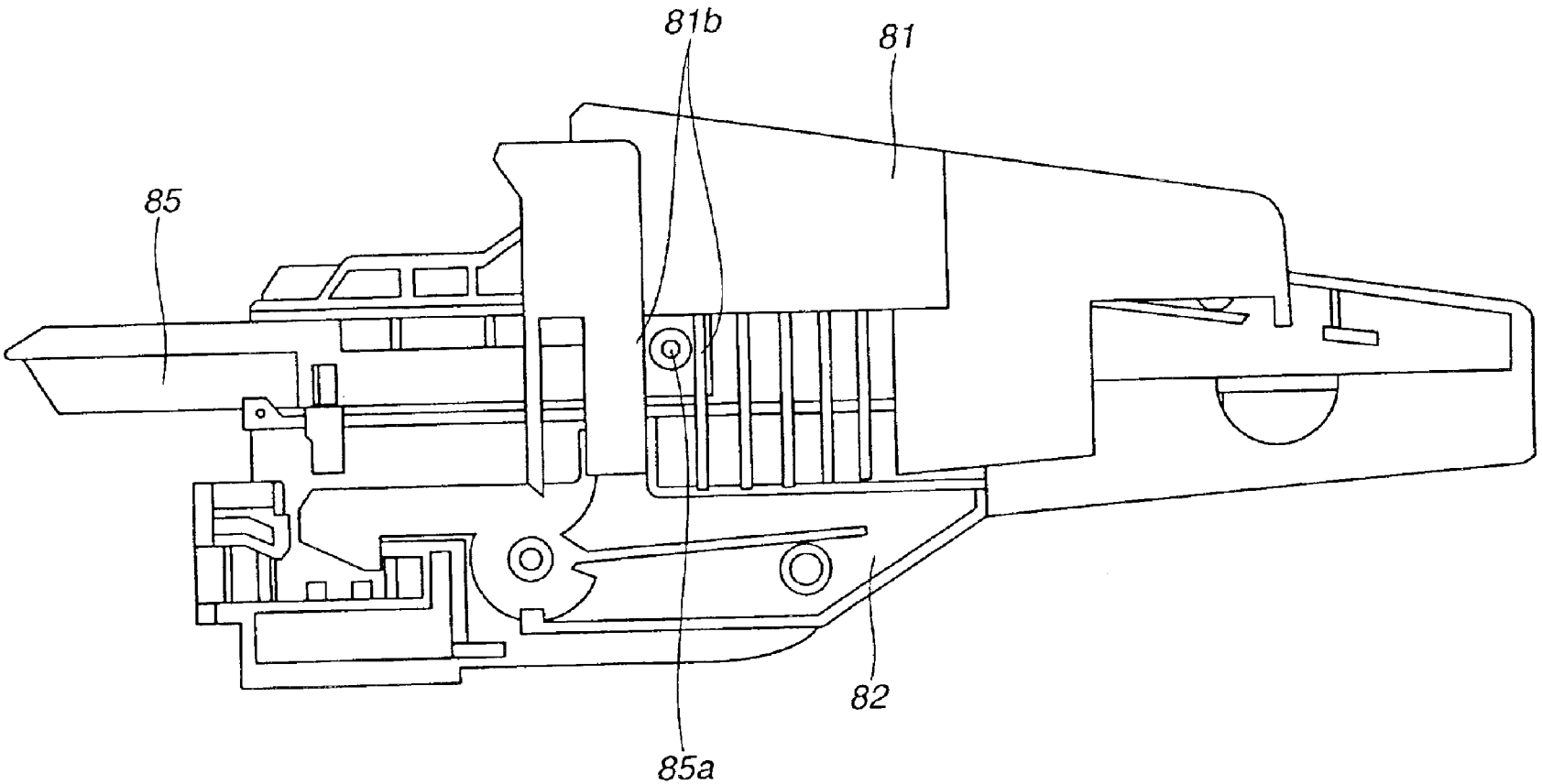
FIG. 27 is a side view illustrating a state in which the arm of the tray guide protrudes.

As shown in FIGS. 26 and 27, a configuration may be adopted in which walls 81*b* are provided at both sides of the slide cover 81, and a post 85*a* provided at the arm 85 is present at a position surrounded by the walls 81*b* at the both sides. By applying a force to this cylindrical post 85*a*, the slide cover 81 moves forward or backward. By receiving a drag from the slide-cover walls 81*b* produced by moving the slide cover 81 forward or backward, the post 85*a* of the arm 85 is pressed, and the arm 85 protrudes to the left in FIG. 26.

The spur base 43 mounting the spurs 42 is slidable vertically with respect to the platen 34, and is urged against the platen 34 by springs producing a predetermined pressure. Accordingly, by entrance of the arm 85 between the spur base 43 and the platen 34, the spur base 43 is raised upward by a predetermined amount. As a result, the spurs 42 leave the sheet discharge rollers 40 and 41. At that time, the arm 85 can smoothly enter between the platen 34 and the spur base 43 due to an inclined portion formed at the distal end of the arm 85. An inclined portion is also provided at an insertion portion between the spur base 43 and the platen 34. As a result, a space to allow passage of the tray 83 can be formed between the platen 34 and the spur base 43. The arm 85 is positioned in a state of entering between the platen 34 and the spur base 43, and has a gap with the tray guide 82 in a state of being accommodated in the tray guide 82.

Accordingly, even if there is an error in mounting of the tray guide 82 in the lower case 99, since the arm 85 follows the platen 34 and the spur base 43, the amount of raise of the spur base 43 can be exactly set only by the thickness of the arm 85. Hence, problems do not arise such that the path for a CD cannot be sufficiently secured because the amount of raise of the spur base 43 is small, and interference with other components, such as the carriage and the like, occurs because the amount of raise of the spur base 43 is too large.

The configurations of the spur base 43 and the platen 34 will now be described in detail with respect to FIGS. 28–34.

Figure 28:
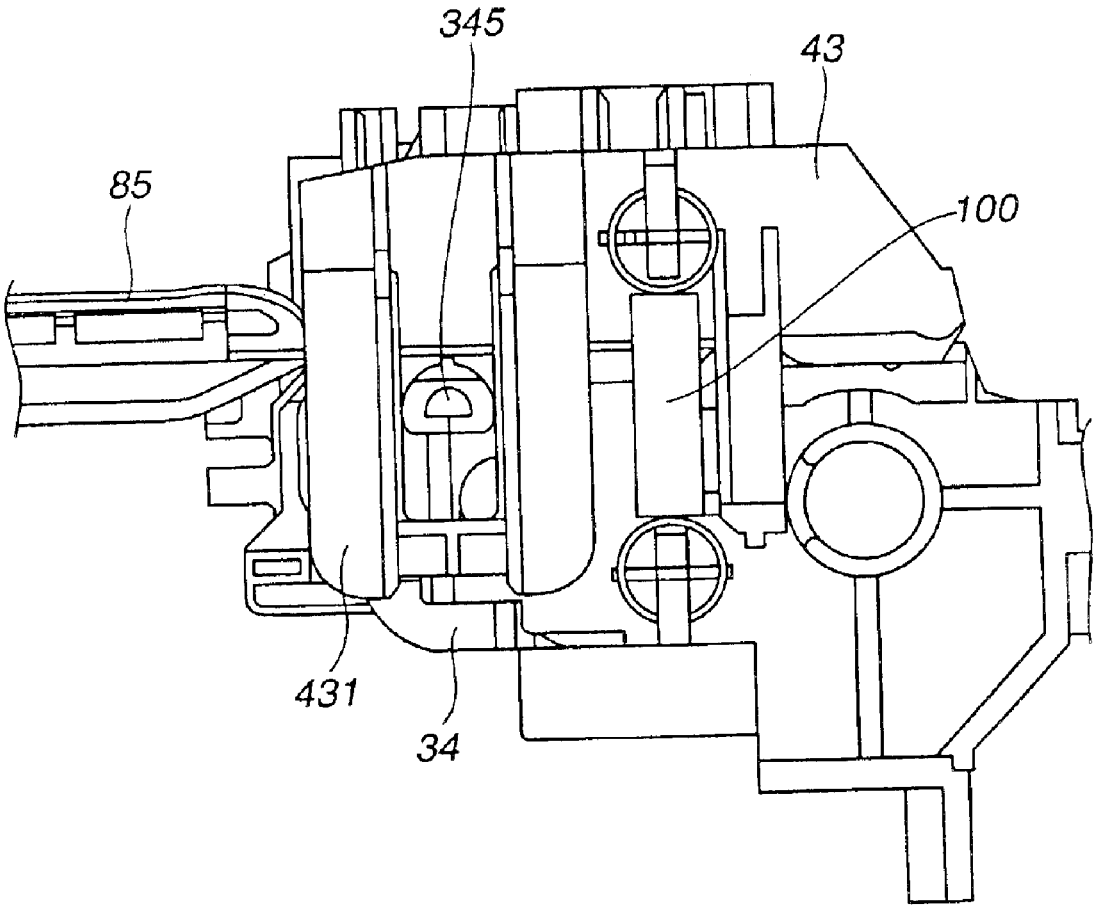
FIG. 28 is a right side view illustrating a portion including a spur base and a platen in the first embodiment.
Figure 29:
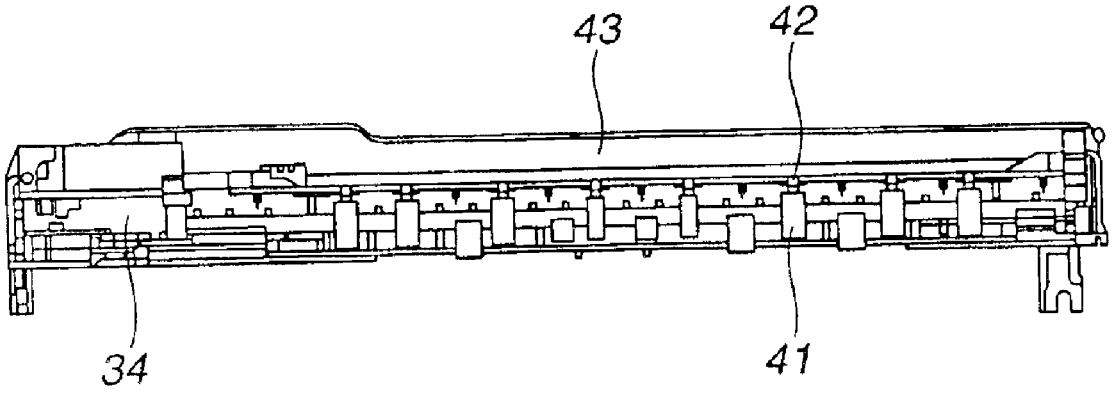
FIG. 29 is a front view illustrating the portion including the spur base and the platen in the first embodiment.
Figure 30:
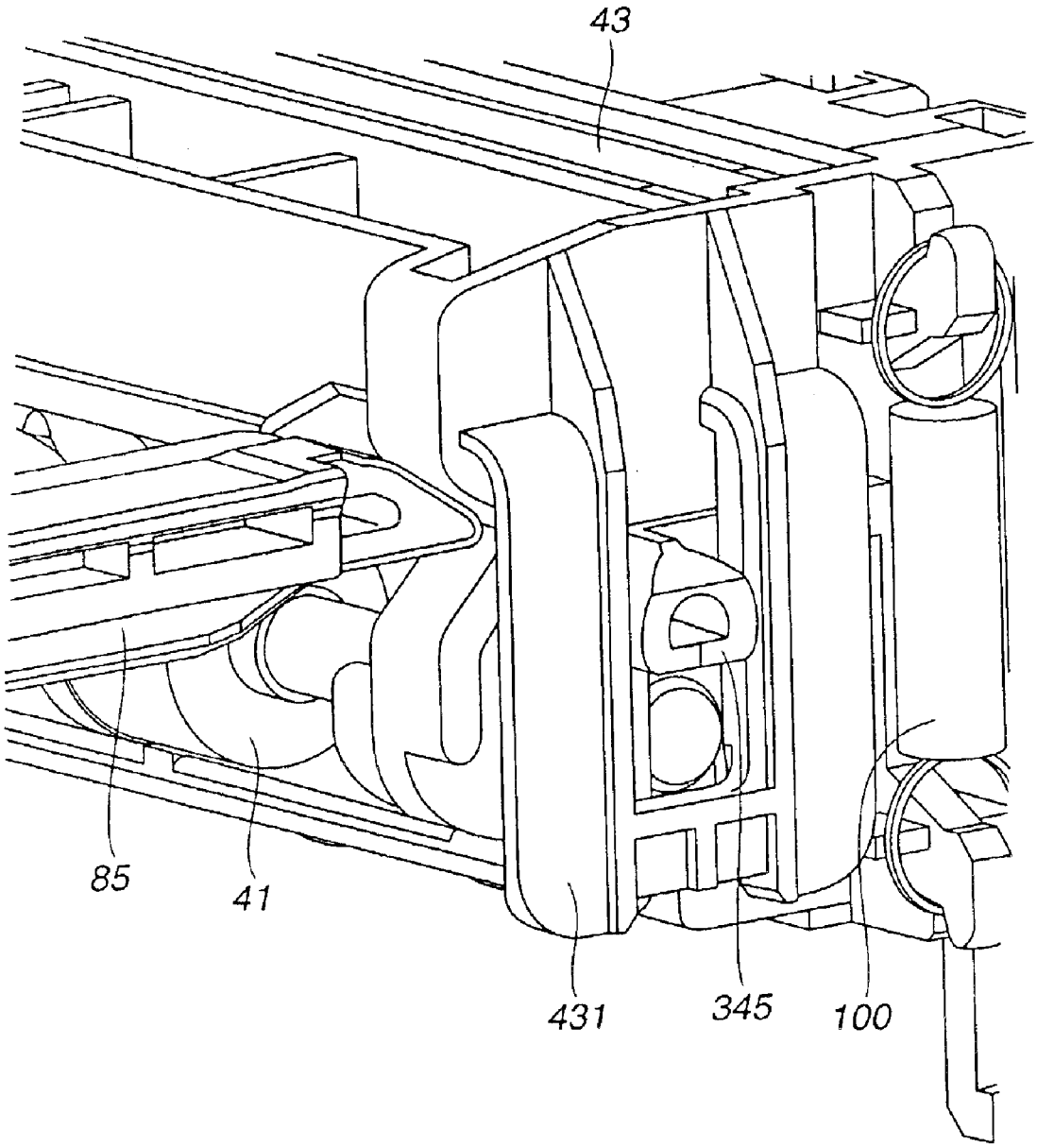
FIG. 30 is a right perspective view illustrating the portion including the spur base and the platen in the first embodiment.
Figure 31:
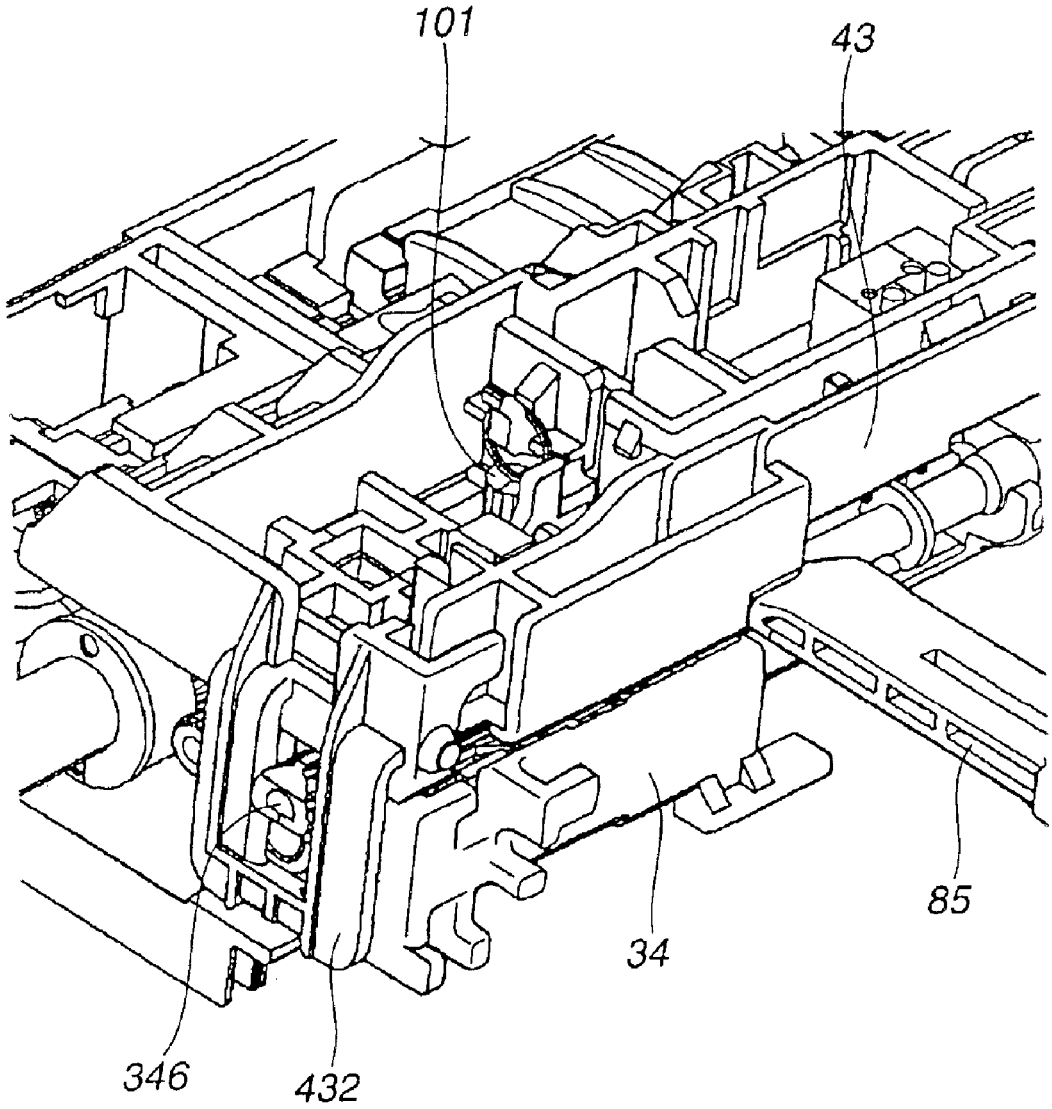
FIG. 31 is a left perspective view illustrating the portion including the spur base and the platen in the first embodiment.
Figure 32:
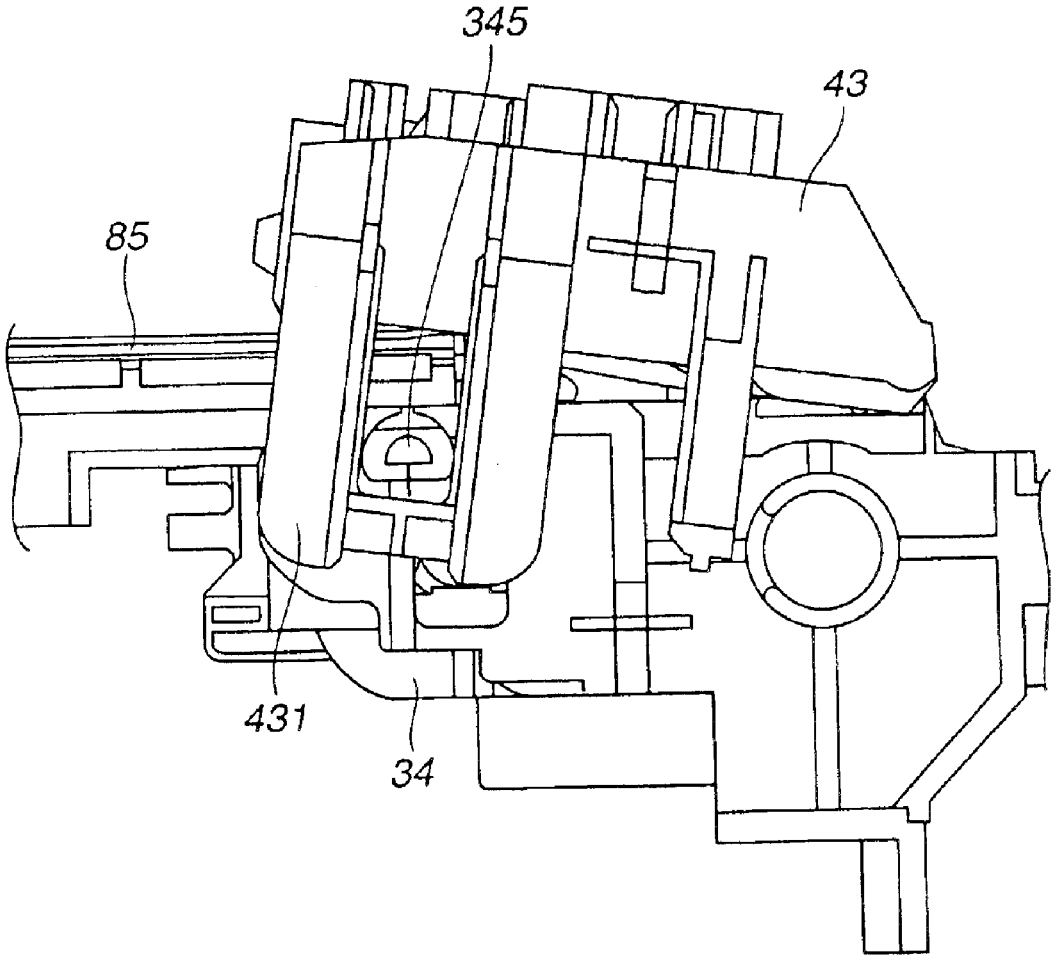
FIG. 32 is a right side view illustrating a state in which the spur base is being moved in the first embodiment.
Figure 33:
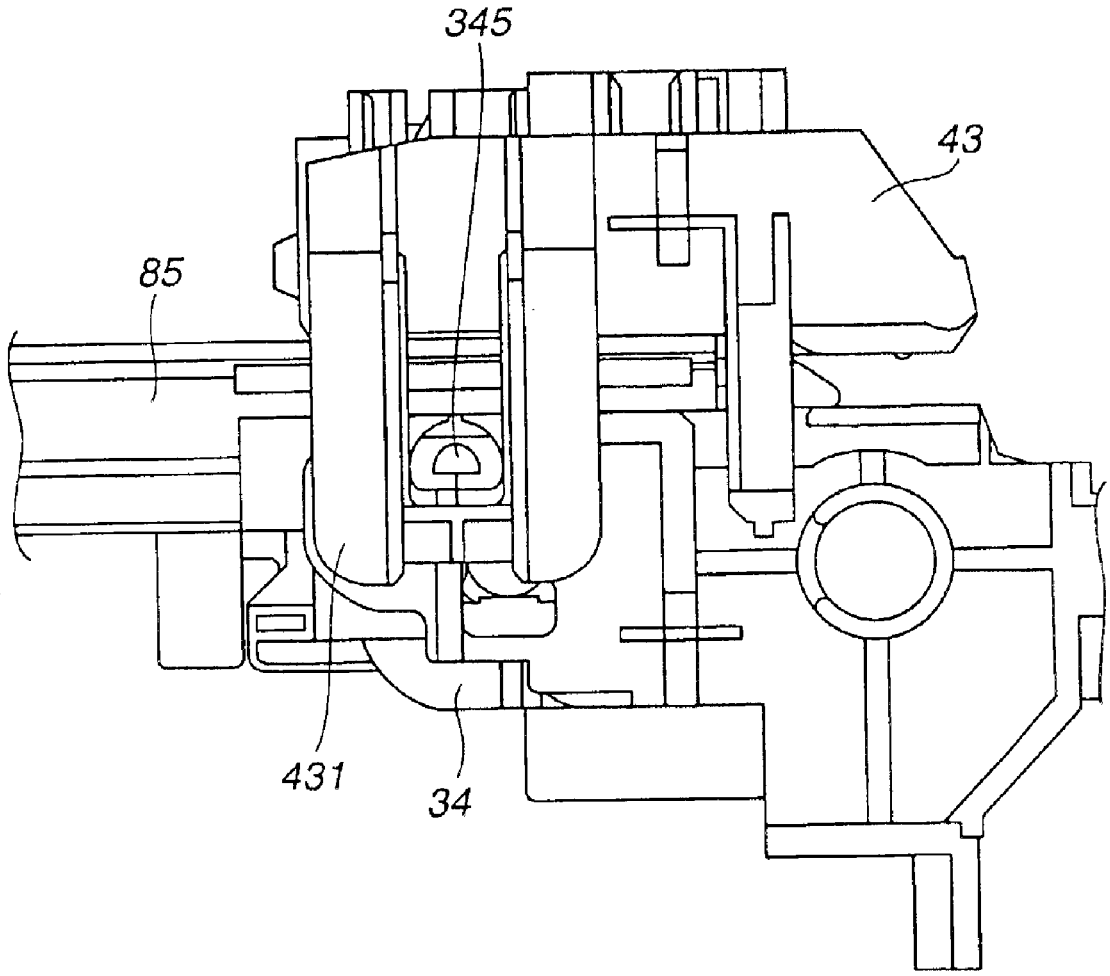
FIGS. 33 and 34 are a right side view and a front view, respectively, illustrating a state in which the movement of the spur base is completed in the first embodiment.
Figure 34:
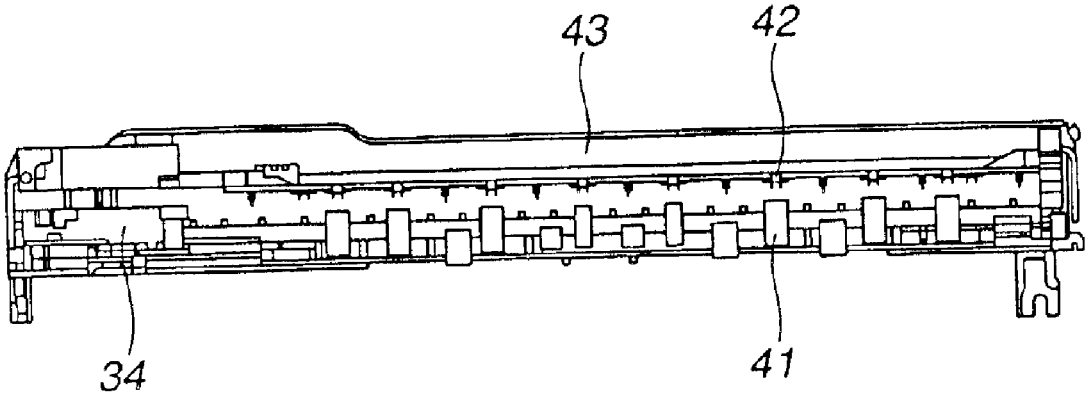

FIG. 28 is a right side view illustrating a portion including the spur base 43 and the platen 34. FIG. 29 is a front view illustrating the portion including the spur base 43 and the platen 34. FIG. 30 is a right perspective view illustrating the portion including the spur base 43 and the platen 34. FIG. 31 is a left perspective view illustrating the portion including the spur base 43 and the platen 34. FIG. 32 is a right side view illustrating a state in which the spur base 43 is being moved. FIGS. 33 and 34 are a right side view and a front view, respectively, illustrating a state in which the movement of the spur base 43 is completed.

As shown in FIGS. 28–31, usually, the spur base 43 and the platen 34 are in tight contact by left and right tension springs 100 and 101. In this state, the spurs 42 contact the sheet discharge rollers 40 and 41. The spring force of the springs 100 and 101 is set to a value larger than the added value of the pressures of all spur springs 44, so that the spur base 43 is not raised in an ordinary state. Since each of the springs 100 and 101 is disposed so as to produce a load at a portion near the insertion portion of the arm 85, the spur base 43 and the platen 34 receiving the load are not creeped.

The spur base 43 is positioned by engagement of left and right arm portions 431 and 432, each having a moving space at the lower side, with left and right shaft portions 345 and 346, respectively, of the platen 34. Accordingly, the spur base 43 is supported so as to be moved vertically and rotatably with respect to the platen 34.

As shown in FIG. 32, when the arm 85 is inserted between the spur base 43 and the platen 34, the downstream side of the spur base 43 first raises while rotating, and when the arm portions 431 and 432 contact the lower portions of the shaft portions 345 and 346, respectively, the raise of the downstream side of the spur base 43 is completed. When the arm 85 is further inserted to a rear portion, the upstream side of the spur base 43 raises only by rotation, and all of the spurs 42 completely leave the sheet discharge rollers 40 and 41 (see FIGS. 33 and 34). By the final rotation operation of the spur base 43, a sensation of clicking indicating completion of insertion of the arm 85 is provided. Since rotation and vertical movement can be performed in the above-described manner, it is possible to perform exact positioning of the spur base 43 at an ordinary position, and prevent galling and the like during movement. Furthermore, the movement of the spur base 43 during insertion of the arm 85 is very smooth. It is thereby possible to reduce the operation force, and realize an easy operation of the recording apparatus.

Figure 35:
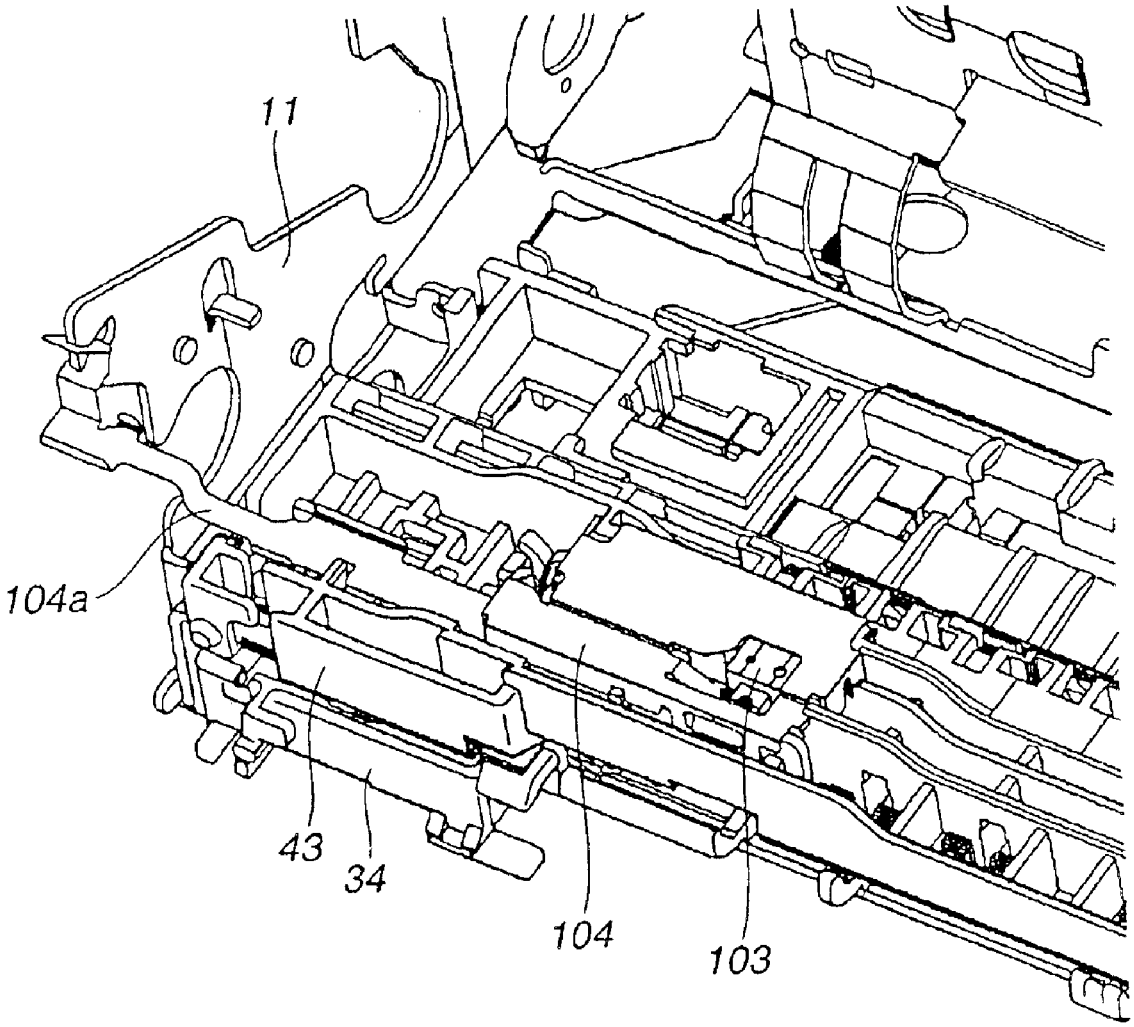
FIG. 35 is a perspective view illustrating a portion including the spur base and the platen in the first embodiment.

As shown in FIG. 35, an ink sensor 103 for detecting the remaining amount of ink within an ink tank 71 mounted on the carriage 50 and presence/absence of the ink tank 71 is mounted on the spur base 43. In order to prevent erroneous detection of the sensor 103 and destruction due to static electricity, an ink-sensor cover 104 is provided as a grounding plate. One end of the ink-sensor cover 104 is mounted so as to cover the ink sensor 103 on the spur base 43, and another end of the ink-sensor cover 104 is mounted on the chassis 11 and is grounded. Since the ink-sensor cover 104 has a narrow portion 104*a* having a thickness of 0.15 mm and a width of about 4 mm, the ink-sensor cover 104 can follow the spur base 43 by elastic deformation o the narrow portion 104*a* when the spur base 43 raises.

Figure 36:
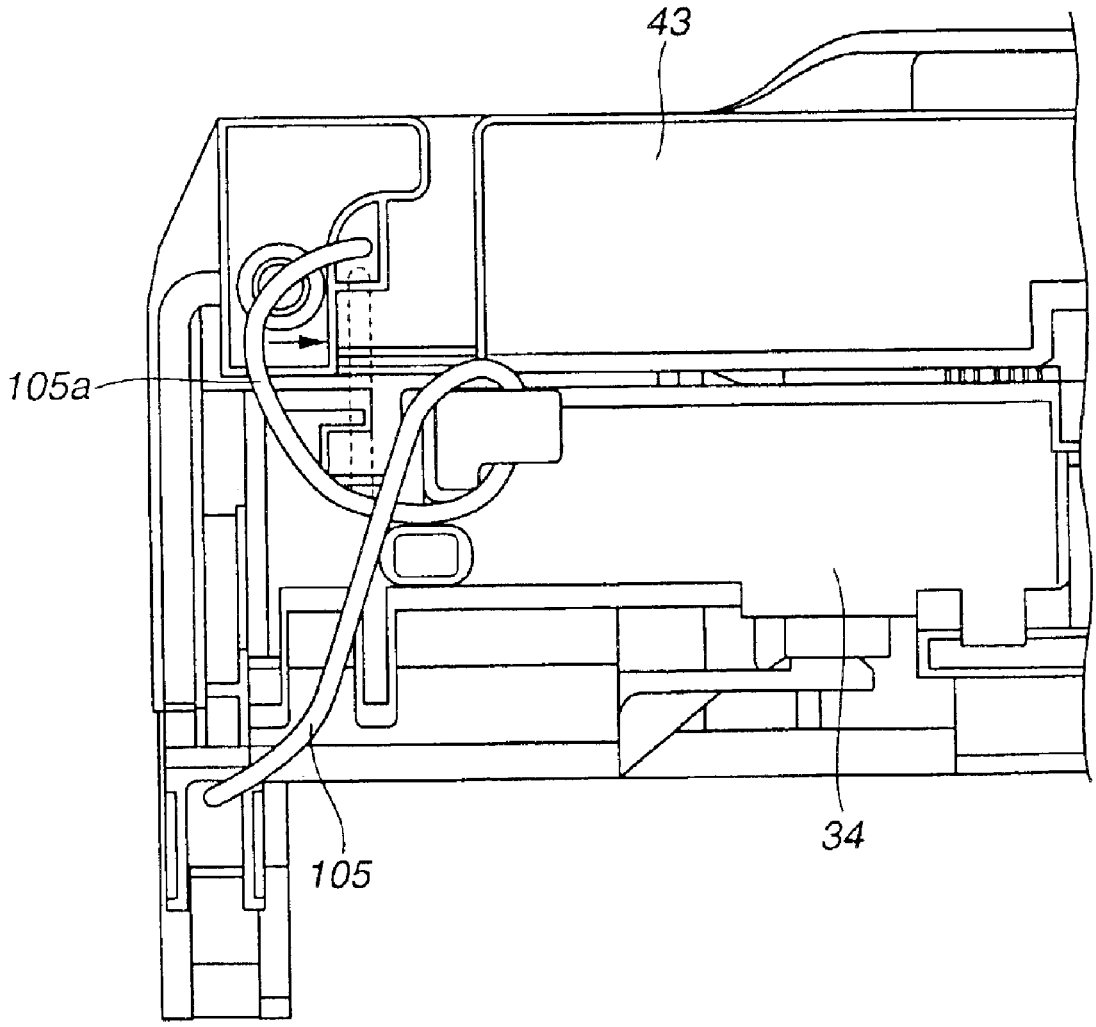
FIG. 36 is a plan view illustrating the relationship between the spur base and a lead wire in the first embodiment.

As shown in FIG. 36, a lead wire 105 extending from the ink sensor 103 is fixed to the spur base 43 and the platen 34, and a deflection margin 105*a* is provided between fixed portions. As a result, when the spur base 43 raises, the lead wire 105 moves to a position indicated by broken lines in FIG. 36, so that the raise of the spur base 43 is not hindered.

Although a configuration has been adopted in which the spur base 43 raises when the arm 85 is inserted, a path for a recording material may be secured by separating the spurs 42 from the sheet discharge rollers 40 and 41 by descent of the platen 34.

In the above-described configuration, in a state in which the slide cover 81 is not moved toward the main body of the recording apparatus, since the opening 821 is closed, the tray 83 cannot be inserted. When the slide cover 81 is moved toward the main body of the recording apparatus, the slide cover 81 moves in an obliquely upper direction, to disclose the opening 821 with respect to the tray guide 82. In this state, it is possible to insert the tray 83 mounting a CD from the opening 821, and set the tray 83 to a predetermined position. It is thereby possible to prevent damage of a tray sheet 831 provided at the distal end of the tray 83 and the spurs 42 due to interference between the tray 83 and the spurs 42 when the tray 83 is inserted in a state in which the spur base 43 does not raise.

As shown in FIG. 12, when the tray 82 draws the slide cover 81 from the main body of the recording apparatus, the arm 85 leaves the spur base 43 by being linked with the slide cover 81, and the spur base 43 and the spurs 44 retract to a predetermined position. At that time, if the tray 83 remains to be mounted, the tray 83 is pinched in the opening between the slide cover 81 and the tray guide 82, and the slide cover 81 cannot be further drawn. As a result, the spurs 44 retract while the CD remains within the main body of the recording apparatus, to prevent damage of the CD. When the slide cover 81 is further drawn, the slide cover 81 operates on the hook 84 to cause the hook 84 to leave the guide rail 993 of the lower case 99, and thereby release mounting of the CD conveying unit 8 in the main body of the recording apparatus.

As shown in FIG. 14, the tray 83 includes a CD mounting portion 832, an operation unit 833 for allowing the operator to grasp the tray 83 when drawing or accommodating the tray 83, a position detection mark 834, a hole 835 for taking a CD, insertion-position aligning marks 836, a lateral-pressure-roller recess portion 837, and a medium-presence/absence detection mark 838 that are provided on a resin plate having a thickness of about 2–3 mm. Furthermore, the tray sheet 831 for assuring entrance of the conveying roller 36 and the pinch roller 37 into the tray 83 is provided at the distal end of the tray 83.

Two and one of the position detection marks 834 are provided at leading-edge portions of a CD mounting portion of the tray 83, and at an opposite side, respectively. The position detection sensor 834 has the shape of a square having a size of about 3–10 mm made of a high-reflectivity material, and is formed according to hot stamping. As shown in FIG. 15, since a recess 839 is provided around the position detection mark 834, it is possible to easily form a reflective material along a desired shape of the position detection mark 834 in a resin member. The surface of the base of the recess 839 is very flat with a predetermined angle. Accordingly, even if light from a tray-position detection sensor 59 provided at the carriage 50 is reflected at a portion other than the position detection marks 834, since the reflected light does not return to the photosensing unit of the tray-position detection sensor 59, erroneous detection is prevented. As described above, since the reflectivity of the position detection marks 834 on the tray 83 is high, it is unnecessary to mount a high-performance sensor, and processing, such as correction and the like, can be minimized. Accordingly, an increase in the production cost and an increase in the printing time can be prevented. In comparison with a method of directly reading an edge of a printed region of a CD, exact detection can be performed even when printing is performed on a colored CD or printing is again performed on a CD on which recording has already been performed once.

A plurality of molded pawls are provided at the CD mounting unit 832 in order to perform positioning when a CD is mounted, and prevent shaking. The operator mounts a CD by fitting a hole at the center of the CD with the CD mounting portion 832. When detaching the CD, the operator can take the CD by holding the circumferential edge of the CD utilizing two holes 835 for detaching a CD. The CD mounting portion 132 is more or less lower than the surrounding surface, and a medium-presence/absence detection mark 838 is provided at the lower surface. This mark 838 is formed by providing holes having a predetermined width in a hot stamp having a predetermined width. When these holes are detected, it is determined that a medium is absent.

As described above, the tray sheet 831 is mounted at the distal end of the tray 83. The tray sheet 831 is a sheet made of PET (polyethylene terephthalate) or the like having a thickness of 0.1–0.3 mm, and has predetermined values of a coefficient of friction and a hardness. A tapered portion 830 is provided at the distal end of the tray 83. When the tray sheet 83 is pinched between the conveying roller 36 and the pinch roller 37, a conveying force is generated. When the tapered portion 830 at the distal end of the tray 83 is raised by the pinch roller 37, it is possible to grasp the tray 83 having a certain thickness at the nip portion between the conveying roller 36 and the pinch roller 37, and convey the tray 83. The position detection marks 834 are provided between the pinch rollers 37. Accordingly, it is possible to prevent production of damage on the surface due to contact of the position detection marks 834 with the pinch roller 37.

As shown in FIG. 20, a lateral-pressure roller 824 for pressing the tray 83 against a reference surface of the tray guide 82 is provided at the tray guide 82. Positioning is performed by pressing the tray 83 against the reference surface of the tray guide 82 with a predetermined pressure using a roller spring. The lateral-pressure roller 824 operates until the operator sets the tray 83 at a predetermined position. When the tray 83 is conveyed by the conveying roller 36 and the pinch roller 37, since the lateral-pressure recess portion 837 is at a position where the lateral-pressure roller 824 operates, the lateral-pressure roller 824 does not operate on the tray 83, so that useless back tension or the like does not operate on the tray 83. As a result, degradation in conveyance accuracy for the tray 83 is prevented.

Pressing rollers 811 are provided at left and right portions of the slide cover 81. By pressing the tray 83 against the second sheet discharge roller 41 with a predetermined pressure by a roller spring 812, a conveying force for the tray 83 is generated. When starting a printing operation, the tray 83 can be conveyed from a set position to the nip portion between the conveying roller 36 and the pinch roller 37 by this conveying force. Upon completion of the printing operation, the tray 83 can be conveyed to a predetermined position where the operator takes the tray 83. In this case, also, it is arranged such that the position of the position detection marks 834 differs from the position of the pressing roller 811. Accordingly, production of damage on the surface by contact of the position detection marks 834 with the pressing roller 811 is prevented.

By drawing the tray 83 conveyed to the predetermined position, the tray 83 can be taken from the tray guide 82. Then, by utilizing the two holes 835 for taking a CD, the operator can take a CD by grasping the outer circumference of the CD.

Next, an operation of performing printing on a CD when using the above-described configuration will be described. When performing printing on standard paper having a thickness of about 0.1 mm, serving as an ordinary recording material, the distance between the recording head 7 and the recording material is as small as about 1.2 mm. A description will now be provided of a case in which printing is performed on a special recording material, such as a CD having a thickness of about 1.5 mm, or the like.

By sliding the CD conveying unit 8 rectilinearly toward the main body of the recording apparatus, the CD conveying unit 8 is mounted in the lower case 99. At that time, mounting of the tray guide 82 in the main body of the recording apparatus is detected by the tray-guide detection sensor 344.

When the slide cover 81 is moved toward the main body of the recording apparatus, the arm 85 protrudes toward the main body of the recording apparatus by being linked with the slide cover 81. By entrance of the arm 85 between the spur base 43 and the platen 34, the spur base 43 is raised upward by a predetermined amount.

By thus moving the slide cover 81 toward the main body of the recording apparatus, the slide cover 81 moves in an obliquely upward direction, and the opening 821 with the tray guide 82 appears. In this state, as shown in FIG. 17, the tray 83 mounting the CD can be inserted from the opening 821 and set to a predetermined position.

Then, the CD is mounted on the CD mounting unit 832 of the tray 83. The operator inserts the tray 83 by having the operation unit 833 until the position detection marks 834 coincide with tray setting marks 826 on the tray guide 82.

In this state, when a recording signal is transmitted from a host computer, a recording operation is started. First, as shown in FIG. 18, the conveying roller 36, the first sheet discharge roller 40 and the second sheet discharge roller 41 rotate in a reverse direction. By raising the tray 83 to the first sheet discharge roller 40 and the second sheet discharge roller 41 with a predetermined pressure by the pressing roller 811 and the roller spring 812, the conveying force for the tray 83 is produced. Accordingly, by inverse rotation of the first sheet discharge roller 40 and the second sheet discharge roller 41, the tray 83 is conveyed into the recording apparatus. By pinching of the tray sheet 83 between the conveying roller 36 and the pinch roller 37, a predetermined conveying force is generated. The tapered portion 830 at the distal end of the tray 83 is raised by the pinch roller 37, and the tray 83 is grasped between the conveying roller 36 and the pinch roller 37.

Then, in order to detect the tray 83, the carriage 50 moves from the home position to a recording region. At that time, as shown in FIG. 19, the guide shaft 52 is raised by being driven by the carriage raising/lowering motor 58, so that an optimum gap can be provided with respect to the tray 83.

Figure 16A:
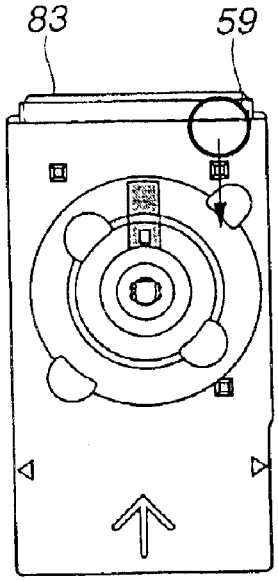
FIGS. 16A–16F are diagrams, each illustrating a relative position of a position detection sensor with respect to the tray in the first embodiment.
Figure 16B:
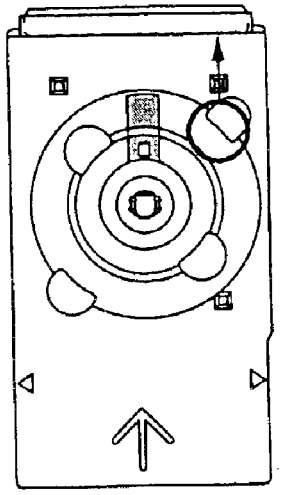

As shown in FIGS. 16A and 16B, the carriage 50 stops at a position where the tray-position detection sensor 59 is adjusted with a position detection mark 834*a* on the tray 83.

Figure 16C:
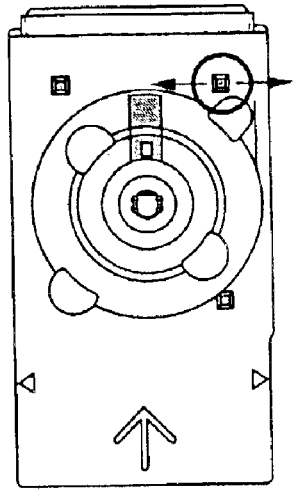

Then, the position of the upper edge of the position detection mark 834*a* is detected while conveying the tray 83, and then the position of the lower edge of the position detection mark 834*a* is detected by further conveying the tray 83. Then, as shown in FIG. 16C, the tray 83 is returned so that the tray-position detection sensor 59 reaches a substantially central portion of the position detection mark 834*a*. Then, by moving the carriage 50 to the right and to the left, the position of the right edge of the position detection mark 834*a* and the position of the left edge of the position detection mark 834*a* are detected. According to the above-described operation, a central position 834*ac* of the position detection mark 834*a* can be calculated, and a printing position on the CD mounted on the tray 83 is obtained based on the central position 834*ac*. As described above, since the position of the tray 83 itself is detected, deviation in printing due to variations in accuracy of components, the state of the tray, and the like will not occur, in comparison with a case in which printing is performed only relying on mechanical accuracy without performing detection.

Figure 16D:
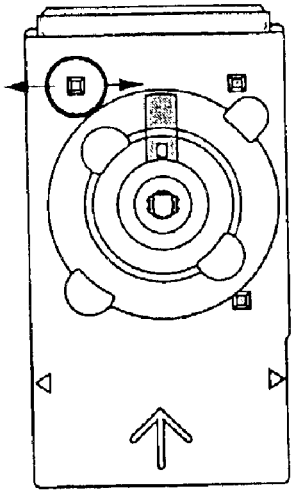
Figure 16E:
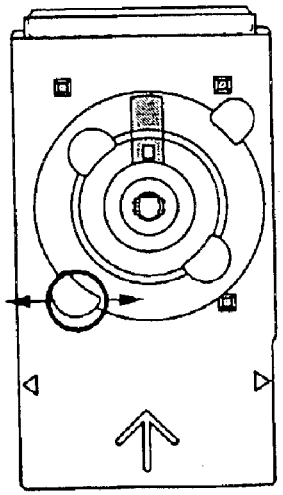

As shown in FIG. 16D, after detecting the position detection mark 834*a*, the carriage 50 moves in order to detect a position detection mark 834*b*. By detecting edges at both sides, it is confirmed that the previously detected position detection mark 834*a* is correct. When the tray 83 is erroneously inserted to a more rear position than a normal set position, even if the position detection mark 834*c* is erroneously detected as shown in FIG. 16E, it is known that the detected mark is not the position detection mark 834*a* by the moving operation for detecting the position detection mark 834*b*.

Figure 16F:
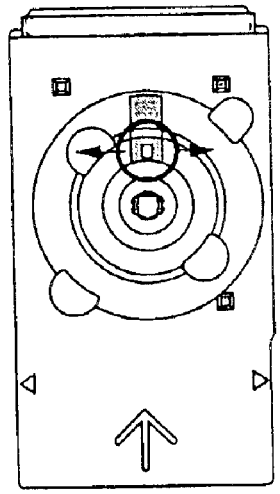

As shown in FIG. 16F, after detecting the position of the tray 83, the tray 83 is conveyed so that the tray-position detection sensor 59 of the carriage 50 coincides with the position of the medium presence/absence detection mark 838 of the tray 83. At that time, edges of the detection hole of the medium presence/absence detection mark 838 are detected. When the distance between the edges coincides with a predetermined hole width, it is determined that a CD is not mounted. Accordingly, the printing operation is interrupted, the tray 83 is discharged to a predetermined position, and an error is displayed. When the medium presence/absence detection mark 838 cannot be detected, it is determined that a CD is mounted, and the printing operation is continued.

Upon completion of the above-described series of initial operations, the tray 83 is conveyed to a predetermined position where printing can be performed on the entire surface of the CD at a rear portion of the main body of the recording apparatus. Then, recording is started in accordance with image data transmitted from the host computer. By performing so-called multipass recording in which an image is formed with a plurality of scanning lines, it is possible to mitigate uneven bands and the like due to insufficiency in accuracy of conveyance and ink discharge from the recording head 7.

Upon completion of printing, the tray 83 is conveyed to a position set to the tray guide 82 by the operator before the above-described printing operation. In this state, the operator can take the tray 83 mounting the CD on which printing has been performed. By drawing the slide cover 81, the arm 85 is released from the spur base 43. By releasing the hook 84 from the lower case 99, the CD conveying unit 8 is released from the main body of the recording apparatus, and can be detached.

According to the above-described configuration and operation, it is possible to perform very precise printing on a CD with a simple operation.

Although in the first embodiment, the arm 85 can be accommodated within the tray guide 82, a modified configuration may also be adopted in which the arm 85 is fixed to the tray guide 82. In this case, when the tray guide 82 is mounted in the main body of the recording apparatus, the arm 85 raises the spur base 43.

Figure 37:
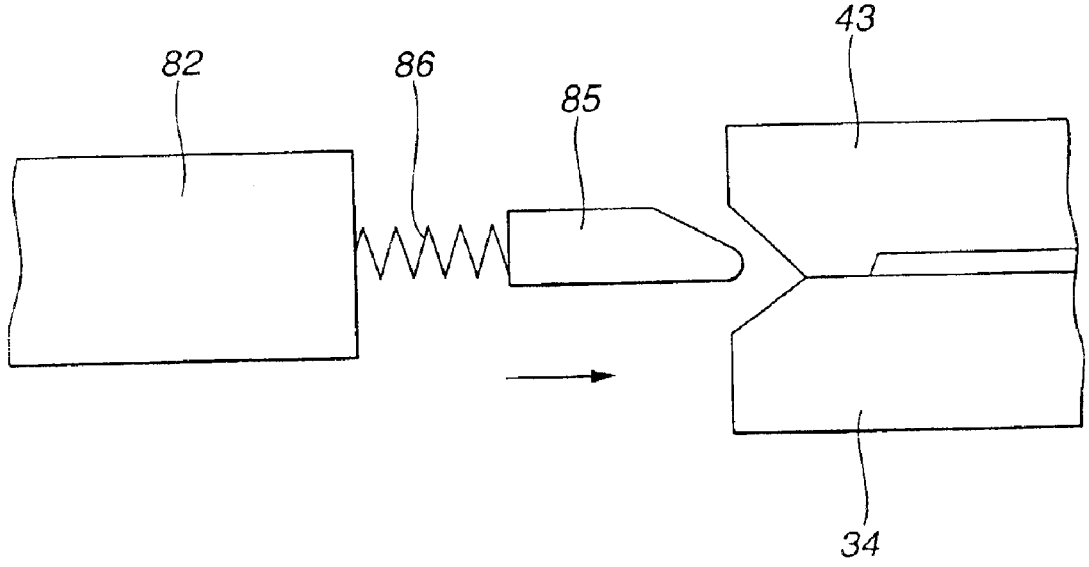
FIG. 37 is a schematic diagram illustrating a modified example of the relationship between the arm and the tray guide in the first embodiment.

As shown in FIG. 37, if the arm 85 and the tray guide 82 are connected using an arm spring 86, an error in positioning between the spur base 43 and the platen 34 can be absorbed even if a margin (backlash) is not provided for the arm 85 as in the first embodiment.

According to the above-described configuration, it is possible to further simplify the configuration of a sheet feeding unit for a special recording material, and realize reduction in the production cost. It is also possible to absorb an error in mounting between the main body of the recording apparatus and the sheet feeding unit, and move the spur by an exact amount. Accordingly, the problems that a path for a recording material cannot be sufficiently secured because the amount of raise of the spur base is too small, and occurrence of interference with other components, such as the carriage and the like, because the amount of raise of the spur base is too large do not arise.

(Second Embodiment)

Next, a second embodiment of the present invention will be described in detail with reference to the drawings. The same components as those in the first embodiment are indicated by the same reference numerals, and further description thereof will be omitted. However, in each of the following embodiments, in order to facilitate understanding, some of these components will be again described while modifying the description.

Figure 38:
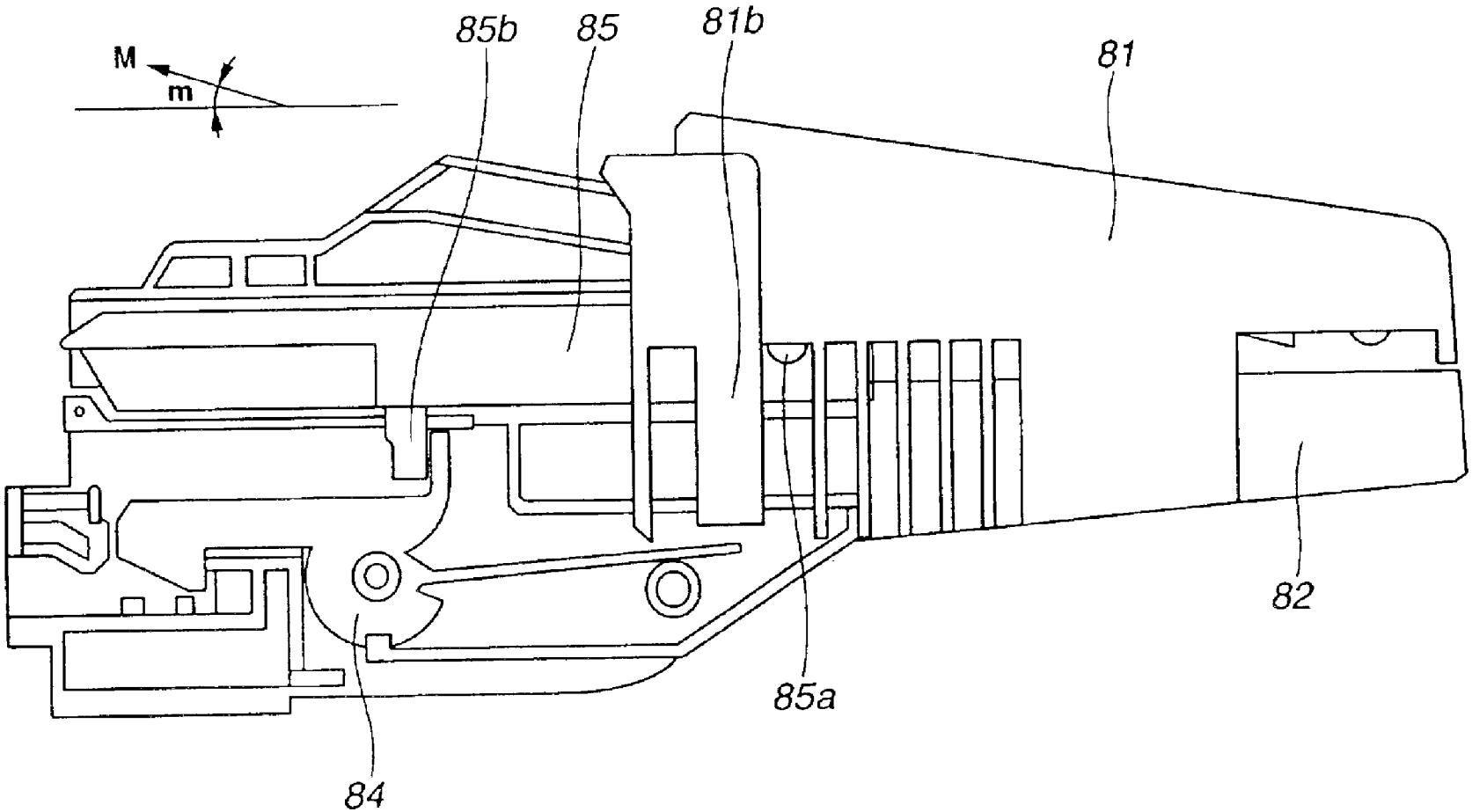
FIG. 38 is a side view illustrating a state of preparing for mounting of a tray guide in a second embodiment of the present invention.
Figure 39:
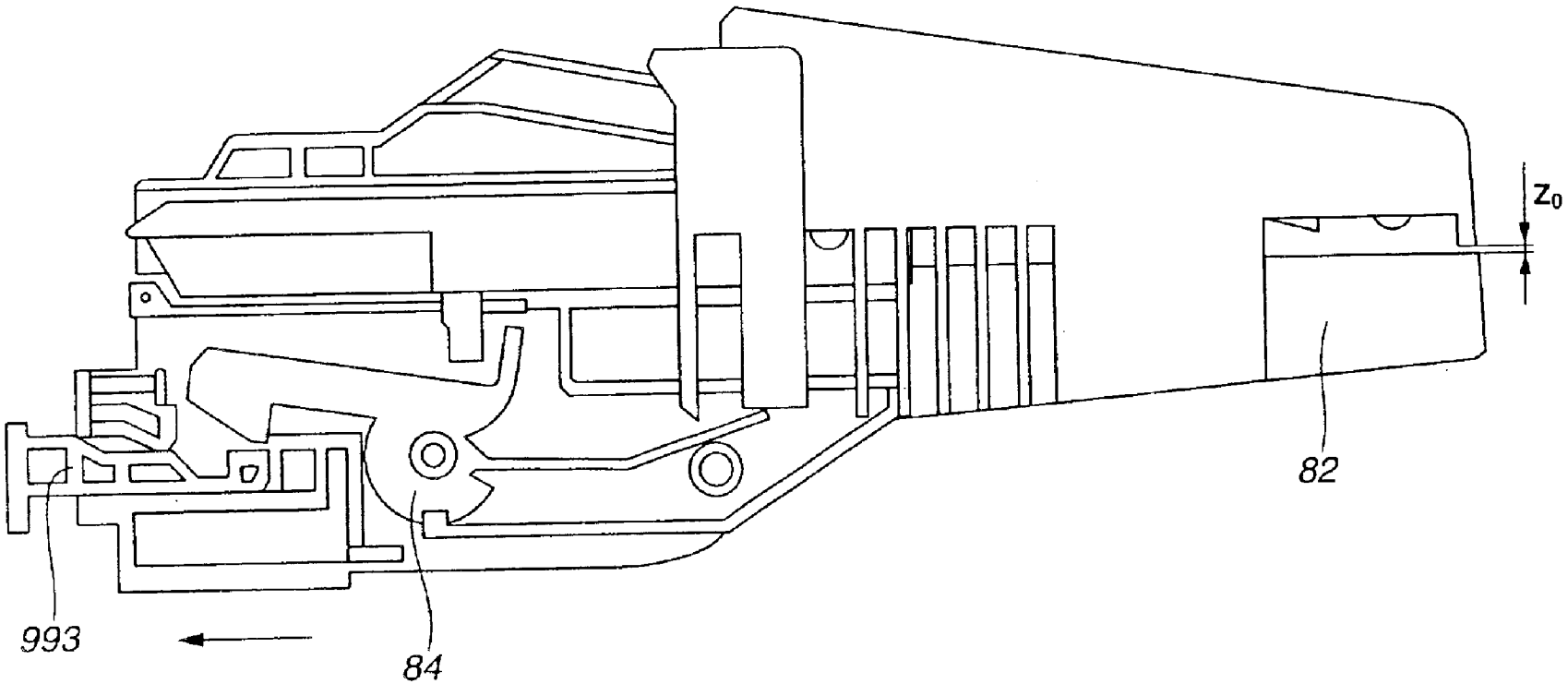
FIG. 39 is a side view illustrating a state in which locking of the tray guide is released in the second embodiment.
Figure 40:
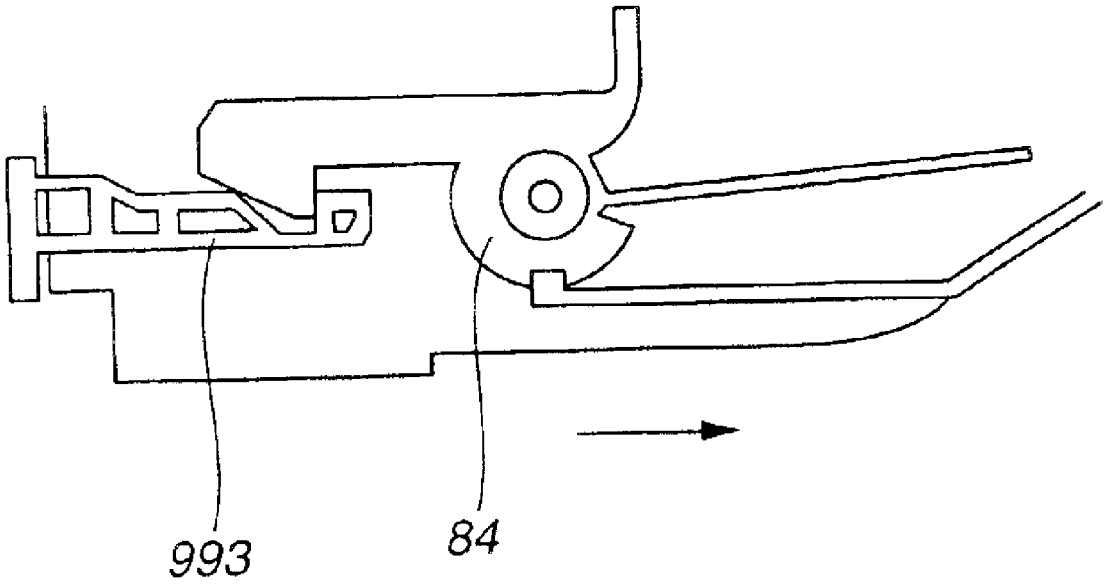
FIG. 40 is a side view illustrating a tray-guide locking state in the second embodiment.
Figure 41:
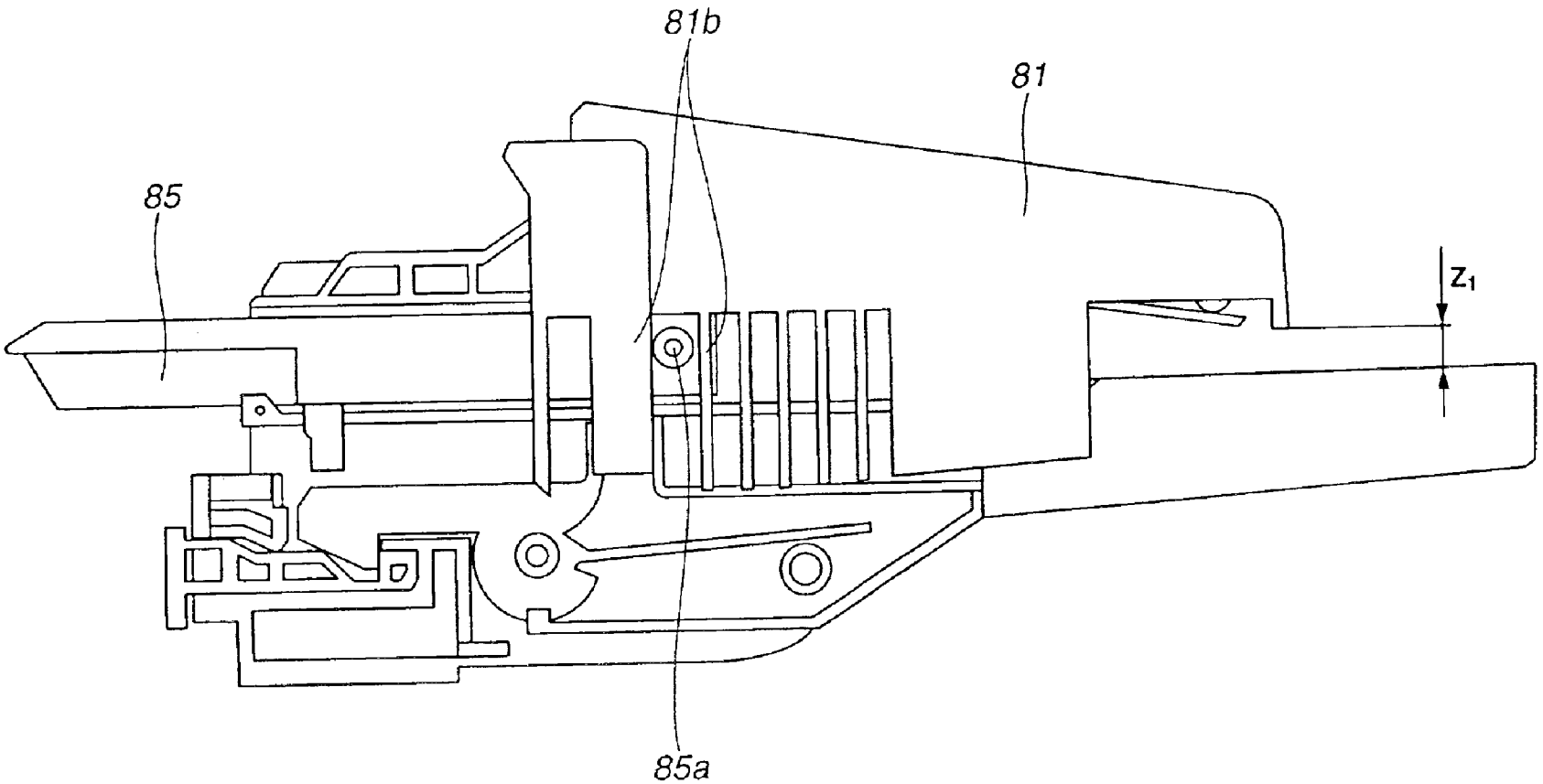
FIGS. 41 and 42 are a side view and a cross-sectional view, respectively, illustrating a state in which the tray guide is set in the main body of a recording apparatus in the second embodiment.

In the second embodiment, a slide cover 81 is slid by sliding a guide pin provided inside of a tray guide 82 along a guide groove 82 in the direction of an angle m (see FIG. 38). First, as shown in FIG. 39, the tray guide 82 is caused to enter the main body of the recording apparatus by sliding the tray guide 82 in the direction of an arrow Y. At that time, a hook 84 is swung in a clockwise direction by a guide rail 993. When the tray guide 82 is further slid, then, as shown in FIG. 40 indicating a principal portion, the hook 84 completely meshes with the guide rail 993 to provide a locked state. In this state, the tray guide 82 cannot be detached even if it is pulled. FIG. 41 illustrates a state in which the slide cover 81 is further pushed in the Y direction and is raised with an angle m. The interval between the tray guide 82 and the slide cover 81, i.e., the width of the opening 821, increases from Z0 shown in FIG. 39 to Z1. At the same time, as described before, the arm 85 moves to a position to enter the main body of the recording apparatus by the post 85*a*. The arm 85 raises the spur 42 to allow the tray 83 to enter a printing region from the tray guide 82.

Figure 42:
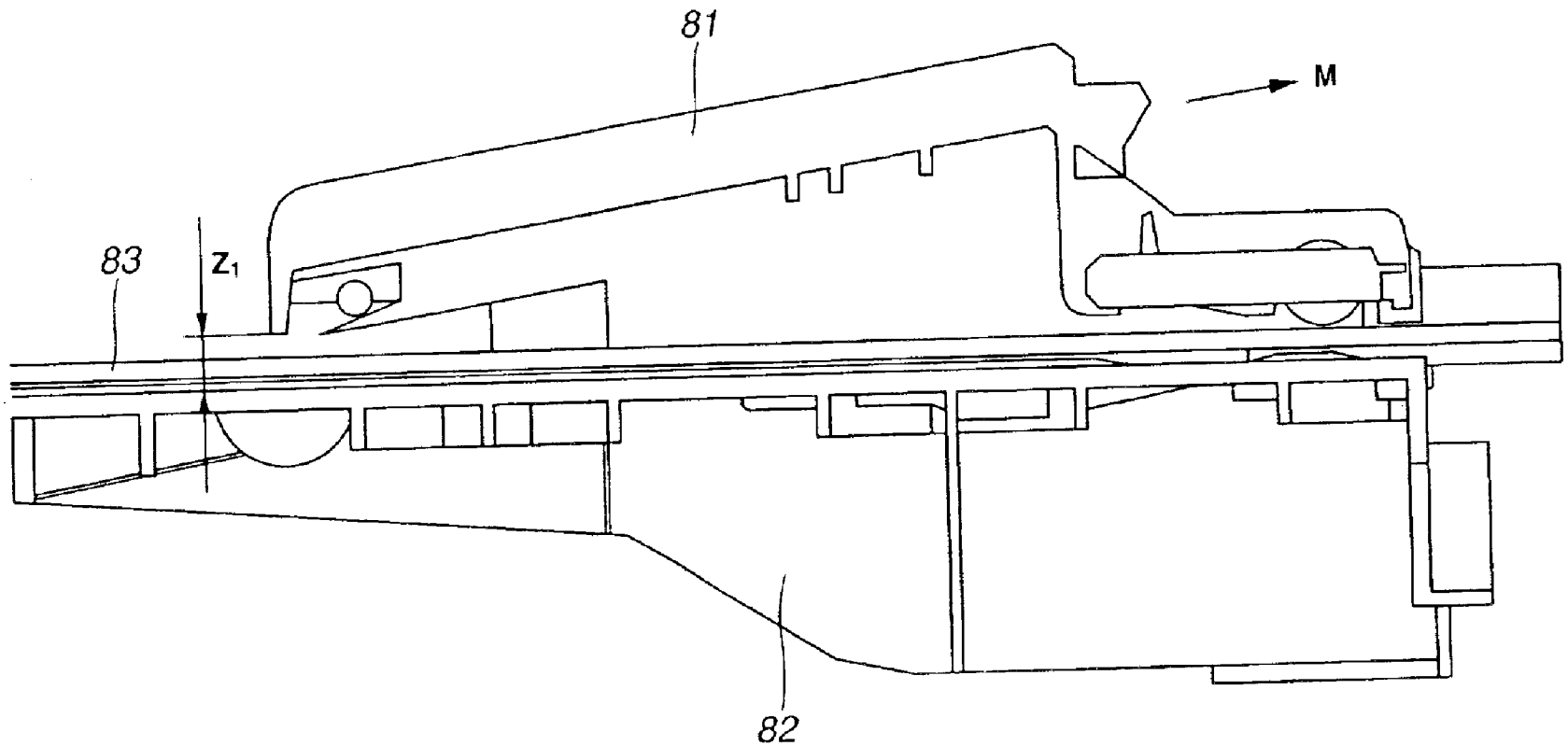
Figure 43:
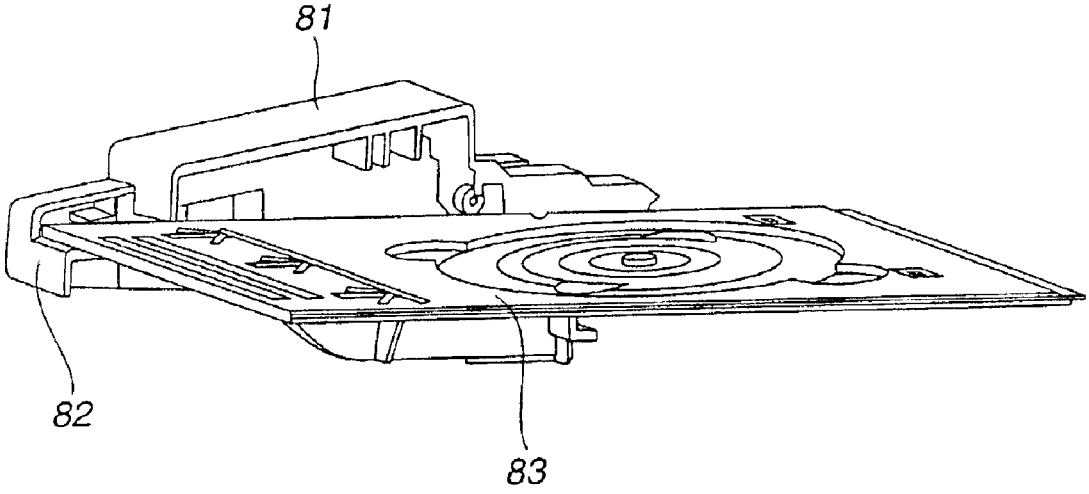
FIG. 43 is a partially-broken perspective view illustrating a tray in a state in which the tray guide is set in the main body of the recording apparatus in the second embodiment.

FIG. 42 is a cross-sectional view as seen from a direction opposite to the direction in FIG. 41. FIG. 43 is a perspective cross-sectional view of the portion shown in FIG. 42, and illustrates the tray 83. It can be understood from FIGS. 42 and 43 that the above-described interval Z1 is sufficient for inserting the tray 83. Accordingly, the tray 83 can be smoothly loaded in a state in which the slide cover 81 is completely pushed.

On the other hand, when the slide cover 81 is moved in a direction opposite to M, the interval between the slide cover 81 and the tray guide 82 is reduced. As a result, the slide cover 81 contacts the tray 83 and cannot be further moved at a midpoint. Hence, the slide cover 81 cannot be moved to the position shown in FIG. 44.

Figure 44:
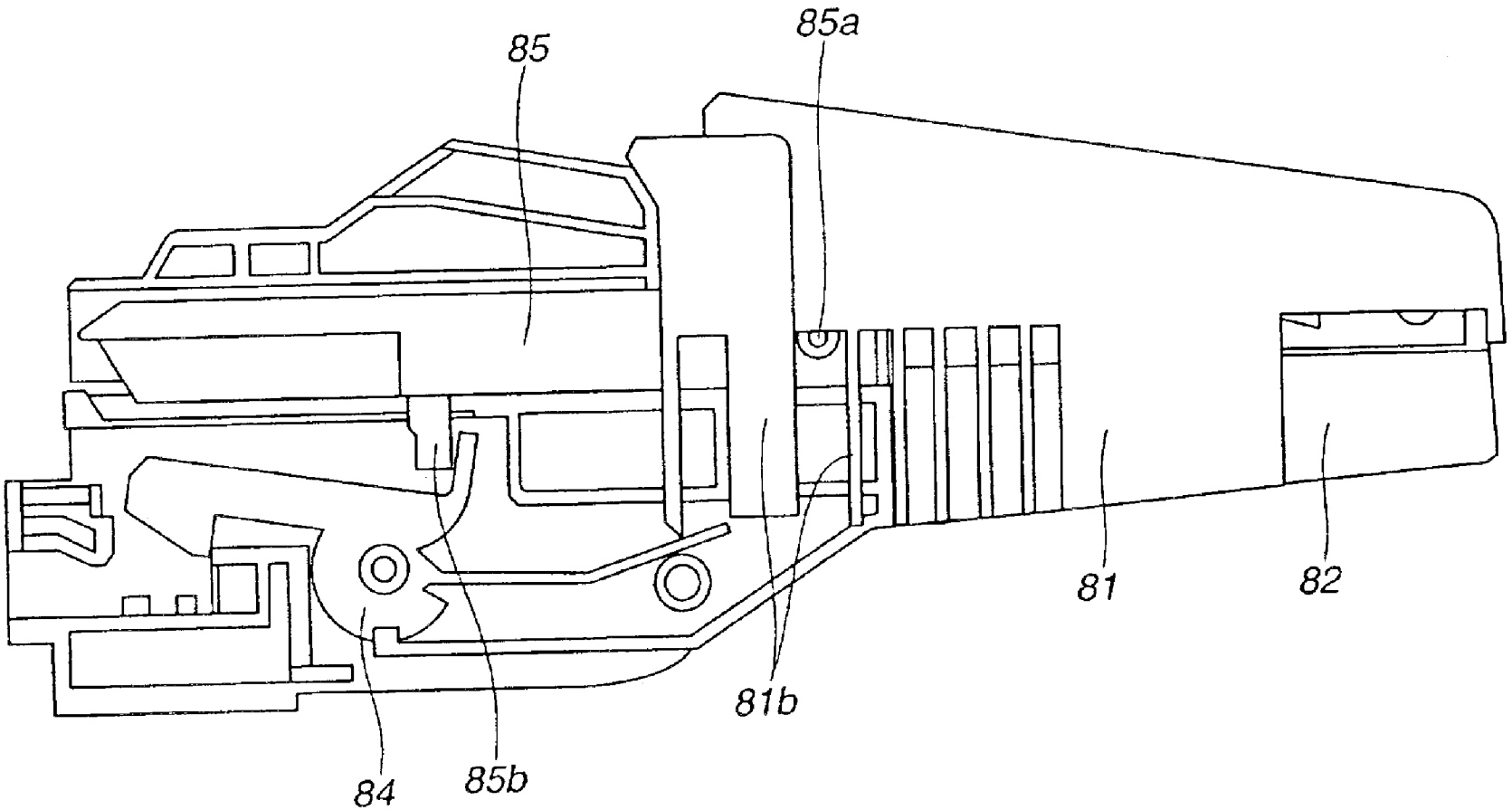
FIG. 44 is a side view illustrating a state in which the tray guide is locked in the second embodiment.

As shown in FIG. 44, the slide cover 81 is slid toward the right in FIG. 44, the arm 85 is accommodated into the tray guide 82 by the post 85*a*. When the slide cover 81 is further slid toward the right, the hook 84 is rotated in a clockwise direction by the engaging portion 85*a* of the arm 85, connection of the tray guide 82 with the main body of the recording apparatus is released, and the tray guide 82 can be detached. However, if the tray guide 82 cannot be moved to the position shown in FIG. 44, it cannot be detached from the main body of the recording apparatus.

(Third Embodiment)

Next, a third embodiment of the present invention will be described in detail with reference to the drawings. The same components as those in the first and second embodiments are indicated by the same reference numerals, and further description thereof will be omitted.

Figure 45:
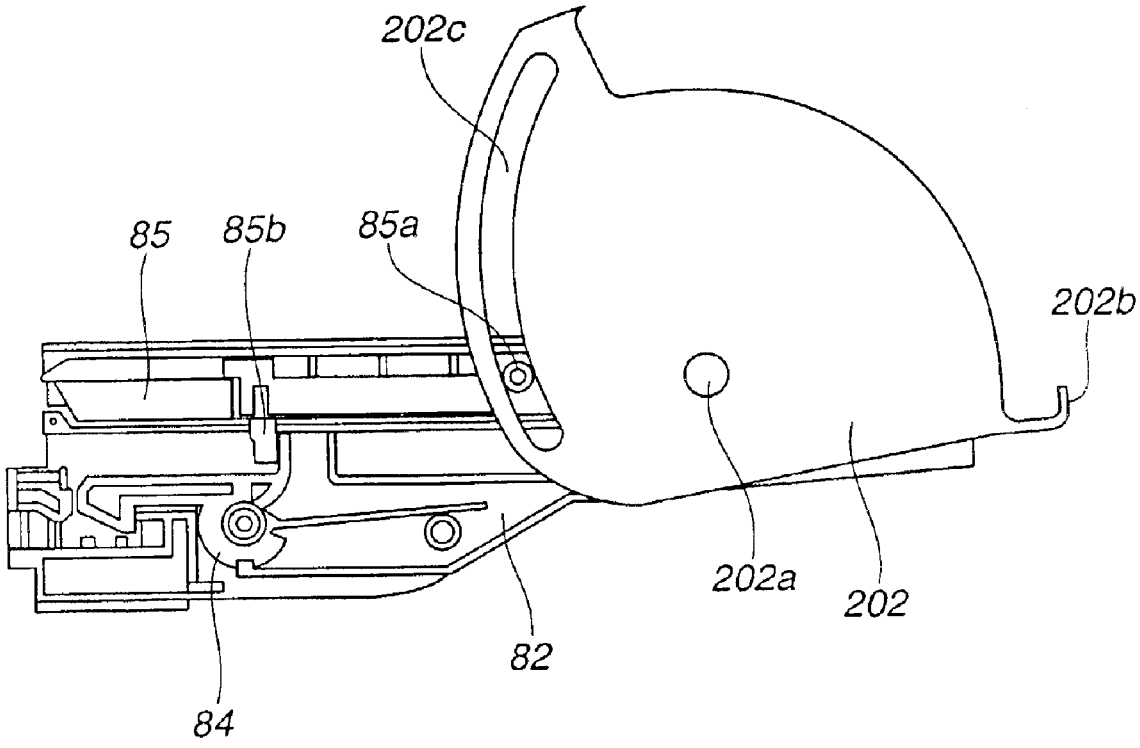
FIG. 45 is a side view illustrating a state of preparing for mounting of a tray guide in a third embodiment of the present invention.

In the third embodiment, a rotation knob 202 rotatable around a rotation shaft 202*a* is mounted at a tray guide 82. An arm 85 is slidable in the left and right directions of the tray guide 82, and is guided by upper and lower ribs with a space of about 1 mm above and below. A post 85*a* engages with a groove 202*c* of the rotation knob 202. By rotation of the rotation knob 202, the tray guide 82 is slid to the left and the right. When the rotation knob 202 is rotated in a clockwise direction from the state shown in FIG. 45, the arm 85 slides, to rotate a hook 84 in a counterclockwise direction by an engaging unit 85*b*. If the rotation knob 202 is rotated in a counterclockwise direction, the arm 85 protrudes to the left in FIG. 45.

Figure 46:
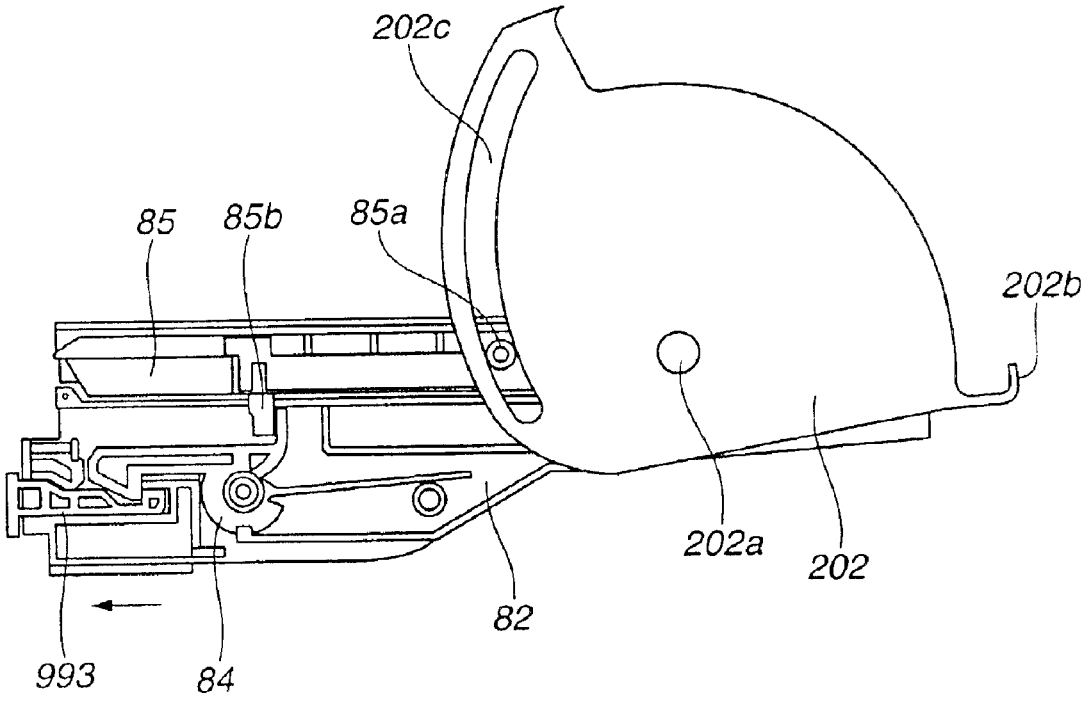
FIG. 46 is a side view illustrating a state in which the tray guide is mounted in the main body of a recording apparatus in the third embodiment.

FIG. 46 illustrates a state in which the tray guide 82 is mounted in the main body of the recording apparatus. A hook 84 is engaged with a guide rail 993.

Figure 47:
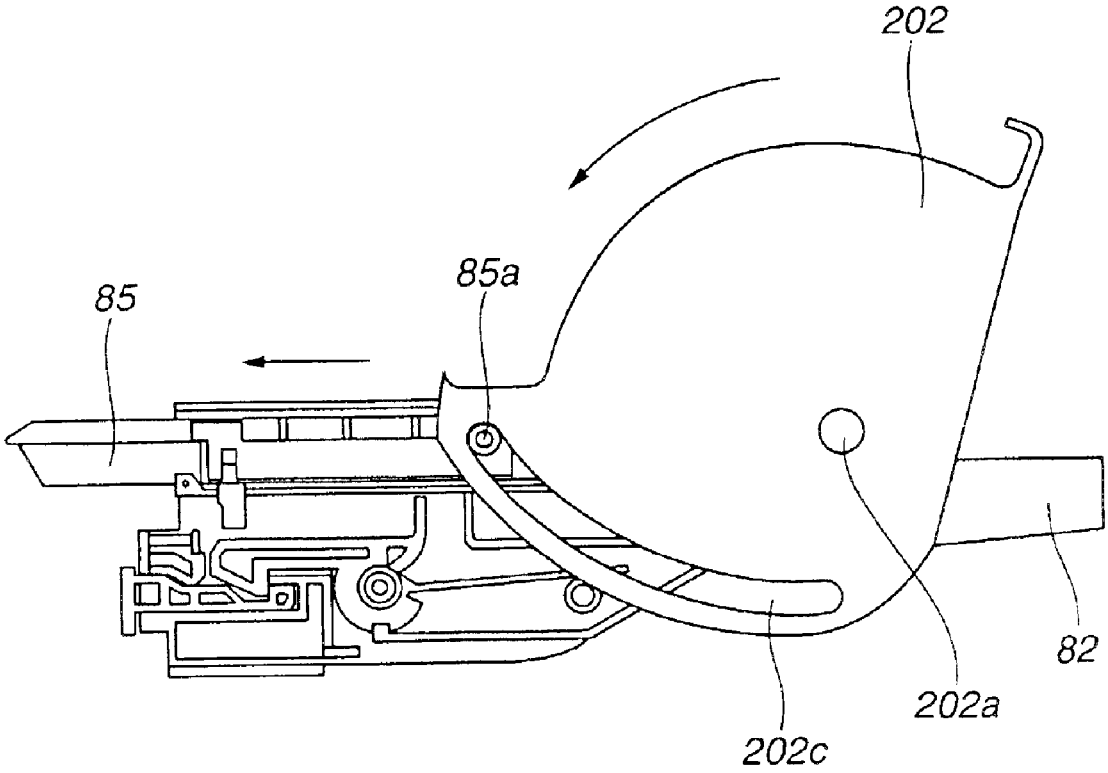
FIGS. 47 and 48 are a side view and a perspective view, respectively, illustrating a state in which the tray guide is set in the main body of the recording apparatus in the third embodiment.
Figure 48:
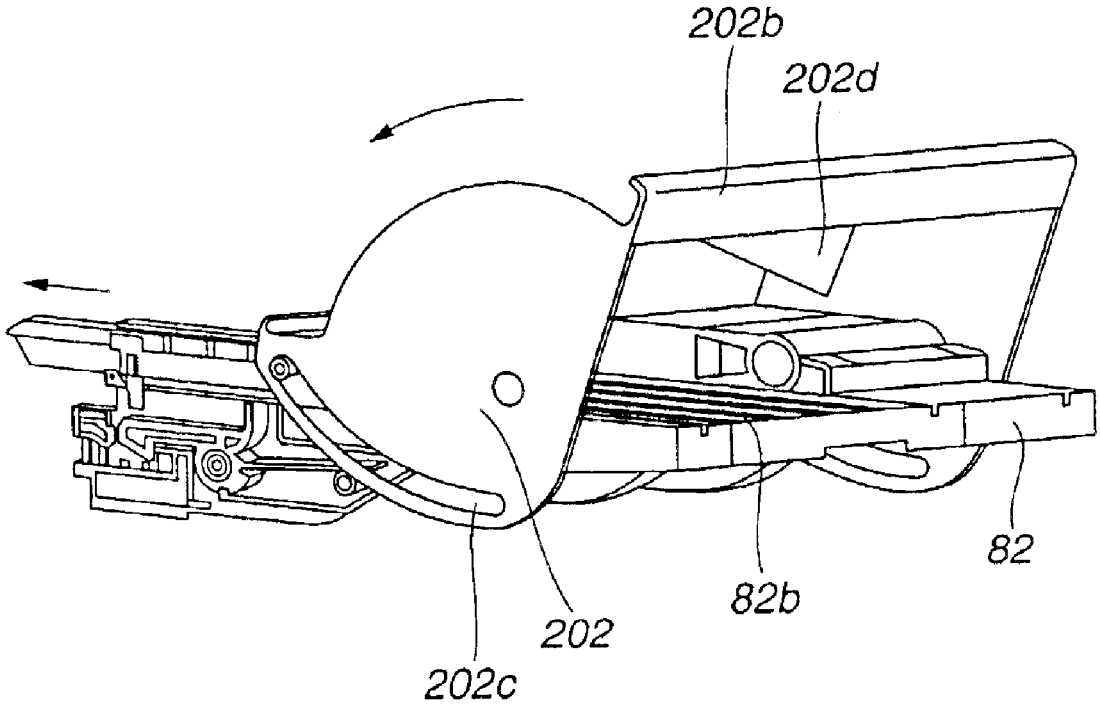
Figure 49:
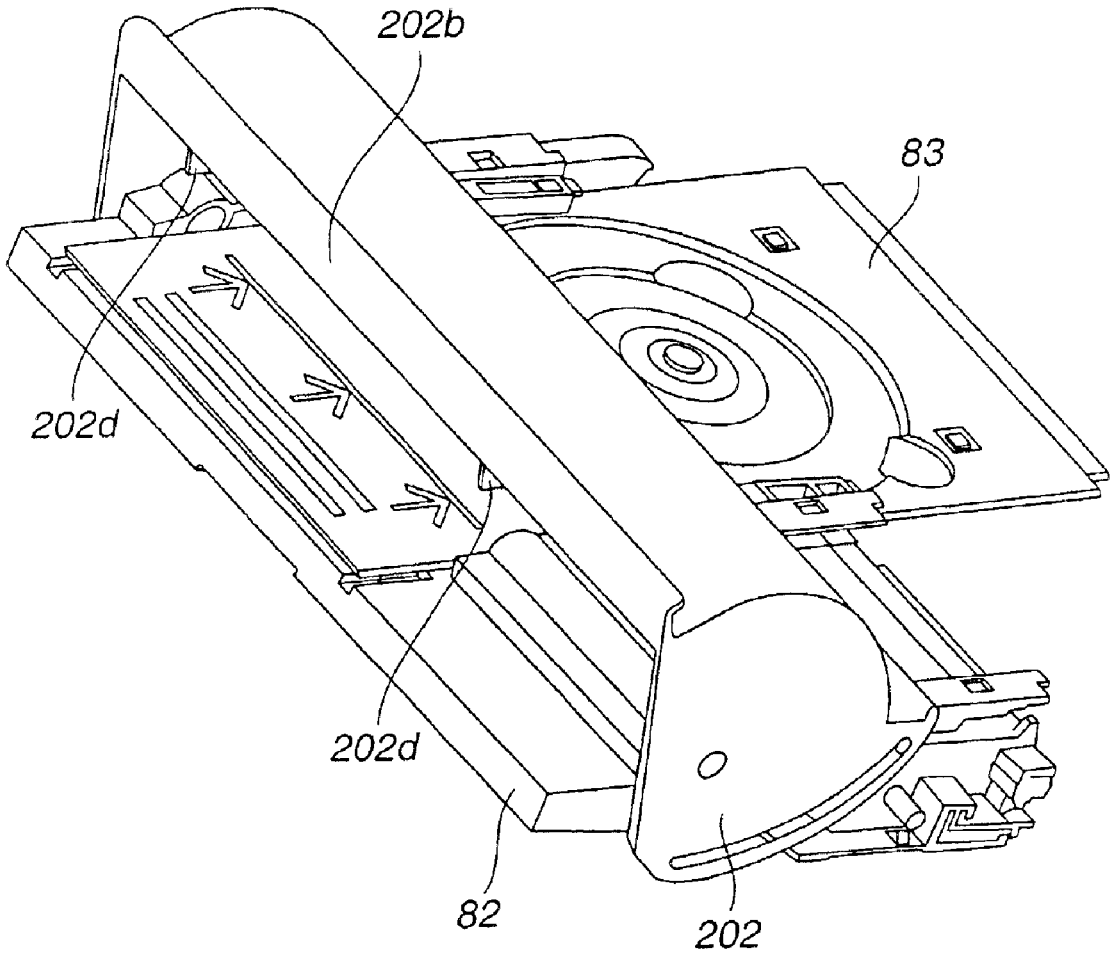
FIG. 49 is a perspective view illustrating a tray in a state in which the tray guide is set in the main body of the recording apparatus in the third embodiment.

FIGS. 47–49 illustrate a state in which the rotation knob 202 is rotated in a counterclockwise direction from the state shown in FIG. 46. The arm 85 raises the spur roller 42, and a tray 83 can enter a printing region. As shown in FIG. 48, a rib 82*b* is provided at the tray guide 82. A rotation-knob control plate 202*d* is provided at the back of a flange 202*b* of the rotation knob 202.

Figure 50:
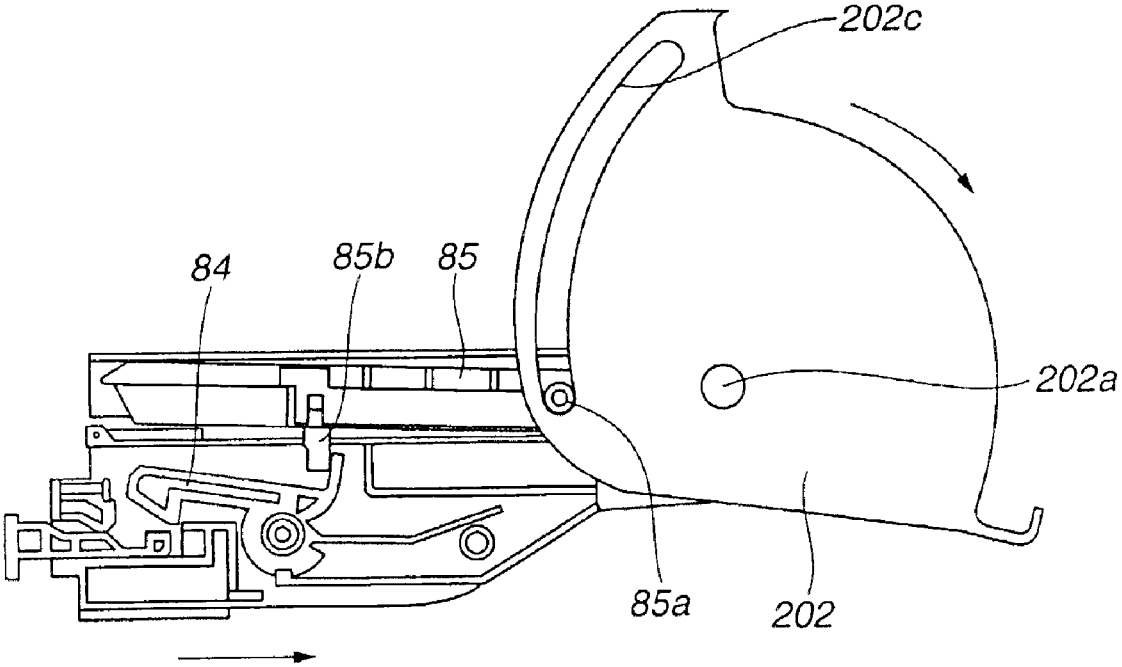
FIG. 50 is a side view illustrating a state in which locking of the tray guide is released in the third embodiment.
Figure 51:
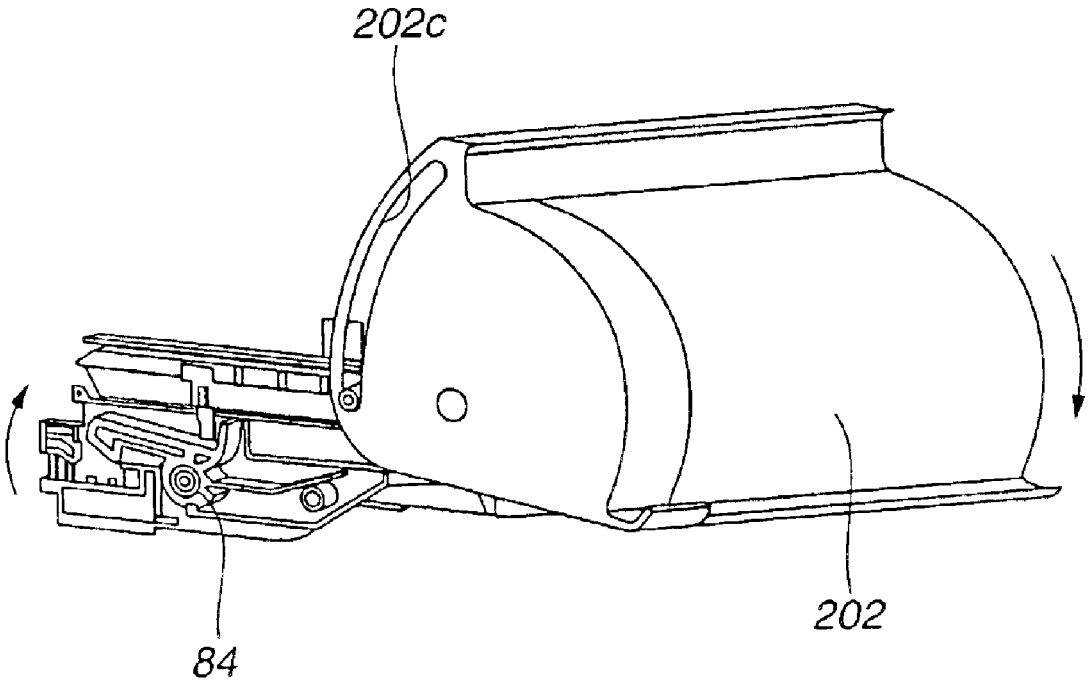
FIGS. 51 and 52 are perspective views, each illustrating a state in which locking of the tray guide is released in the third embodiment.
Figure 52:
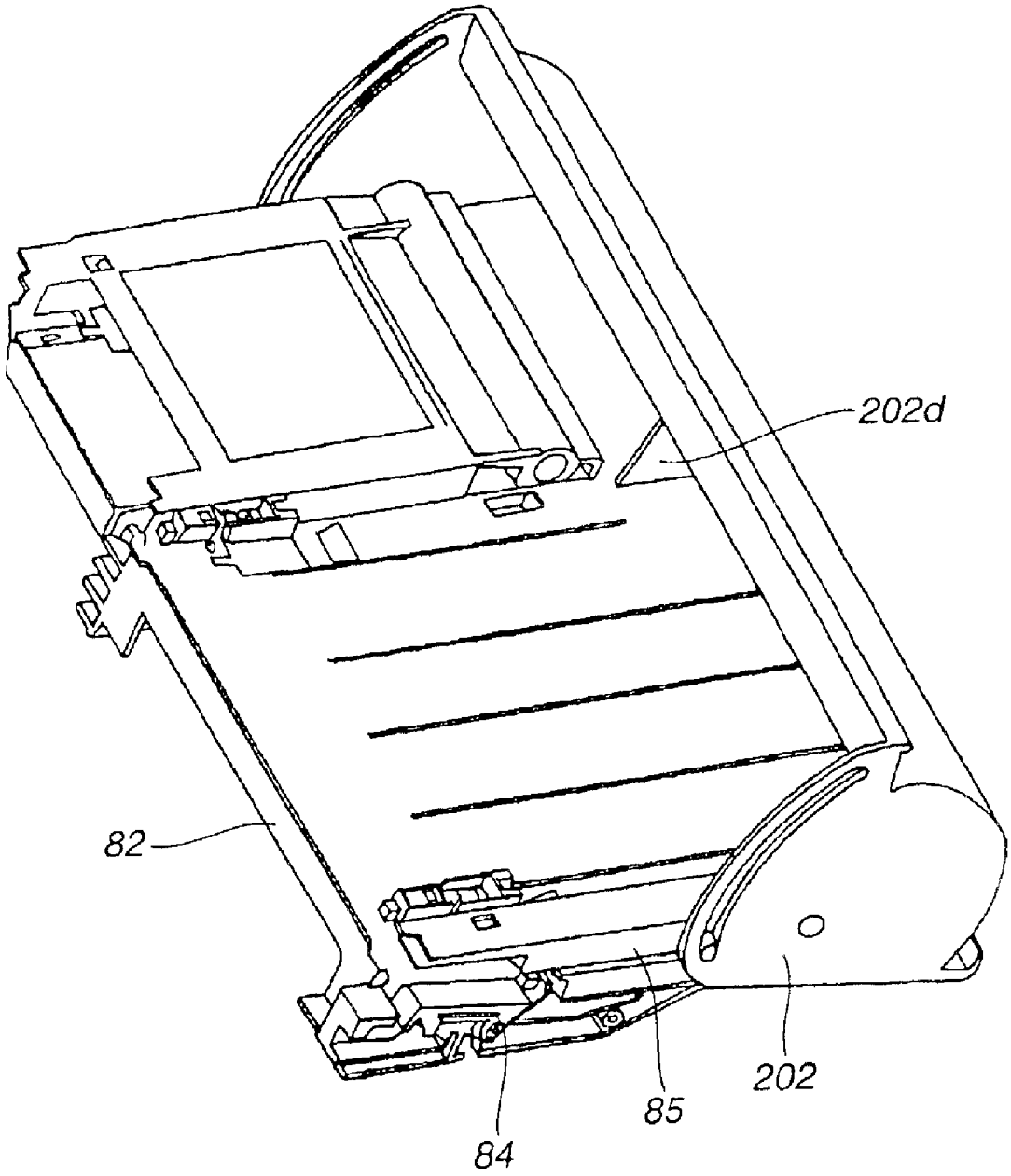

FIGS. 50 and 51 illustrate a state in which from the state shown in FIG. 46, by rotating the rotation knob 202 in a clockwise direction, the hook 84 swings and leaves the guide lever 993 by the post 85*a* and the engaging unit 85*b* of the arm 85, and the tray guide 82 can be detached. In the state shown in FIG. 51, the distal end of the rotation knob 202 blocks the path so that the tray 81 cannot be set in the tray guide 82.

(Fourth Embodiment)

Next, a fourth embodiment of the present invention will be described in detail with reference to the drawings. The same components as those in the first through third embodiments are indicated by the same reference numerals, and further description thereof will be omitted. In the fourth embodiment, the configuration of the tray guide is very much simplified in comparison with the above-described embodiments.

Figure 53:
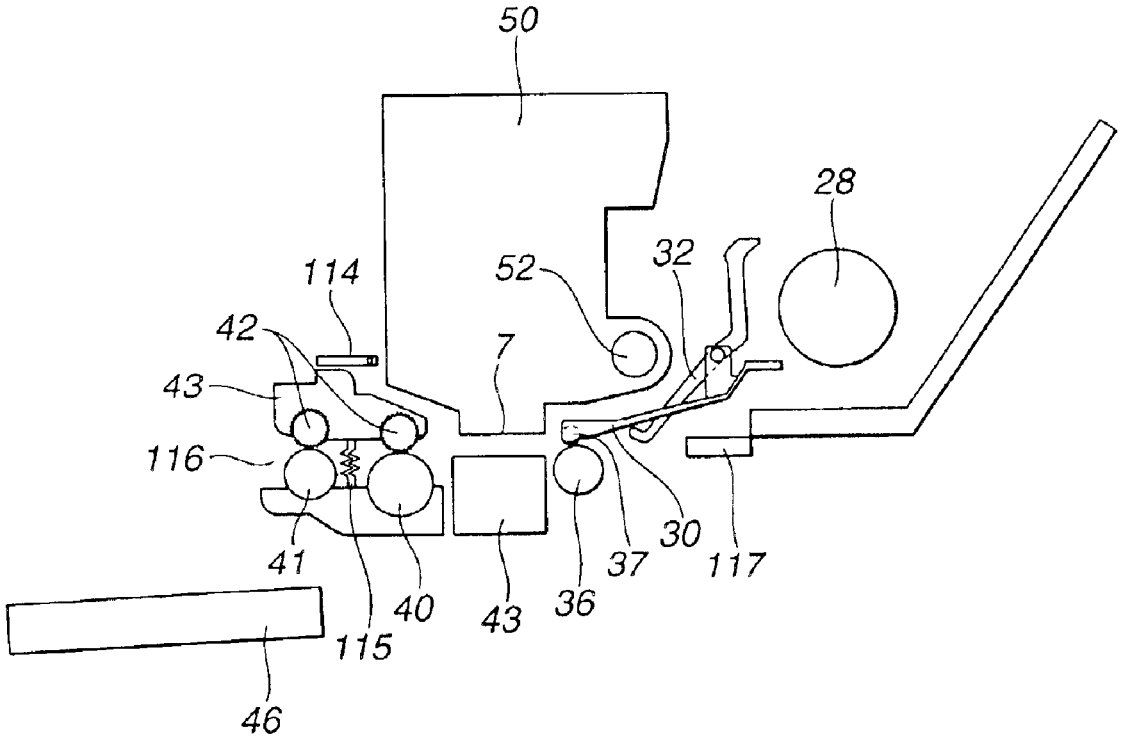
FIG. 53 is a schematic diagram illustrating a state of recording on standard paper in a recording apparatus according to a fourth embodiment of the present invention.

Recording on ordinary standard paper is the same as in the above-described embodiments. As shown in FIG. 53 by being simplified, sheets of a sheet material are mounted on a sheet feeding unit, and are individually fed by a sheet feeding roller 28. The edge of the sheet material is detected by a PE sensor 32, and the sheet material is conveyed on the platen 34 by a pinch roller 37 and a conveying roller 36. By reciprocating a carriage 50 in lateral directions of the sheet material, recording is performed by an ink-jet recording head 7 mounted on the carriage, based on recording data. After completing recording, the sheet material is discharged onto a discharged-sheet tray 43 by a spur 42 mounted on a spur base 43, and sheet discharge rollers 40 and 41.

Figure 54A:
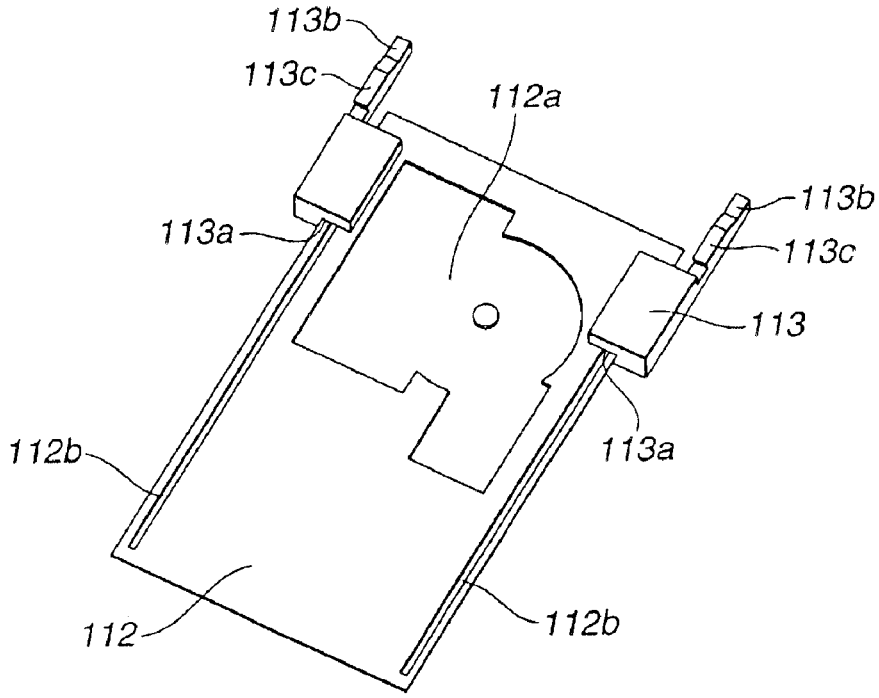
FIGS. 54A–54C are perspective views illustrating a tray and a tray guide in the fourth embodiment.
Figure 54B:
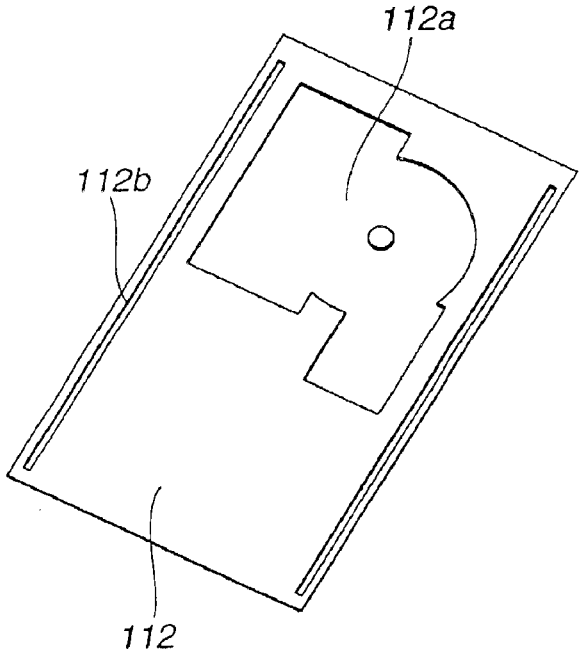
Figure 54C:
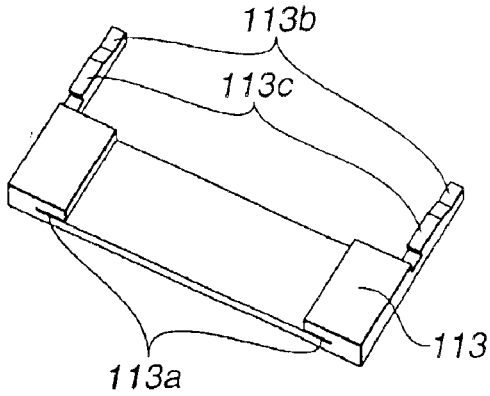

As shown in FIGS. 54A–54C, the fourth embodiment has a very simple configuration in which only tray guides 113 partially hold both sides of a tray 112. Projections 113*a* of the tray guides 113 fit with corresponding grooves 112*b* of the tray 112, so that the tray 112 is regulated so as not to be detached from the tray guide 113. The tray guide 113 is fixed on the main body of the recording apparatus by left and right protruding arms 113*b*, and projections 113*c* provided at the respective arms 113*b* raise and retract the spur base 43.

Figure 55:
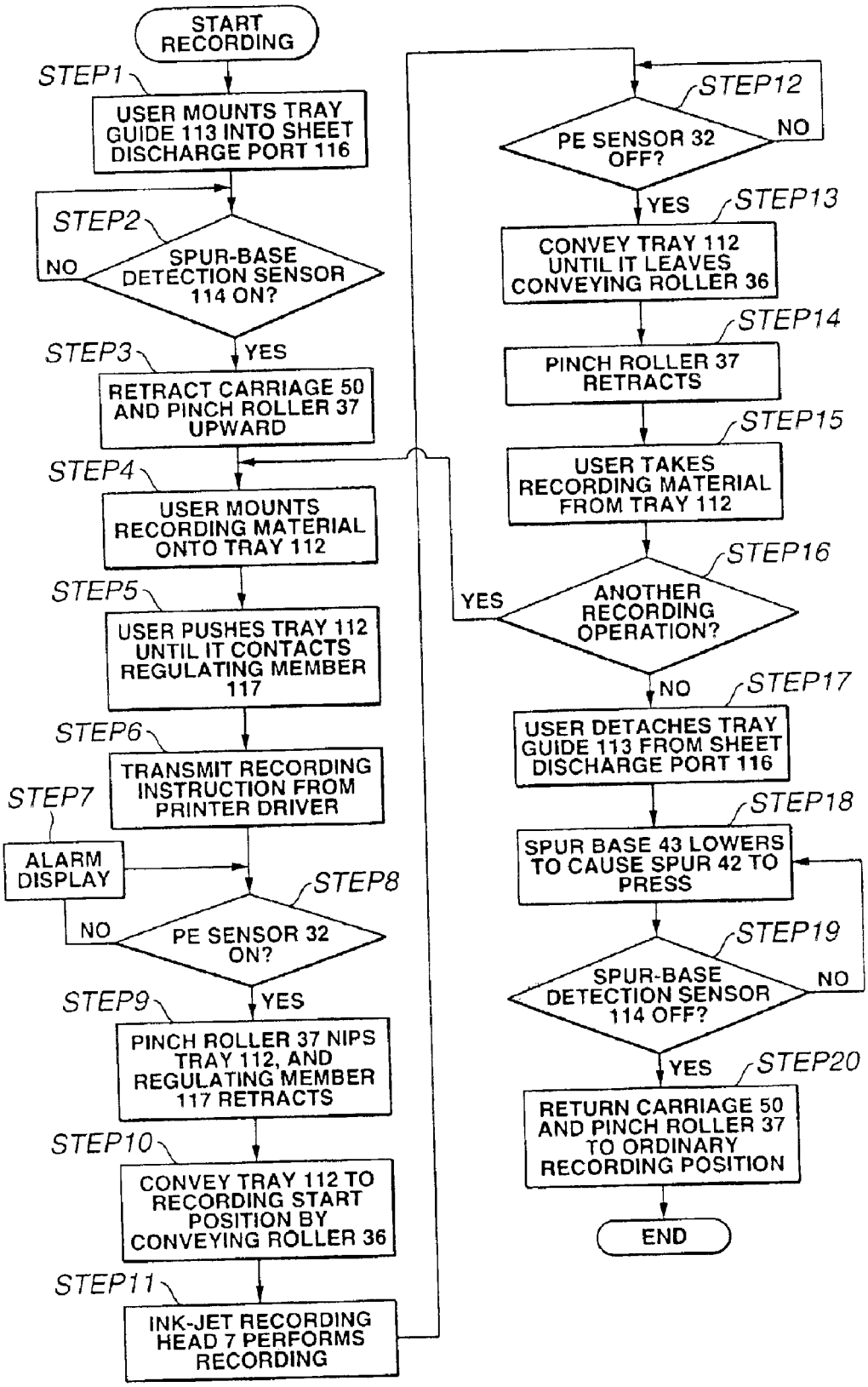
FIG. 55 is a flowchart illustrating a recording method using the tray according to the fourth embodiment.
Figure 56:
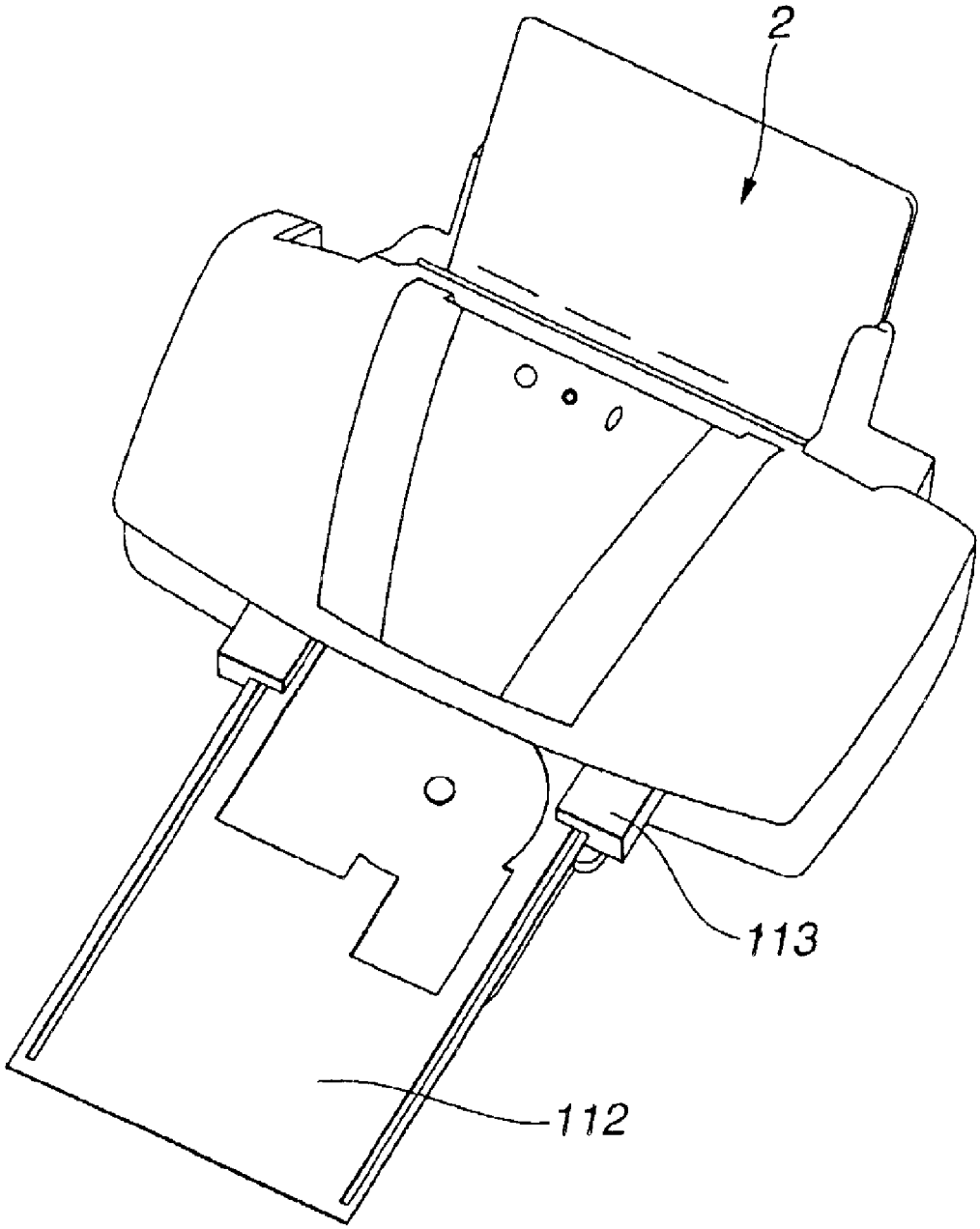
FIG. 56 is a perspective view illustrating a tray mounting state in the recording apparatus of the fourth embodiment.
Figure 57:
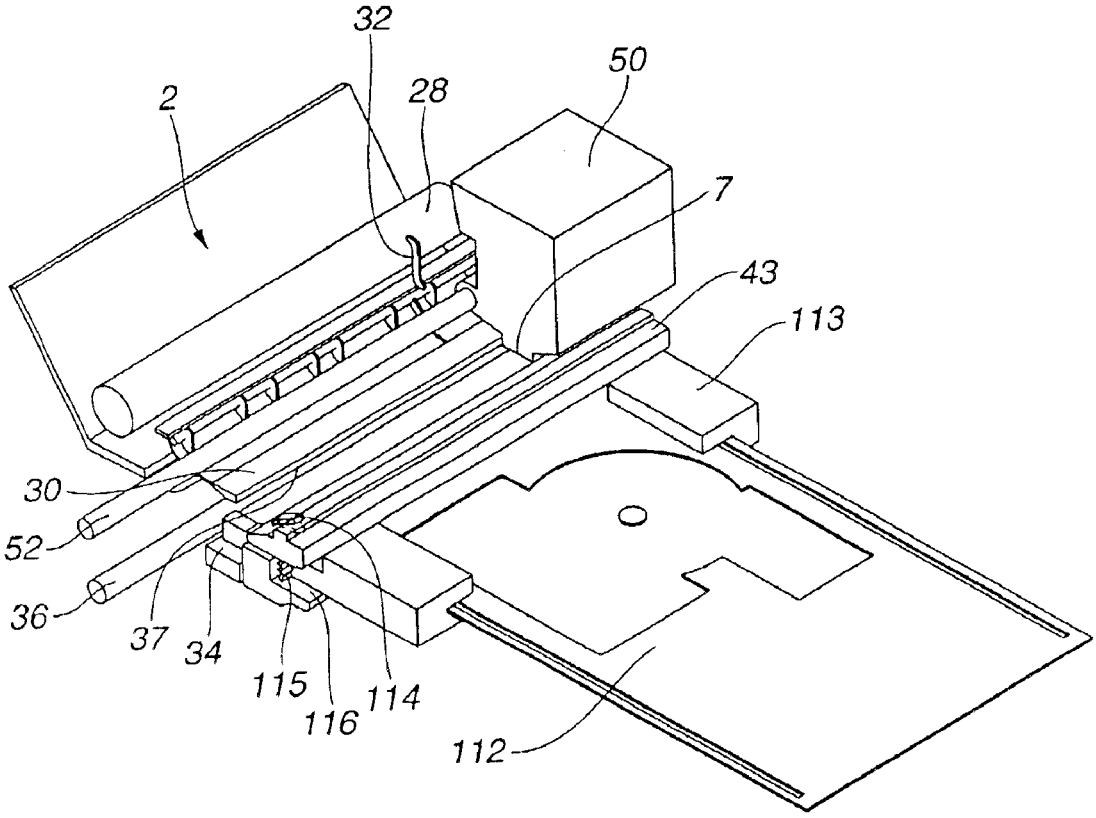
FIGS. 57 and 58 are a perspective view and a side cross-sectional view, respectively, illustrating an internal mechanism of the tray mounting state in the recording apparatus of the fourth embodiment.
Figure 58:
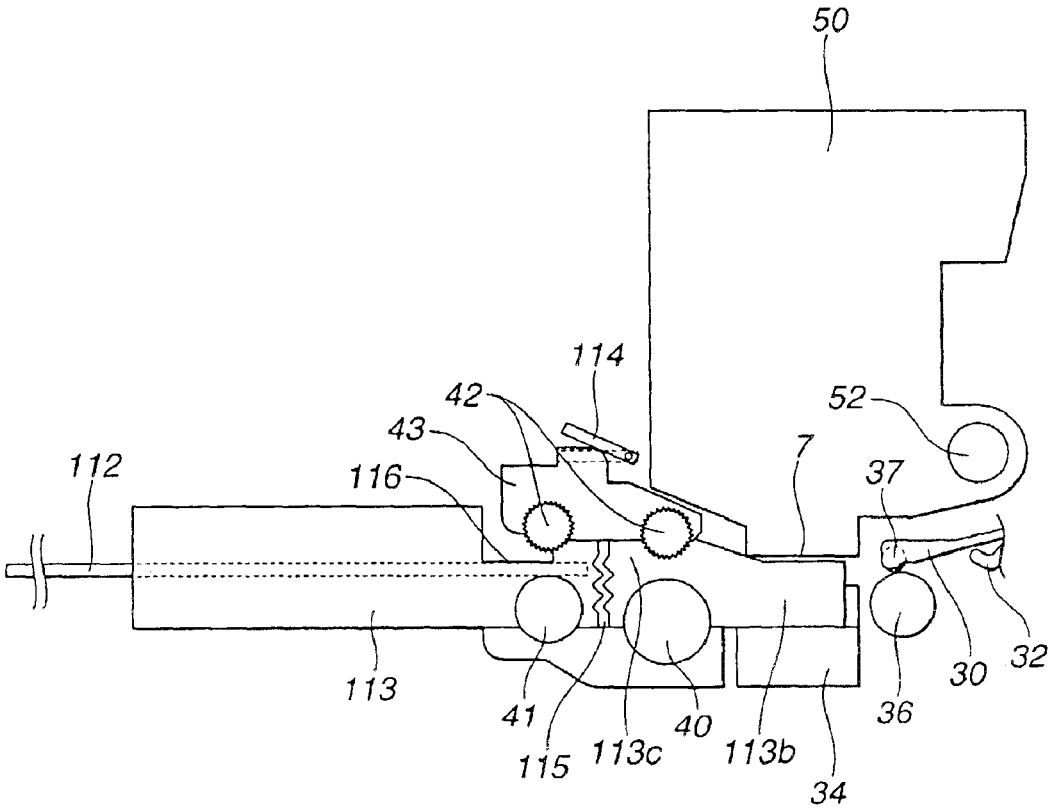

A method for performing recording on a special recording material (for example, a CD) using the tray guide 113 and the tray 112 will now be described. FIG. 55 is a flowchart illustrating the method. FIG. 56 is a schematic perspective view illustrating a state in which the tray 112 and the tray guide 113 are mounted in the main body of the recording apparatus. FIG. 57 is a partially broken perspective view illustrating the tray mounting state. FIG. 58 is a side cross-section view also illustrating the tray mounting state.

First, as shown in FIGS. 56–58, the tray 112 mounting a recording material is mounted into a sheet discharge port 116 of the main body of the recording apparatus (STEP 1). Portions for guiding the left and right arms 113*b* of the tray guide 113 are provided at the sheet discharge port 116 of the main body of the recording apparatus. The arms 113*b* of the tray guide 113 are inserted and fixed in these portions. A configuration may also be adopted in which a hook is provided at each of the left and right arms 113*b* of the tray guide 113, and the hooks are fixed to the sheet discharge port 116. By further inserting the arms 113*b* of the tray guide 113 into the guide portions of the sheet discharge port 116, the spur base 43 that is usually urged downward by a spur-base spring 115 is raised upward by the projections 113*c* provided at the arms 113*b* of the tray guide 113. As a result, the spur base 43 and spurs 42 are separated from the sheet discharge rollers 40 and 41, and a space for allowing the tray 112 to enter the main body of the recording apparatus is secured.

Figure 59A:
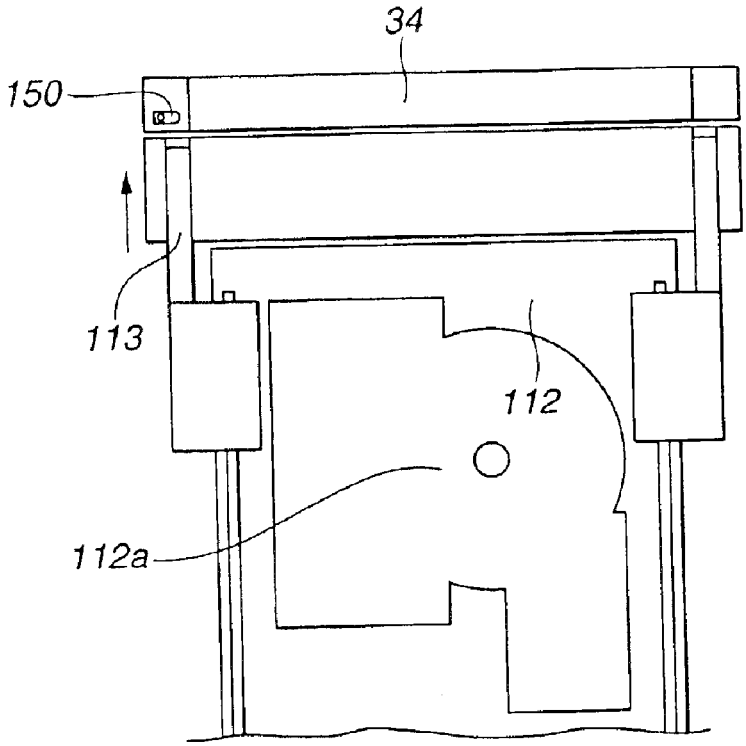
FIGS. 59A and 59B are schematic plan views illustrating a portion near a tray-guide detection sensor according to the fourth embodiment.
Figure 59B:
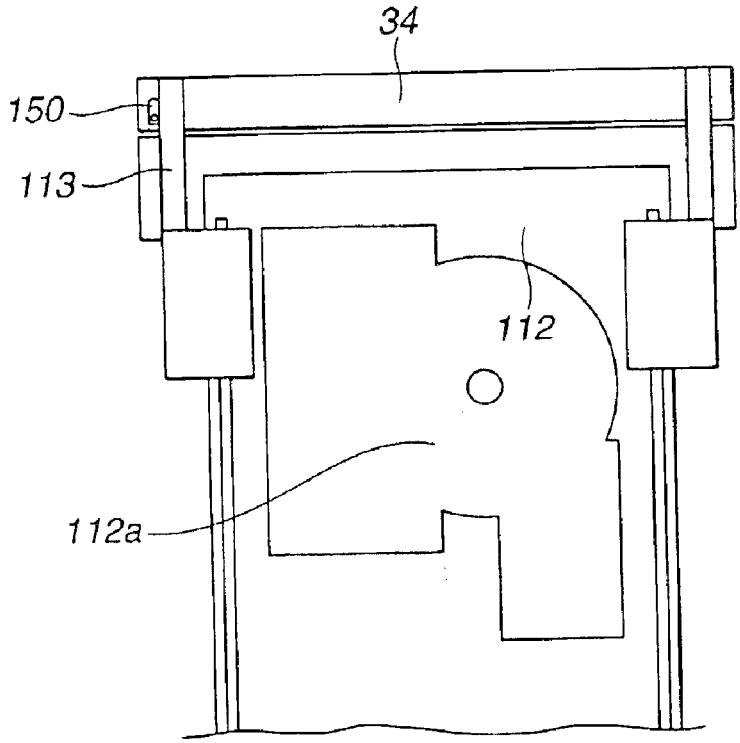

In order to assuredly provide a space for allowing entrance of the tray 112, a configuration may be adopted in which as shown in FIGS. 59A and 59B, a tray-guide detection sensor 150 is provided within the recording apparatus. In this case, for example, the tray-guide detection sensor 150 rotates by being pushed by the mounted tray guide 113, to shift from the state shown in FIG. 59A to the state shown in FIG. 59B, whereby the spur base 43 and the spur 42 leave the sheet discharge rollers 40 and 41 by means of a mechanism (not shown), and a space for allowing entrance of the tray 112 into the main body of the recording apparatus is secured.

Figure 60:
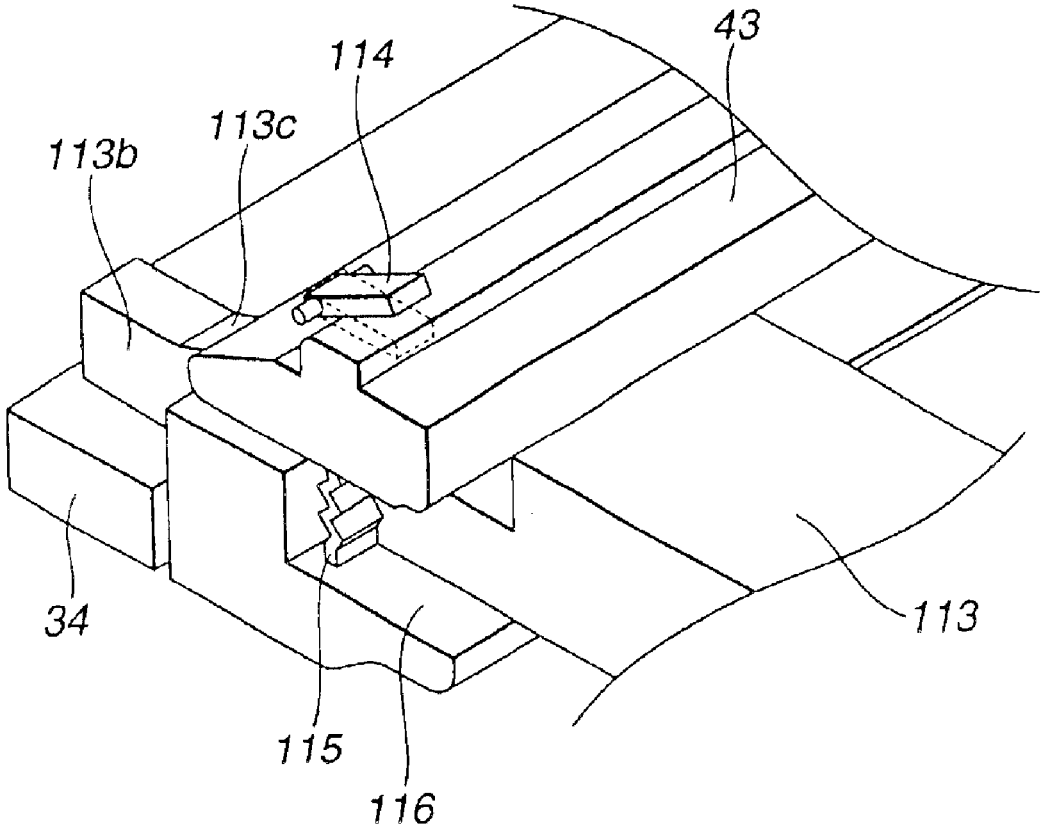
FIG. 60 is a schematic perspective view illustrating a portion near the tray-guide detection sensor of the fourth embodiment.

As shown in FIG. 60, when the spur base 43 retracts, a spur-base detection sensor 114 provided above the spur base 43 rotates by a raise of the spur base 43, and detects that the tray guide 113 is mounted (STEP 2).

Figure 61A:
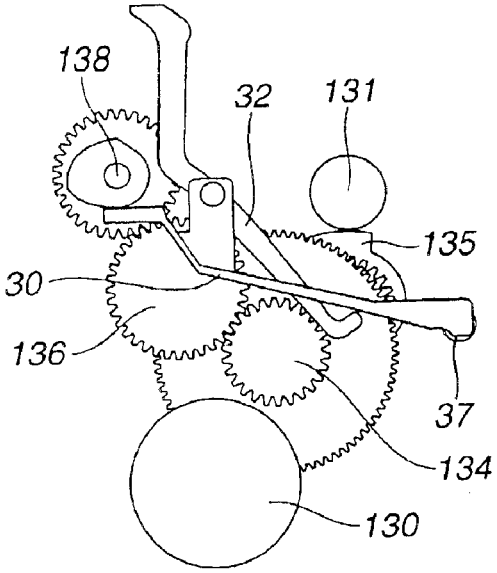
FIGS. 61A–61D are diagrams illustrating a retraction mechanism according to the fourth embodiment.
Figure 61B:
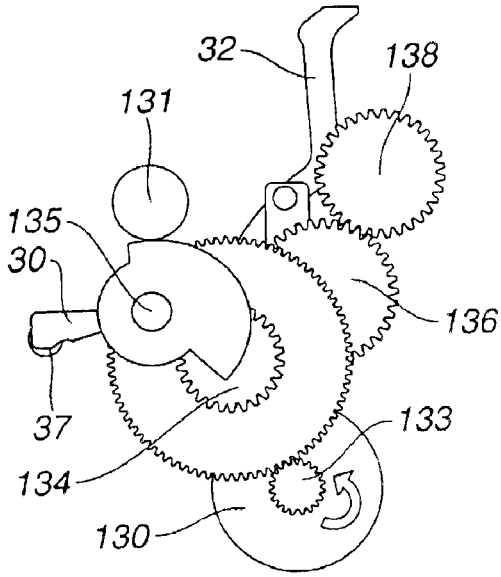

Upon detection of mounting of the tray guide 113 by the spur-base detection sensor 114, a retraction motor 130 revolves in the direction of an arrow shown in FIG. 61B, and the driving force of the retraction motor 130 is transmitted from a retraction-motor pinion 133 to a retraction three-stage gear 134. The driving force is then divided in the direction of the carriage 50 and in the direction of the pinch roller 37. The driving force in the direction of the carriage 50 is then transmitted to a carriage retraction cam 135. The carriage retraction cam 135 rotates in a counterclockwise direction from the position shown in FIG. 61B to the position shown in FIG. 61D. A guide shaft 52 is raised by the carriage retraction cam 135, and the carriage 50 retracts upward.

The driving force in the direction of the pinch roller 37 is transmitted from the retraction three-stage gear 134 to a pinch-roller retraction cam 138 via a pinch-roller retraction intermediate gear 136. The pinch-roller retraction cam 138 rotates from the position shown in FIG. 61A to the position shown in FIG. 61C in a counterclockwise direction, and a pinch-roller holder 30 and the pinch roller 37 retracts by the pinch-roller retraction cam 138. According to the above-described operation, the carriage 50 and the pinch roller 37 retract, and an entrance space for the tray 112 is secured (STEP 3).

Instead of using the spur-base detection sensor 114, a configuration may be adopted in which the carriage 50 and the pinch roller 37 retract by a linked operation of retraction of the spur base 43 by the projection 113*c* provided at the arm 113*b* of the tray guide 113, and a mechanism (not shown). Instead of using the spur-base detection sensor 114, a configuration may be adopted in which a tray-guide detection sensor 150 shown in FIGS. 59A and 59B is used, and when it detects mounting of the tray 112, a mechanism for retracting the carriage 50 and the pinch roller 37 as that shown in FIGS. 59A and 59B operate to retract them.

Figure 62:
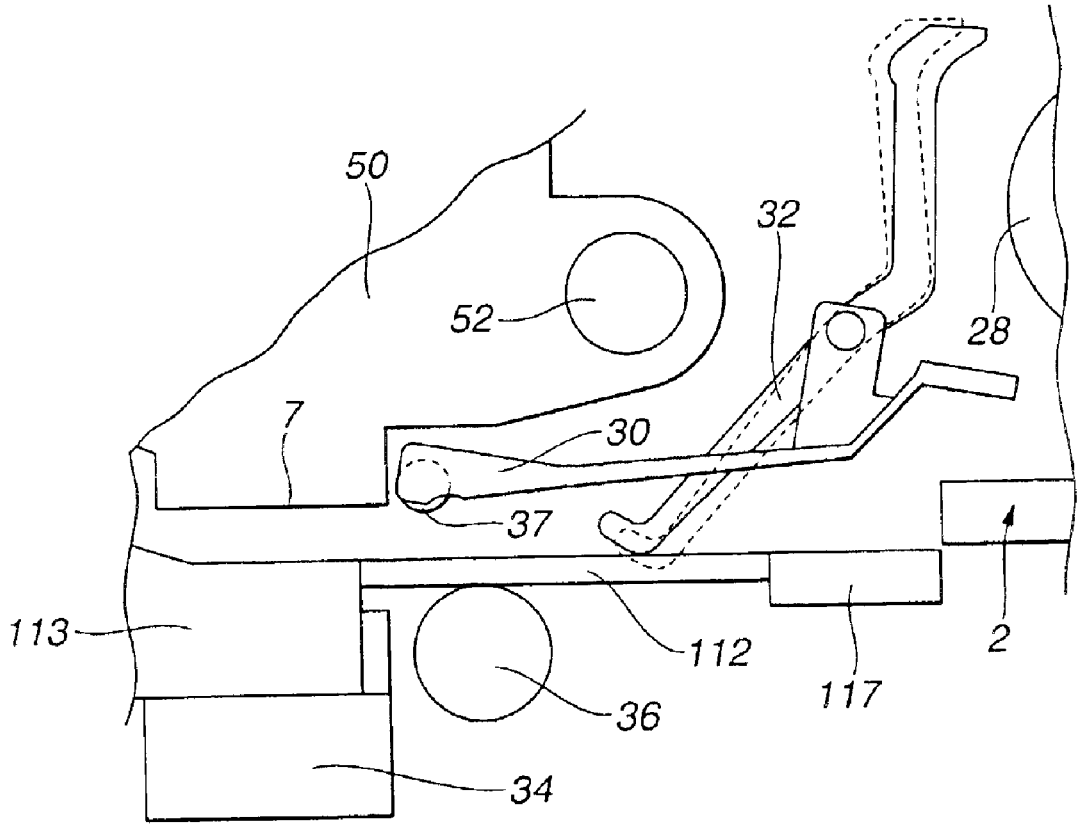
FIG. 62 is a schematic side view illustrating a portion near a PE sensor according to the fourth embodiment.
Figure 63:
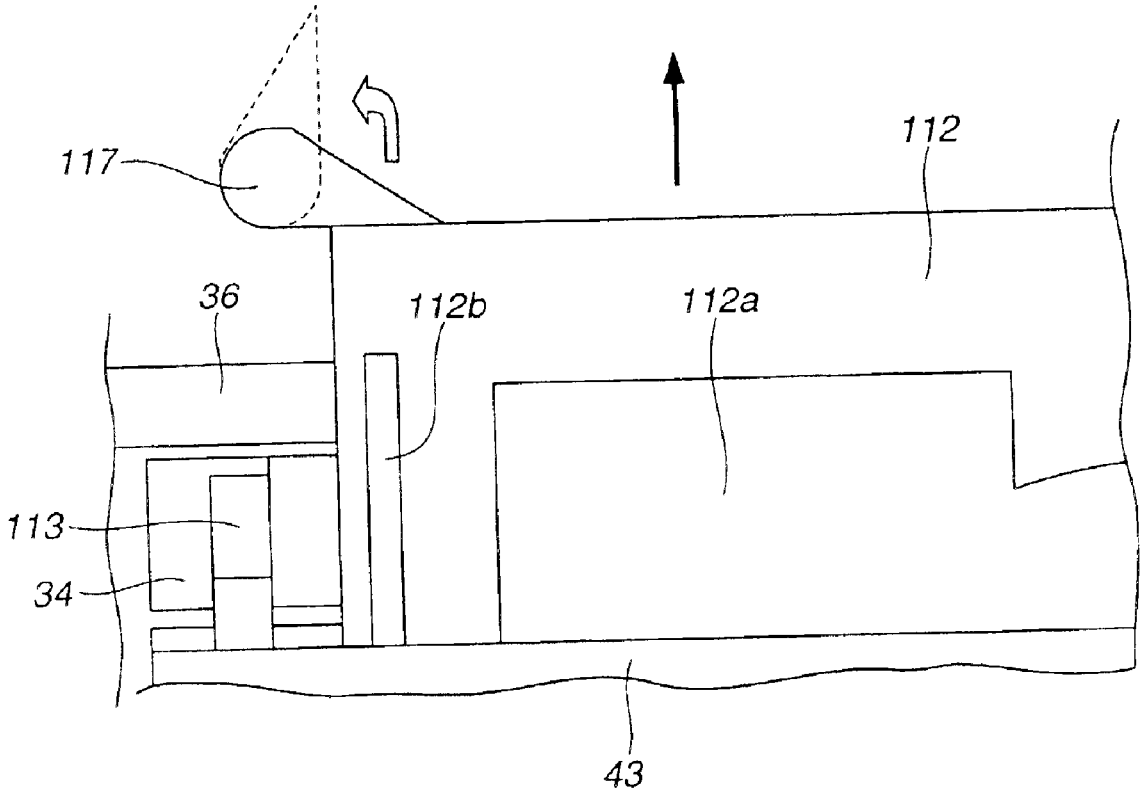
FIG. 63 is a schematic plan view illustrating a portion near a regulating member according to the fourth embodiment.

Then, the user mounts a recording material, such as a CD or the like, on the tray 112 (STEP 4). When the tray 112 is pushed into a more rear portion than the conveying roller 35 (STEP 5), then, as shown in FIG. 62, the leading edge of the PE sensor 32 provided in the main body of the recording apparatus is raised by the tray 112 that has entered, and the PE sensor 32 thereby detects entrance of the tray 112. When the user pushes the tray 112 to this position, it is regulated so as not to further push the tray 112. That is, in FIG. 63, a regulating member 117 is held to a position indicated by solid lines instead of a position indicated by broken lines, and further insertion of the tray 112 by the user is regulated.

In this state, an instruction to start recording is transmitted from a printer driver (STEP 6). If the PE sensor 32 does not detect the tray 112 at that time, the alarm display is performed (STEP 7), and the instruction of recording is not executed (STEP 8). The alarm display is performed until the PE sensor 32 detects the tray 112.

Figure 61C:
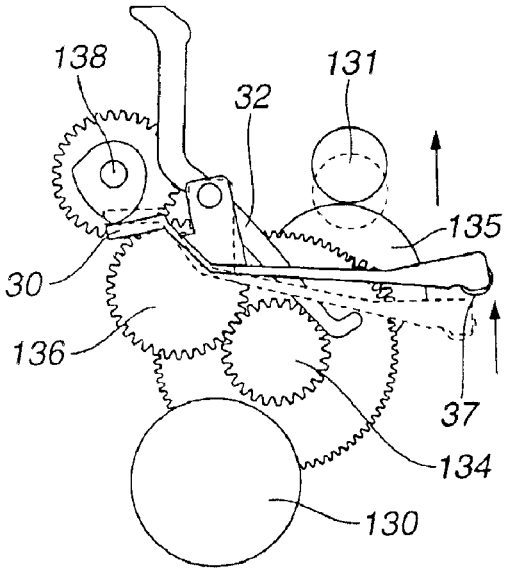
Figure 61D:
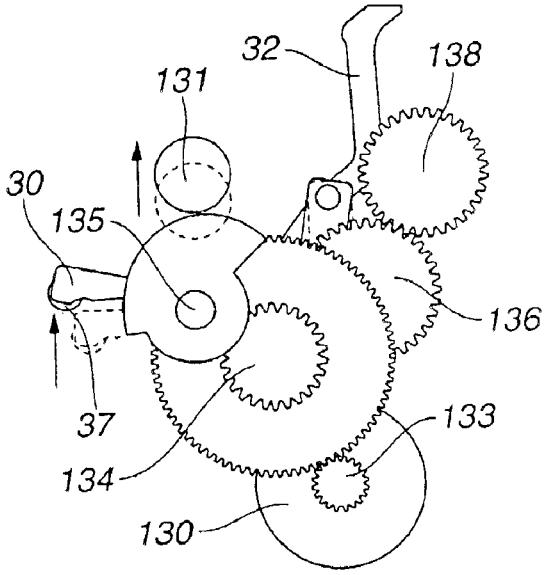
Figure 64:
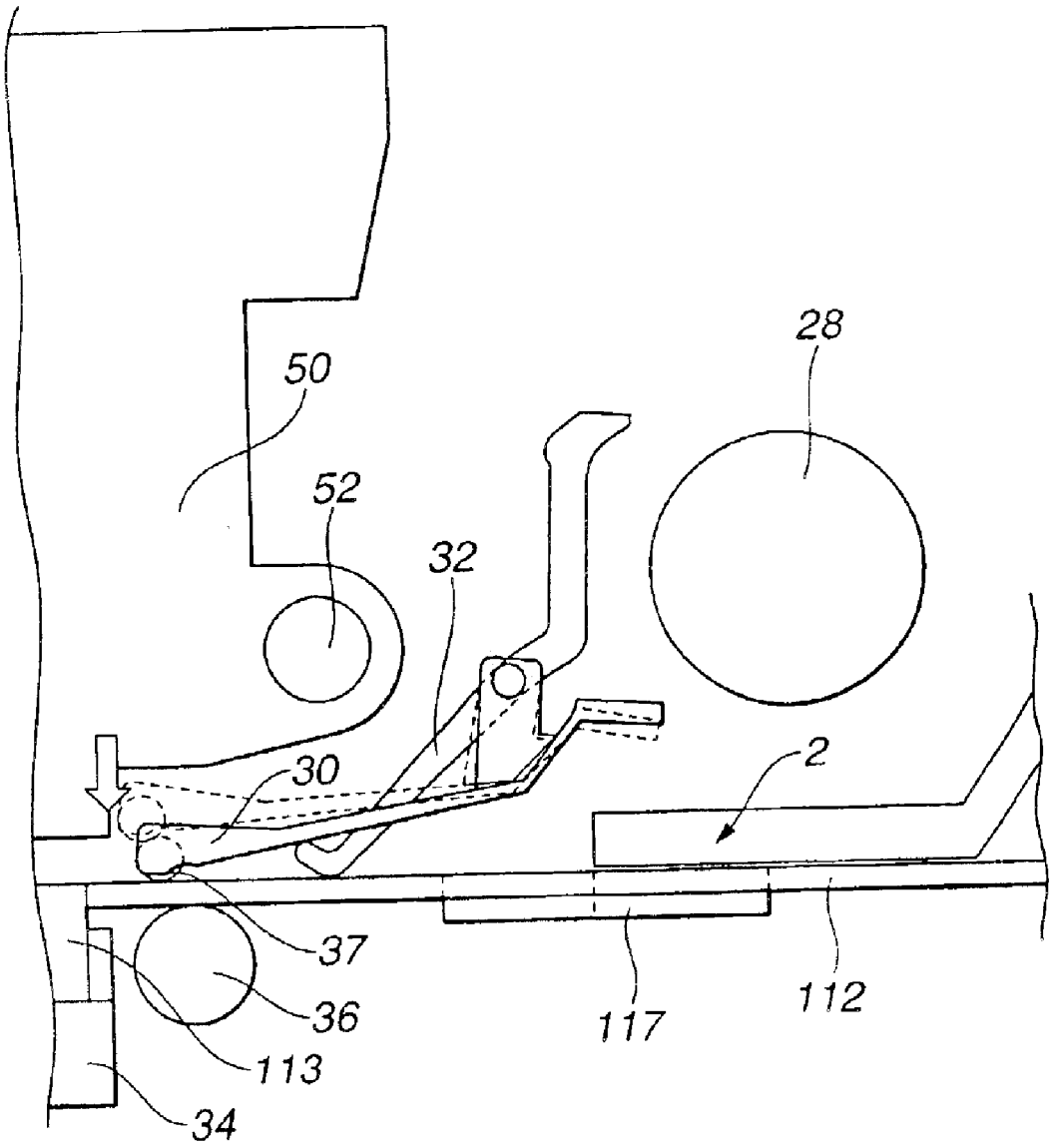
FIG. 64 is a schematic side view illustrating a retracted state of the regulating member of the fourth embodiment.
Figure 65A:
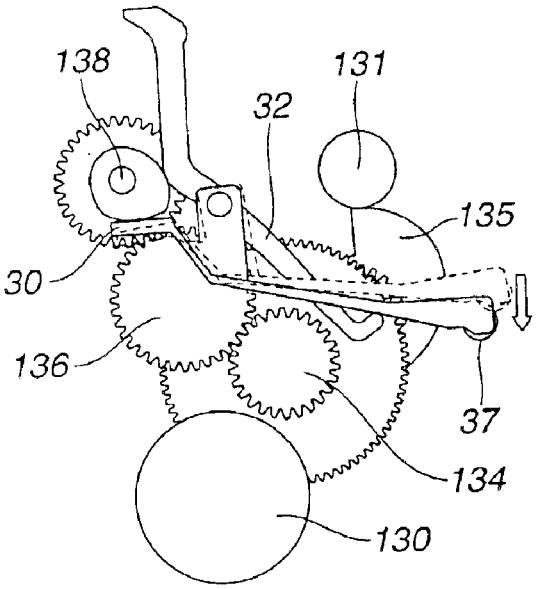
FIGS. 65A and 65B are diagrams illustrating a retraction mechanism according to the fourth embodiment.
Figure 65B:
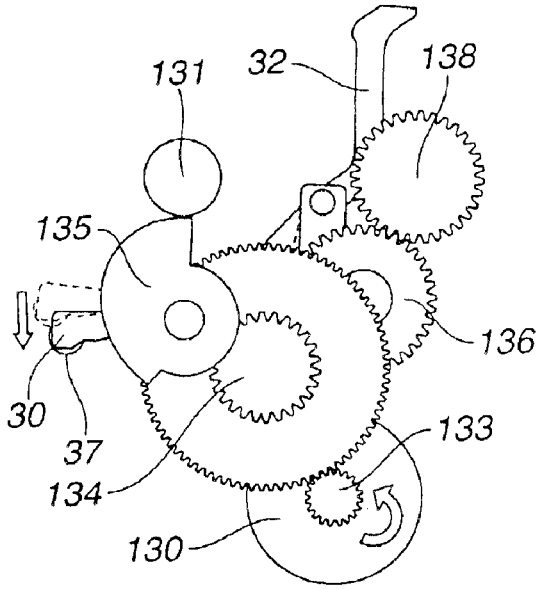

When the PE sensor 32 detects the tray 112, the pinch roller 37 moves in the direction of an arrow shown in FIG. 64, and nips the tray 112 in cooperation with the conveying roller 35 (STEP 9). A state before the pinch roller 37 nips the tray 112 is shown in FIGS. 61C and 61D. When the PE sensor 32 detects entrance of the tray 112 in this state, the retraction motor 130 revolves in a counterclockwise direction as indicated by an arrow shown in FIG. 65B, and a driving force is transmitted from a retraction-motor pinion 133 to the retraction three-stage gear 134. This driving force is divided in the direction of the carriage 50 and in the direction of the pinch roller 37. The driving force in the direction of the carriage 50 is then transmitted to the carriage retraction cam 135. The carriage retraction cam 135 rotates in a counterclockwise direction from the position shown in FIG. 61D to the position shown in FIG. 65B. At that time, since the cam surface of the carriage retraction cam 135 is on the same surface as the cam surface in a state shown in FIG. 61D, the position of the guide shaft 52 is the same as in the state shown in FIG. 61D.

The driving force in the direction of the pinch roller 37 is transmitted from the retraction three-stage gear 134 to the pinch-roller retraction cam 138 via the pinch-roller intermediate gear 136. The pinch-roller retraction cam 138 rotates from the position shown in FIG. 61C to the position shown in FIG. 65A in a counterclockwise direction, and the pinch-roller holder 30 and the pinch roller 37 thereby move downward. According to the above-described operation, the position of the carriage 50 does not change, and the pinch roller 37 moves downward to nip the tray 112 in cooperation with the conveying roller 35.

The conveying roller 35 conveys the tray 112 until a recess 112*a* passes through the carriage 50 (STEP 10). At that time, since the regulating member 117 retracts linked with the pinch roller 37 by an interlocking mechanism (not shown), the tray 112 can be conveyed. When the conveying roller 35 conveys the tray 112 to a position to start recording, the conveying roller 35 rotates in a counterclockwise direction to convey the tray 12 toward the sheet discharge port 116, and the ink-jet recording head 7 sequentially performs recording based on recording data (STEP 11). The tray 112 is conveyed toward the sheet discharge port 116 until it leaves the conveying roller 35 (STEPS 12 and 13). After the tray 112 leaves the conveying roller 35, the pinch roller 37 retracts upward (STEP 14).

After completion of recording, the user draws the tray 112 to a position where the recording material can be taken, and takes the recording material (STEP 15). When it is intended to continue recording (STEP 16), the user again mounts the recording material on the tray 112 (STEP 4), and again inserts the tray 112 up to the regulating member 117 (STEP 5).

When terminating recording, the tray guide 113 is detached from the sheet discharge port 116 (STEP 17). When the tray guide 113 is detached from the sheet discharge port 116, the spur base 43 returns downward, and the spur 42 is brought in pressure contact with the sheet discharge rollers 40 and 41 (STEP 19). Then, the spur-base detection sensor 114 is in an off-state (STEP 19), and the pinch roller 37 and the carriage 50 return to respective positions for ordinary recording (STEP 20).

Next, a description will be provided of a method for performing recording on a recording material, such as cardboard or the like, without using a tray in the fourth embodiment.

Figure 66:
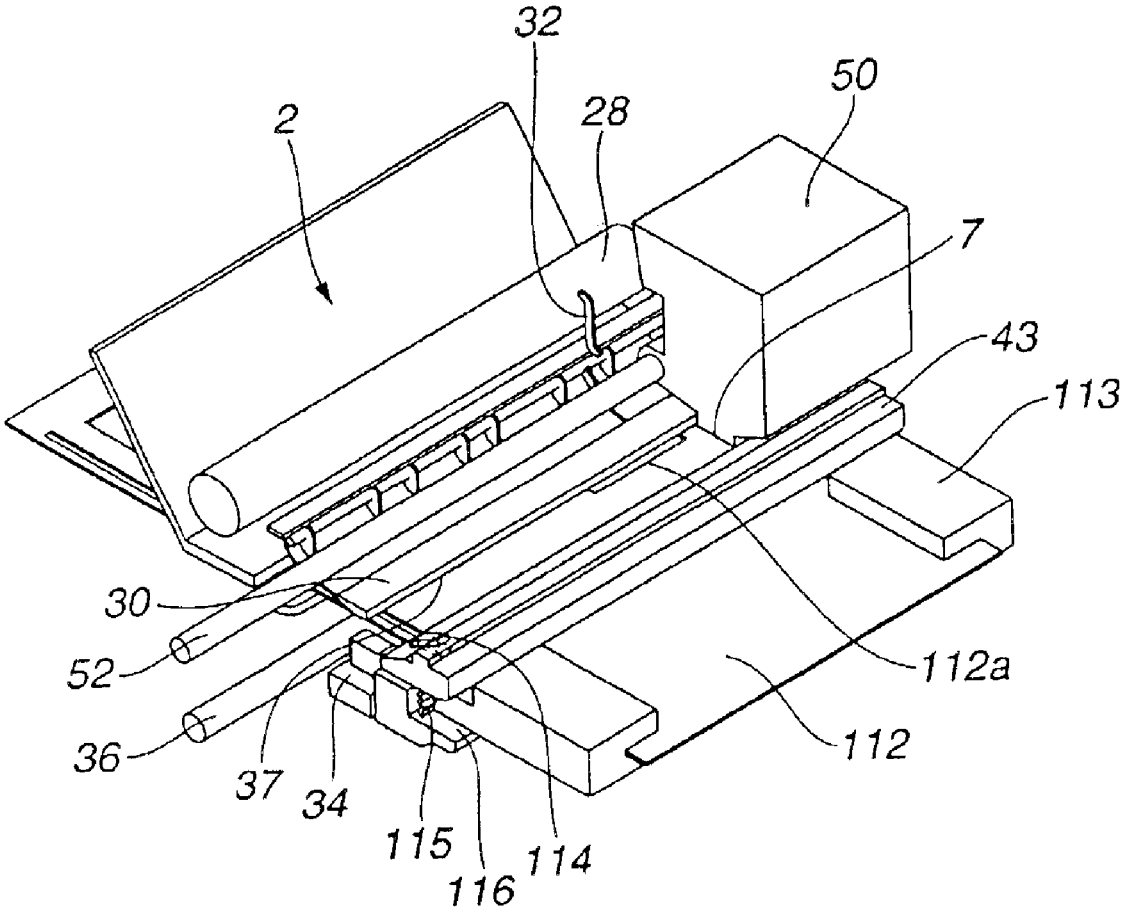
FIG. 66 is a perspective view illustrating a state of recording in which a tray is not used in the fourth embodiment.
Figure 67:
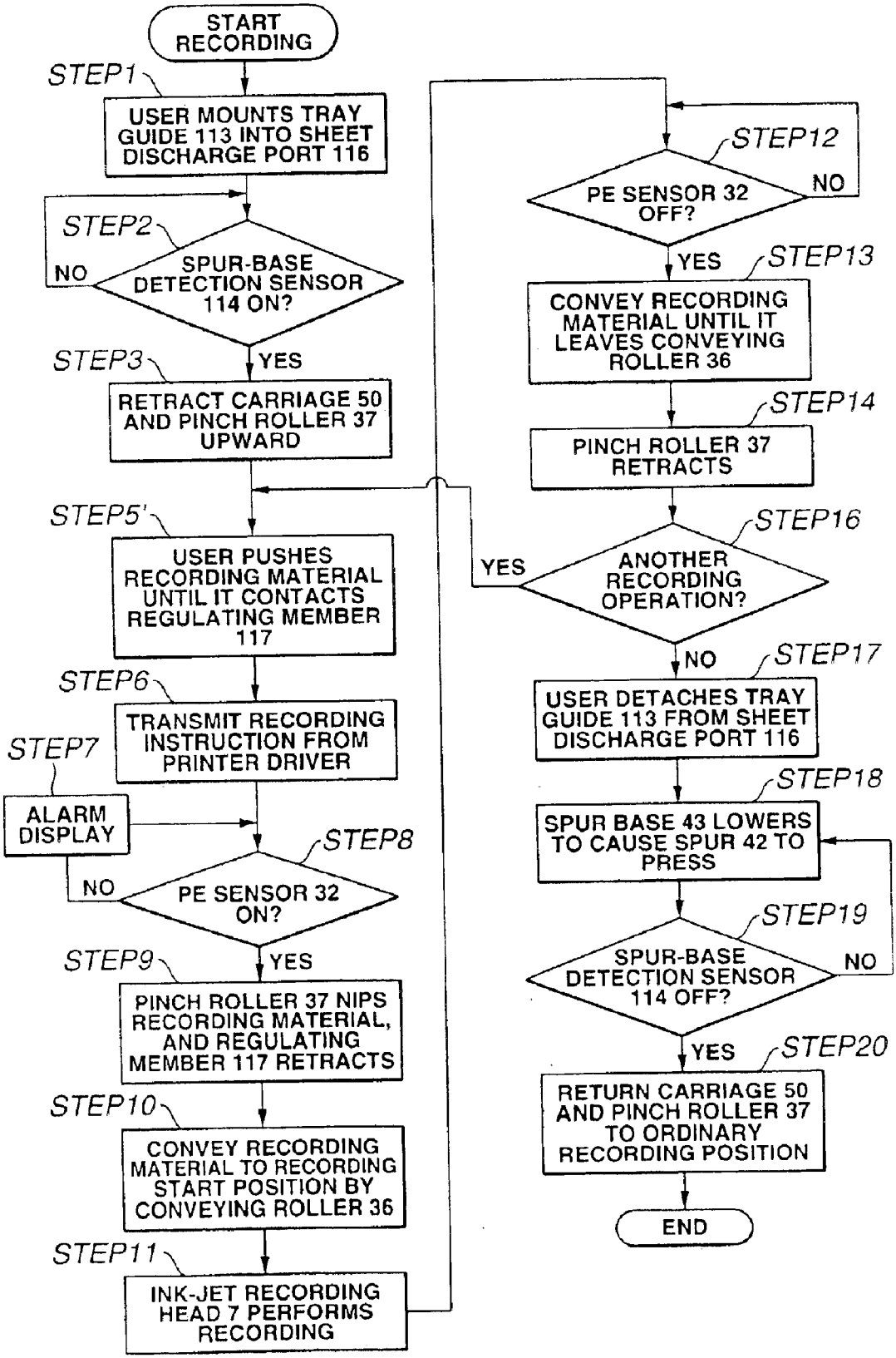
FIG. 67 is a flowchart illustrating a recording method in which a tray is not used in the fourth embodiment.

In the fourth embodiment, when performing recording on a circular recording material, such as a CD or the like, or on a small-size recording material, such as a card or the like, the recording material cannot be inserted as it is in the main body of the recording apparatus because it cannot be smoothly conveyed or may be damaged. Accordingly, the recording material is conveyed to the main body of the recording apparatus in a state of being mounted on the tray 112. However, a recording material, such as sheet-shaped cardboard or the like, that can be smoothly conveyed can be mounted directly on the tray guide 113 without using the tray 112, as shown in FIG. 66, and recording can be performed on the recording material. FIG. 67 is a flowchart illustrating a series of processes for that operation.

First, the recording material is mounted on the tray guide 113 according to the same procedure as described above. The carriage 50 and the pinch roller 37 within the main body of the recording apparatus are retracted upward, to secure a space for entrance of the recording material into the main body of the recording apparatus (STEPS 1–3).

Then, the user pushes the recording material until it contacts the regulating member 117 (STEP 5'). Thereafter, substantially the same processes (STEPS 6–20) may be performed, except that the tray 112 in the steps shown in FIG. 55 is replaced by the recording material. However, in the processes shown in FIG. 55, STEP 15 for taking the recording material from the tray 112 is unnecessary.

The individual components shown in outline in the drawings are all well known in the recording apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording an image on a recording material using a recording head, said apparatus comprising:

a tray for mounting a recording material;

a tray guide for guiding said tray;

a discharge roller for discharging the recording material;

a platen for holding said discharge roller;

a spur for discharging the recording material by rotating in accordance with rotation of said discharge roller; and a spur base for holding said spur, wherein linked with an operation of mounting said tray guide into a main body of said recording apparatus, said discharge roller and said spur are separated from each other by insertion of an arm of said tray guide between said platen and said spur base.

2. A recording apparatus according to claim 1, wherein when said arm is inserted between said platen and said spur base, said spur base raises with respect to said platen.

3. A recording apparatus according to claim 1, wherein said arm is vertically movable with respect to said tray guide.

4. A recording apparatus according to claim 1, wherein said platen and said spur base are urged together by a spring.

5. A recording apparatus according to claim 1, wherein said spur base is held so as to be rotatable and vertically movable with respect to said platen.

6. A recording apparatus according to claim 5, wherein when said arm is inserted, a downstream side of said spur base is first separated from said platen, and thereafter an upstream side of said spur base is separated.

7. A recording apparatus according to claim 1, further comprising a grounding member mounted on said spur base, and wherein a portion of said grounding member is an elastically deformable narrow portion.

8. A recording apparatus according to claim 1, further comprising a lead wire having one end fixed on said spur base, and having another end fixed on said platen, wherein said lead wire has a deflection margin between said spur base and said platen.

9. A recording apparatus according to claim 1, wherein said arm is held on said tray guide via an elastic member.

10. A recording apparatus according to claim 1, further comprising a carriage for mounting the recording head, wherein linked with the operation of mounting said tray guide into said main body of said recording apparatus, separation between said carriage and said platen, and separation between said sheet discharge roller and said spur are performed.

11. A recording apparatus according to claim 10, further comprising a hook for locking said arm of said tray guide, wherein by mounting of said tray guide into said main body, locking by said hook is released.

12. A recording apparatus according to claim 10, further comprising means for detecting a position of said carriage, and determining whether or not an interval between said carriage and said platen is to be changed in accordance with the detected position.

13. A recording apparatus according to claim 1, wherein linked with the operation of mounting said tray guide into said main body, a path for entrance of the recording material is secured by means for releasing a blocking member for blocking entrance of the recording material.

14. A recording apparatus according to claim 13, further comprising detection means for detecting entrance of said tray guide, wherein when mounting said tray guide into the main body, if entrance of said tray guide is detected, at least one of an operation of separating a carriage for mounting the recording head from said platen, and an operation of releasing pressing of a pinch roller facing a conveying roller is performed.

15. A recording apparatus according to claim 13, further comprising detection means for detecting release of said blocking member, wherein when release of said blocking member is detected, at least one of an operation of separating a carriage for mounting the recording head from said platen, and an operation of releasing pressing of a pinch roller facing a conveying roller is performed.

16. A recording apparatus according to claim 13, further comprising a cam for performing at least one of an operation of releasing said blocking member for blocking entrance of the recording material, an operation of separating a carriage for mounting the recording head from said platen, and an operation of releasing pressing of a pinch roller against a conveying roller is provided in said tray guide.

17. A recording apparatus according to claim 13, further comprising an actuator for performing at least one of an operation of releasing said blocking member for blocking entrance of the recording material, an operation of separating a carriage for mounting the recording head from said platen, and an operation of releasing pressing of a pinch roller against a conveying roller.

18. A recording apparatus according to claim 13, further comprising detection means for detecting that the recording material or said tray is inserted to a conveying roller, and means for, when detected that the recording material or said tray is inserted to the conveying roller, bringing a pinch roller in pressure contact with the recording material or said tray, and the recording material or said tray is conveyed by the conveying roller.

19. A recording apparatus according to claim 13, further comprising means for, when the recording material or said tray is conveyed by a conveying roller and is separated from a pinch roller, releasing pressing of the pinch roller against the conveying roller.

20. A recording apparatus according to claim 13, further comprising a regulating member for regulating further entrance of the recording material or said tray when the recording material or said tray enters said main body and is inserted to a conveying roller.

21. A recording apparatus according to claim 1, wherein when said tray guide is not correctly set, entrance of said tray is blocked, and when said tray guide and said tray are correctly set, connection between said arm of said tray guide and a hook of said main body cannot be released.

22. A recording apparatus according to claim 21, wherein said arm of said tray guide performs blocking of entrance of said tray and release of the connection of the arm with said main body.

23. A recording apparatus according to claim 22, wherein said arm is obliquely slid with respect to a direction of entrance of said tray.

24. A recording apparatus according to claim 23, wherein by drawing said arm to a front side, connection between said arm and said hook is released.

25. A recording apparatus according to claim 22, further comprising a rotation knob connected to said arm.

26. A recording apparatus according to claim 25, wherein by rotation of said rotation knob from a position to block entrance of said tray, connection between said arm and said hook is released.

27. A recording apparatus according to claim 21, wherein when the connection between said arm and said hook is released, said main body is changed from a tray feeding configuration to a standard-paper feeding configuration.

* * * * *

UNITED STATES PATENT AND TRADEMARK OFFICE

CERTIFICATE OF CORRECTION

PATENT NO. : 6,869,235 B2 
DATED : March 22, 2005
INVENTOR(S) : Koichiro Kawaguchi et al.

It is certified that error appears in the above-identified patent and that said Letters Patent is hereby corrected as shown below:

Title page,
Item [56], References Cited, FOREIGN PATENT DOCUMENTS,

| | | | | | |
|---|---|---|---|---|---|
| "JP | 11179888 | 07/1999" should read -- JP | 11-179888 | 7/1999 --. |
| "JP | 2001199598 | 07/2001" should read -- JP | 2001-199598 | 7/2001 --. |

Signed and Sealed this

Eighteenth Day of April, 2006

JON W. DUDAS
*Director of the United States Patent and Trademark Office*